US012043428B2

(12) United States Patent
Daniel, III et al.

(10) Patent No.: US 12,043,428 B2
(45) Date of Patent: Jul. 23, 2024

(54) BANKNOTE STRAPPING DEVICE AND METHODS

(71) Applicant: Cummins-Allison Corp., Mt. Prospect, IL (US)

(72) Inventors: John H. Daniel, III, Batavia, IL (US); Douglas Guarascio, Naperville, IL (US); Carl James Sarro, Hampshire, IL (US); Charles P. Jenrick, Schaumburg, IL (US)

(73) Assignee: Cummins-Allison Corp., Mt. Prospect, IL (US)

( * ) Notice: Subject to any disclaimer, the term of this patent is extended or adjusted under 35 U.S.C. 154(b) by 82 days.

(21) Appl. No.: 16/932,509

(22) Filed: Jul. 17, 2020

(65) Prior Publication Data

US 2021/0016909 A1 Jan. 21, 2021

Related U.S. Application Data

(60) Provisional application No. 62/876,443, filed on Jul. 19, 2019.

(51) Int. Cl.

| | |
|---|---|
| ***B65B 27/00*** | (2006.01) |
| ***B65B 13/02*** | (2006.01) |
| ***B65B 27/08*** | (2006.01) |
| ***B65B 35/50*** | (2006.01) |

(52) U.S. Cl.

CPC ..... *B65B 27/08* (2013.01); *B65B 13/02* (2013.01); *B65B 35/50* (2013.01)

(58) Field of Classification Search

CPC ..... B65B 27/08; B65B 13/02; B65B 35/50

USPC ..... 53/399

See application file for complete search history.

(56) References Cited

U.S. PATENT DOCUMENTS

| | | | | |
|---|---|---|---|---|
| 3,944,460 | A | 3/1976 | Karr | |
| 5,126,002 | A * | 6/1992 | Iwata | B65B 27/08 156/475 |
| 5,546,730 | A * | 8/1996 | Newell | B65B 11/585 53/399 |
| 7,686,151 | B2 | 3/2010 | Renz et al. | |
| 8,544,656 | B2 | 10/2013 | Mennie et al. | |

(Continued)

OTHER PUBLICATIONS

International Search Report and Written Opinion of the International Searching Authority dated Apr. 11, 2024, in connection with International Application No. PCT/US2024/012965, 10 pages.

*Primary Examiner* — Eyamindae C Jallow

(57) ABSTRACT

A banknote strapping device comprises a banknote floor moveable generally parallel to a first linear direction from a floor home position to a floor strapping position, a banknote cradle having a cradle stacking position, and a plunger assembly having an anvil, wherein the plunger assembly is configured to move the anvil generally parallel to the first linear direction from an anvil home position on a first side of the cradle stacking position of the banknote cradle to an anvil strapping position located on a second side of the cradle stacking position. When a first predetermined number of banknotes have been stacked on the banknote cradle, a stack of banknotes that had been stacked thereupon is transferred to the banknote floor positioned at the floor home position, wherein the anvil moves the stack of banknotes and the banknote floor to a strapping position at which the stack of banknotes is strapped.

9 Claims, 34 Drawing Sheets

(56) References Cited

U.S. PATENT DOCUMENTS

| | | | | |
|---|---|---|---|---|
| 8,925,448 | B2 | 1/2015 | Sakoguchi et al. | |
| 8,978,970 | B2 | 3/2015 | Nobuhara et al. | |
| 9,092,925 | B2 | 7/2015 | Otsuka | |
| 2008/0060906 | A1* | 3/2008 | Fitzgerald | G07D 11/50 194/207 |
| 2011/0072987 | A1* | 3/2011 | Nobuhara | G07D 11/16 700/214 |
| 2013/0340397 | A1* | 12/2013 | Okamoto | B65B 25/14 53/582 |
| 2014/0044515 | A1* | 2/2014 | Liu | B65H 39/105 414/788.1 |
| 2014/0053505 | A1* | 2/2014 | Meersoek | B65B 13/14 53/399 |
| 2014/0182248 | A1* | 7/2014 | Sakoguchi | B65B 27/08 53/540 |
| 2015/0368057 | A1* | 12/2015 | Hou | B65H 31/26 271/220 |
| 2016/0086416 | A1* | 3/2016 | Razzaboni | B65H 31/04 53/268 |
| 2016/0368632 | A1 | 12/2016 | Sakoguchi et al. | |

* cited by examiner

BANKNOTE STRAPPING DEVICE AND METHODS

CROSS-REFERENCE TO RELATED APPLICATIONS

This application claims the benefit of and priority to U.S. Provisional Patent Application No. 62/876,443, which was filed on Jul. 19, 2019, which is incorporated herein by reference in its entirety.

TECHNICAL FIELD

The present disclosure relates generally to banknote or currency bill processing devices and related methods and more particularly to banknote or currency bill strapping devices and related methods.

BACKGROUND

Previous banknote or currency bill strapping devices have various shortcomings.

SUMMARY

According to various embodiments, a banknote strapping device comprises a banknote floor, moveable generally parallel to a first linear direction from a floor home position to a floor strapping position; and a banknote cradle having a cradle stacking position, wherein when in the cradle stacking position, the banknote cradle is positioned near the floor home position so that banknotes from a transport path may be stacked on the cradle. The banknote strapping device further comprising a plunger assembly having an anvil, wherein the plunger assembly is configured to move the anvil generally parallel to the first linear direction from a first anvil home position on a first side of the cradle stacking position of the cradle to a second anvil strapping position located on a second side of the cradle stacking position. When a first predetermined number of banknotes have been stacked on the cradle, the cradle retracts from the cradle stacking position and as the cradle moves from the cradle stacking position, a stack of banknotes that had been stacked thereupon is transferred to the banknote floor positioned at the floor home position. The anvil then travels generally parallel to the first linear direction and contacts the stack of banknotes on the floor and moves the stack of banknotes and the floor to a strapping position with the anvil at the anvil strapping position and the floor at the floor strapping position at which the stack of banknotes is strapped. The floor home position, the floor strapping position, the cradle home position, the anvil home position, and the anvil strapping position are arranged linearly generally parallel to the first linear direction.

According to various embodiments, a banknote strapping device comprises a generally vertical stacking and strapping column; and a banknote floor residing within the generally vertical stacking and strapping column and moveable generally vertically within the column, the banknote floor being biased upward to a floor home position. The banknote strapping device further comprises a banknote cradle having a cradle stacking position and a cradle retracted position, wherein when in the cradle stacking position, the banknote cradle is positioned within the stacking and strapping column above the banknote floor so that banknotes from a transport path may be stacked on the cradle, wherein when in the cradle retracted position, the banknote cradle is not positioned in the stacking and strapping column. The banknote strapping device further comprises a plunger assembly having an anvil, wherein the plunger assembly is configured to move the anvil generally vertically downward within the stacking and strapping column from an upper anvil home position above the cradle stacking position of the cradle to a lower strapping position; wherein when a first predetermined number of banknotes have been stacked on the cradle, the cradle retracts from the cradle stacking position and the cradle retracted position and wherein as the cradle moves from the cradle stacking position to the cradle retracted position, a stack of banknotes that had been stacked thereupon is transferred to the banknote floor positioned at the floor home position; wherein the anvil then travels generally vertically downward and contacts a top banknote in the stack of banknotes on the floor and pushes the stack of banknotes and the floor to a strapping position at which the stack of banknotes is strapped; wherein the cradle returns to the cradle stacking position while the anvil is positioned below the cradle stacking position; and wherein, after the stack of banknotes has been strapped, the plunger assembly pivots the anvil out of the stacking and strapping column, then raises the anvil above the cradle stacking position, and then pivots the anvil back into the stacking and strapping column.

According to various embodiments, a method of strapping banknotes using a banknote strapping device comprising a banknote floor moveable generally parallel to a first linear direction from a floor home position to a floor strapping position; a banknote cradle having a cradle stacking position; and a plunger assembly having an anvil is provided. The method comprises stacking banknotes on the banknote cradle when the cradle is in the cradle stacking position positioned near the floor home position; when a first predetermined number of banknotes have been stacked on the cradle, retracting the cradle from the cradle stacking position and transferring a stack of banknotes that had been stacked on the cradle to the banknote floor positioned at the floor home position; moving the anvil generally parallel to the first linear direction from an anvil home position on a first side of the cradle stacking position of the cradle toward a second anvil strapping position located on a second side of the cradle stacking position; while moving the anvil, the anvil contacting a stack of banknotes on the floor and moving the stack of banknotes and the floor to a strapping position at which the stack of banknotes is strapped with the anvil being positioned at the anvil strapping position and the floor being positioned at the floor strapping position; and strapping the stack of banknotes at the strapping position; wherein the floor home position, the floor strapping position, the cradle home position, the anvil home position, and the anvil strapping position are arranged linearly generally parallel to the first linear direction.

The above summary is not intended to represent every embodiment or every aspect of the present disclosure. Rather, the foregoing summary merely provides an exemplification of some of the novel aspects and features set forth herein. The above features and advantages, and other features and advantages of the present disclosure, which are considered to be inventive singly or in any combination, will be readily apparent from the following detailed description of representative embodiments and modes for carrying out the present inventions when taken in connection with the accompanying drawings and the appended claims.

BRIEF DESCRIPTION OF THE DRAWINGS

For a more complete understanding of this disclosure, reference is now made to the following description, taken in conjunction with the accompanying drawings, in which.

Figure 1:
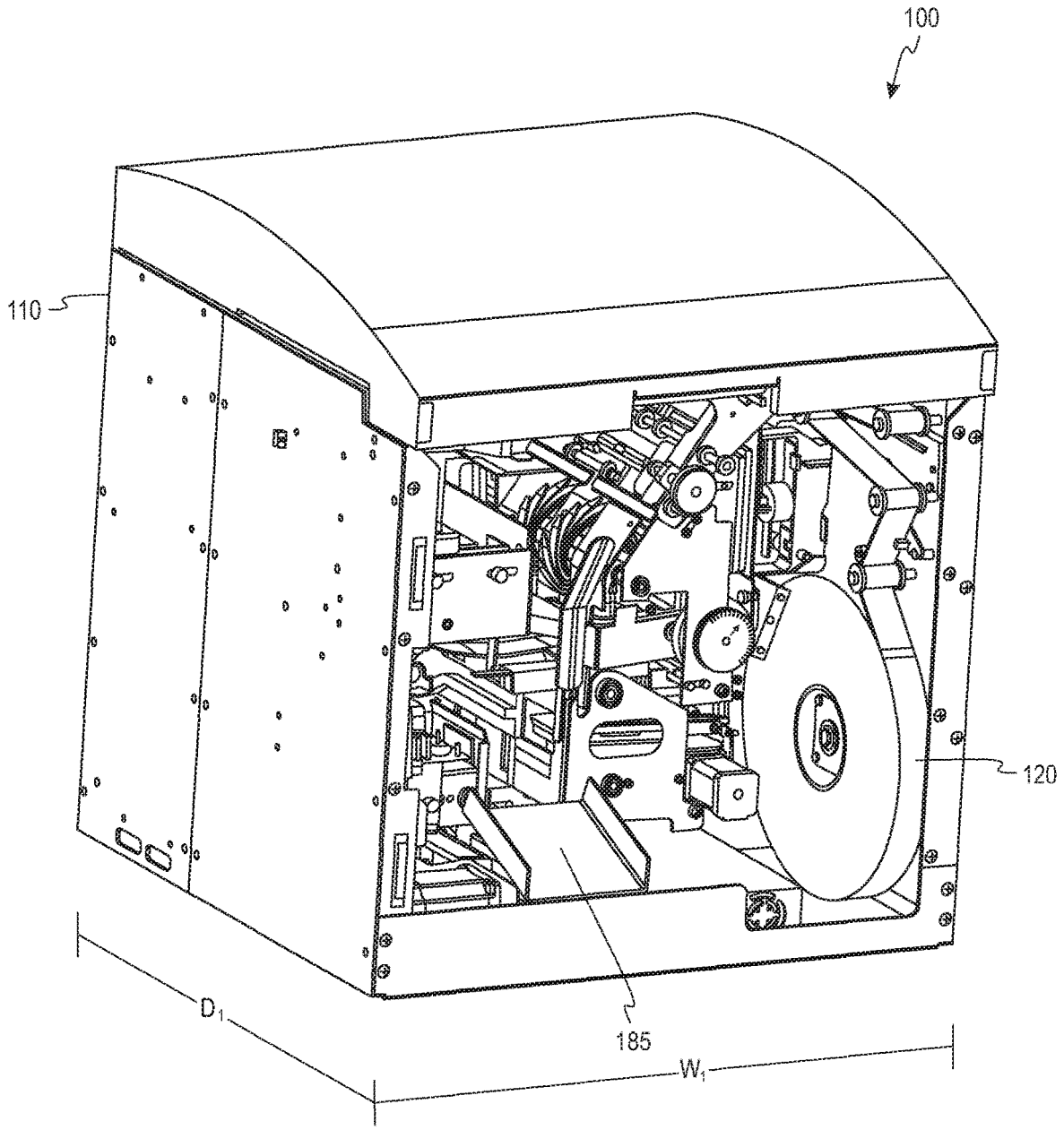
FIG. 1 illustrates a perspective view of a banknote strapping device in accordance with various embodiments of this disclosure.

The present disclosure is susceptible to various modifications and alternative forms, and various representative embodiments have been shown by way of example in the drawings and will be described in detail herein. It should be understood, however, that the inventive aspects are not limited to the particular forms illustrated in the drawings. Rather, the disclosure is to cover all modifications, equivalents, combinations, and alternatives falling within the spirit and scope of the inventions as defined by the appended claims.

Before undertaking the DETAILED DESCRIPTION below, it may be advantageous to set forth definitions of certain words and phrases used throughout this patent document. The term "couple" and its derivatives refer to any direct or indirect communication between two or more elements, whether or not those elements are in physical contact with one another. The terms "transmit," "receive," and "communicate," as well as derivatives thereof, encompass both direct and indirect communication. The terms "include" and "comprise," as well as derivatives thereof, mean inclusion without limitation. The term "or" is inclusive, meaning and/or. The phrase "associated with," as well as derivatives thereof, means to include, be included within, interconnect with, contain, be contained within, connect to or with, couple to or with, be communicable with, cooperate with, interleave, juxtapose, be proximate to, be bound to or with, have, have a property of, have a relationship to or with, or the like. The term "controller" means any device, system or part thereof that controls at least one operation. Such a controller may be implemented in hardware or a combination of hardware and software and/or firmware. The functionality associated with any particular controller may be centralized or distributed, whether locally or remotely. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

DETAILED DESCRIPTION

FIGS. 1 through 16B, discussed below, and the various embodiments used to describe the principles of the present invention in this patent document are by way of illustration only and should not be construed in any way to limit the scope of the disclosure. Those skilled in the art will understand that the principles of this disclosure may be implemented in any suitably arranged device or system.

FIG. 1 illustrates a perspective view of a banknote strapping device 100 in accordance with various embodiments of this disclosure. FIG. 1 illustrates that the banknote strapping device 100 includes a housing 110. The housing 110 includes strapping material 120 for use in strapping banknotes and an output dispensing ramp 185 upon which a strapped stack of banknotes can be ejected from the strapping device 100. According to various embodiments, the strapping device 100 has a width $W_1$ of about 20 inches (51 cm), a depth $D_1$ of about 20 inches (51 cm) and a height $H_1$ of about 22 inches (56 cm), although it will be understood that the banknote strapping device 100 can have various dimensions.

Figure 2:
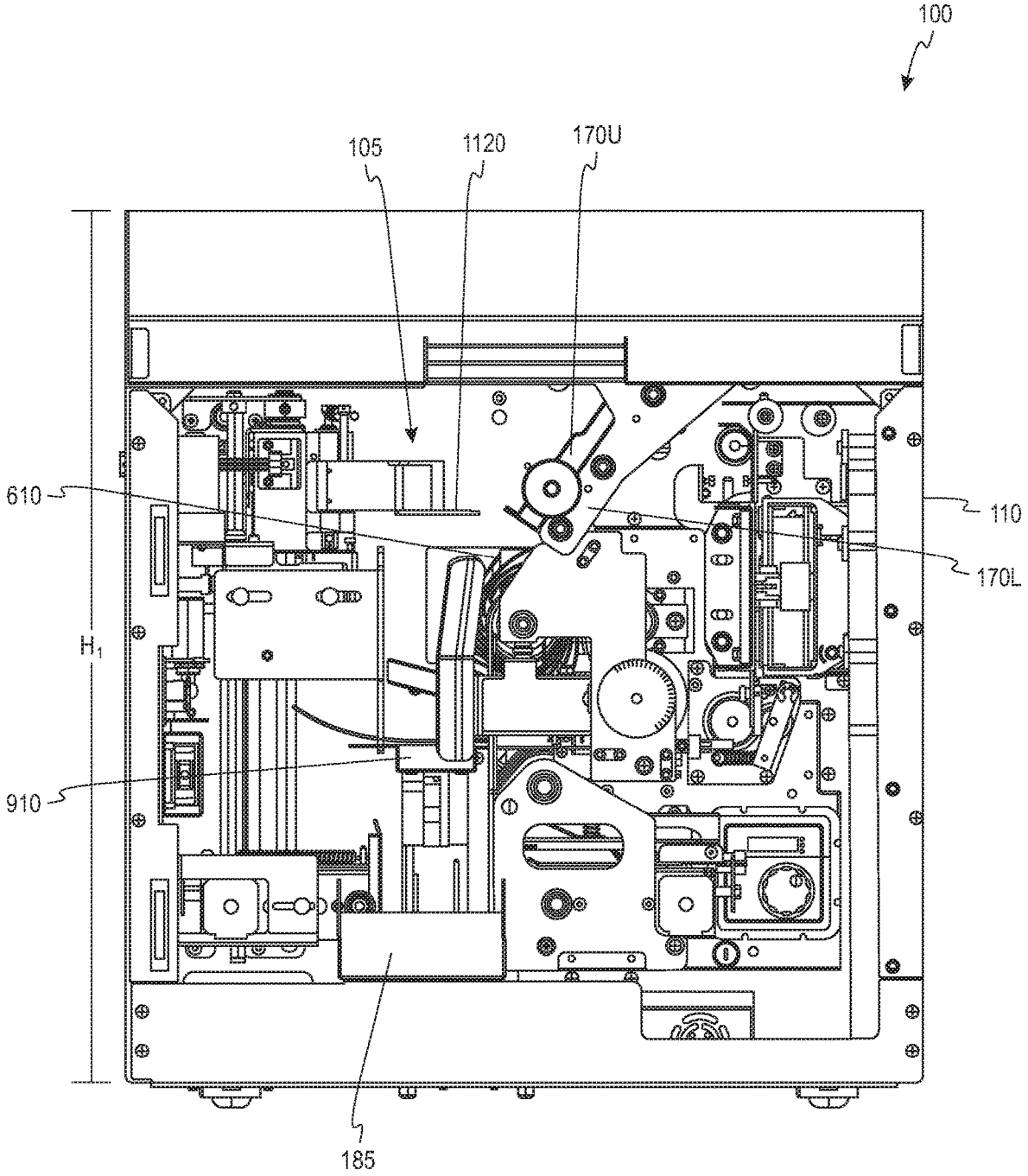
FIG. 2 illustrates a front view of the banknote strapping device of FIG. 1 in accordance with various embodiments of this disclosure.
Figure 3:
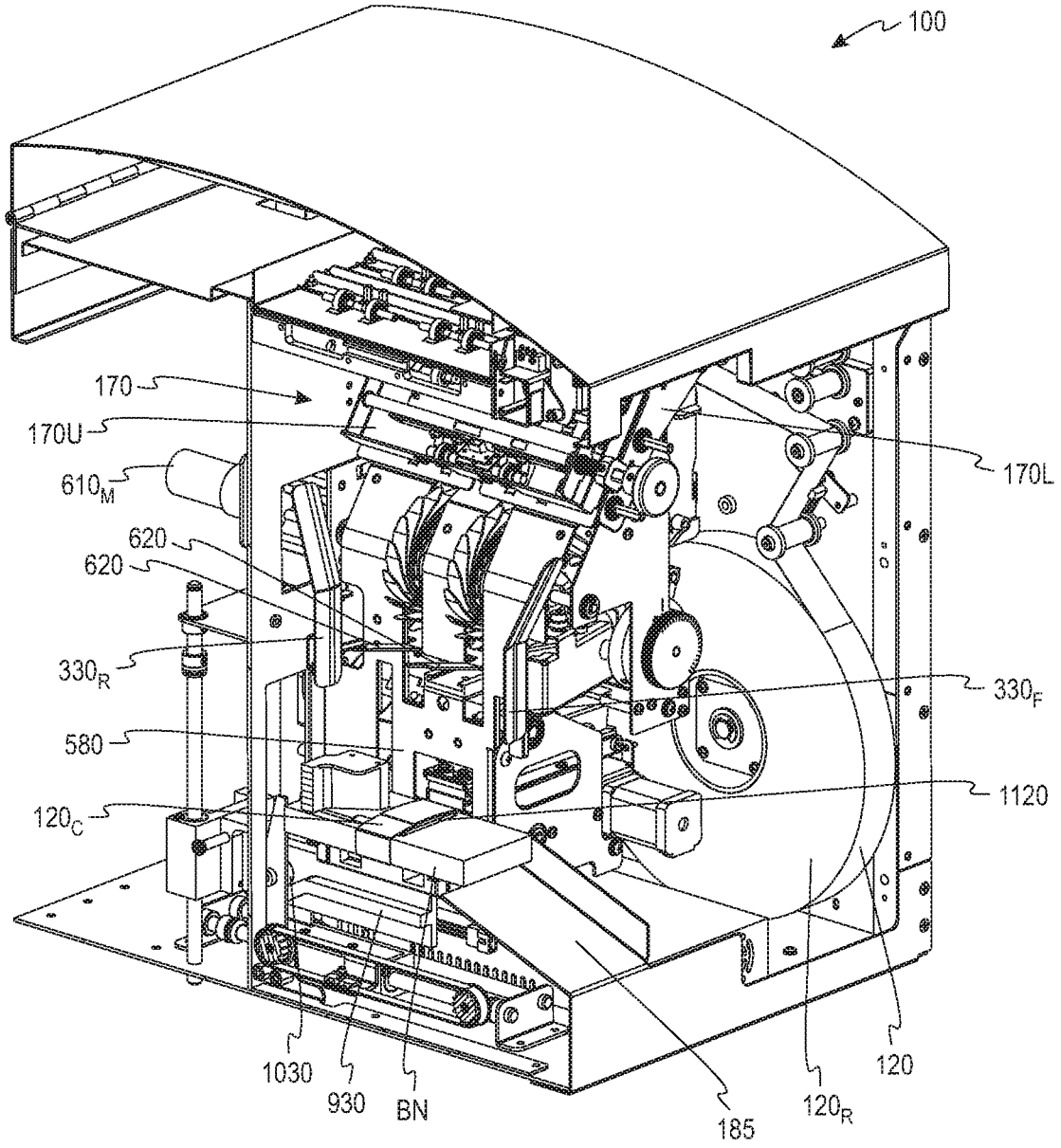
FIG. 3 illustrates a sectional perspective view of the banknote strapping device of FIG. 1 showing a strapped stack of banknotes in accordance with various embodiments of this disclosure.

FIG. 2 illustrates a front view of the banknote strapping device 100 in accordance with various embodiments of this disclosure. FIG. 3 illustrates a sectional perspective view of the banknote strapping device of FIG. 1 showing a strapped stack of banknotes BN in accordance with various embodiments of this disclosure. FIGS. 4A-4K illustrate front sectional views of the banknote strapping device of FIG. 1, illustrating various positions of components during the process of receiving and strapping a stack of banknotes in accordance with various embodiments of this disclosure. According to various embodiments, FIGS. 4A-4K illustrate sequential steps in a process of strapping a stack of banknotes using the banknote strapping device 100.

Figure 4A:
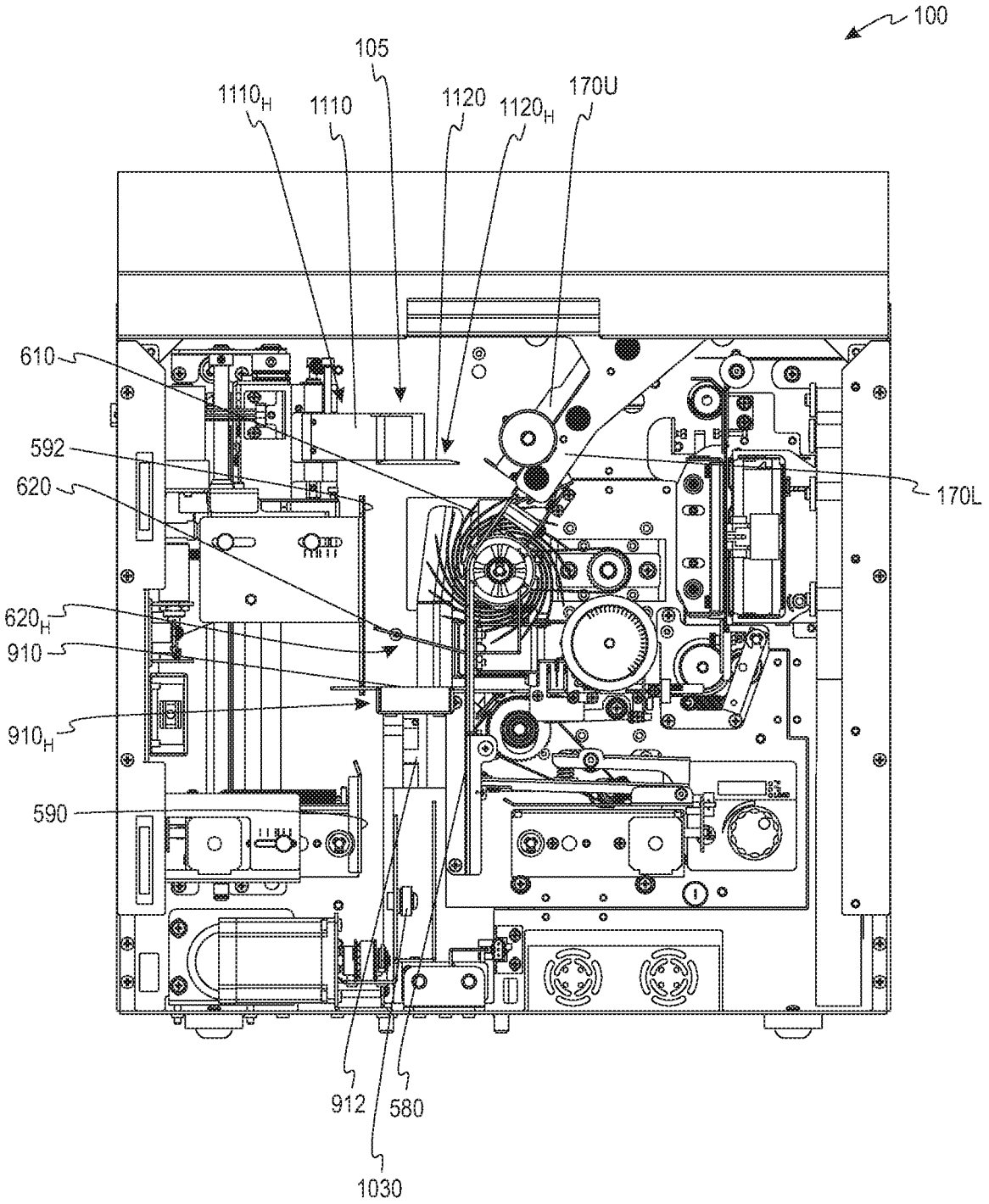
FIGS. 4A-4K illustrate front sectional views of the banknote strapping device of FIG. 1 illustrating various positions of components during the process of receiving and strapping a stack of banknotes in accordance with various embodiments of this disclosure.

According to various embodiments, the banknote strapping device 100 comprises a strapping transport mechanism 170 configured to transport banknotes sequentially in a non-overlapping manner along a strapping transport path to one or more stacker wheels 610 (see, e.g., FIGS. 2, 3, and 4A). According to various embodiments, the strapping transport mechanism comprises an upper transport plate 170U and a lower transport plate 170L defining the strapping transport path therebetween (see, e.g., FIGS. 2, 3 and 4A). According to various embodiments, the stacker wheels 610 are rotationally driven and controlled by a stacker wheel motor $\mathbf{610}_M$ (see FIGS. 3 and 6A) communicatively coupled to a processor, e.g., processor 1375 (FIG. 13).

Figure 13:
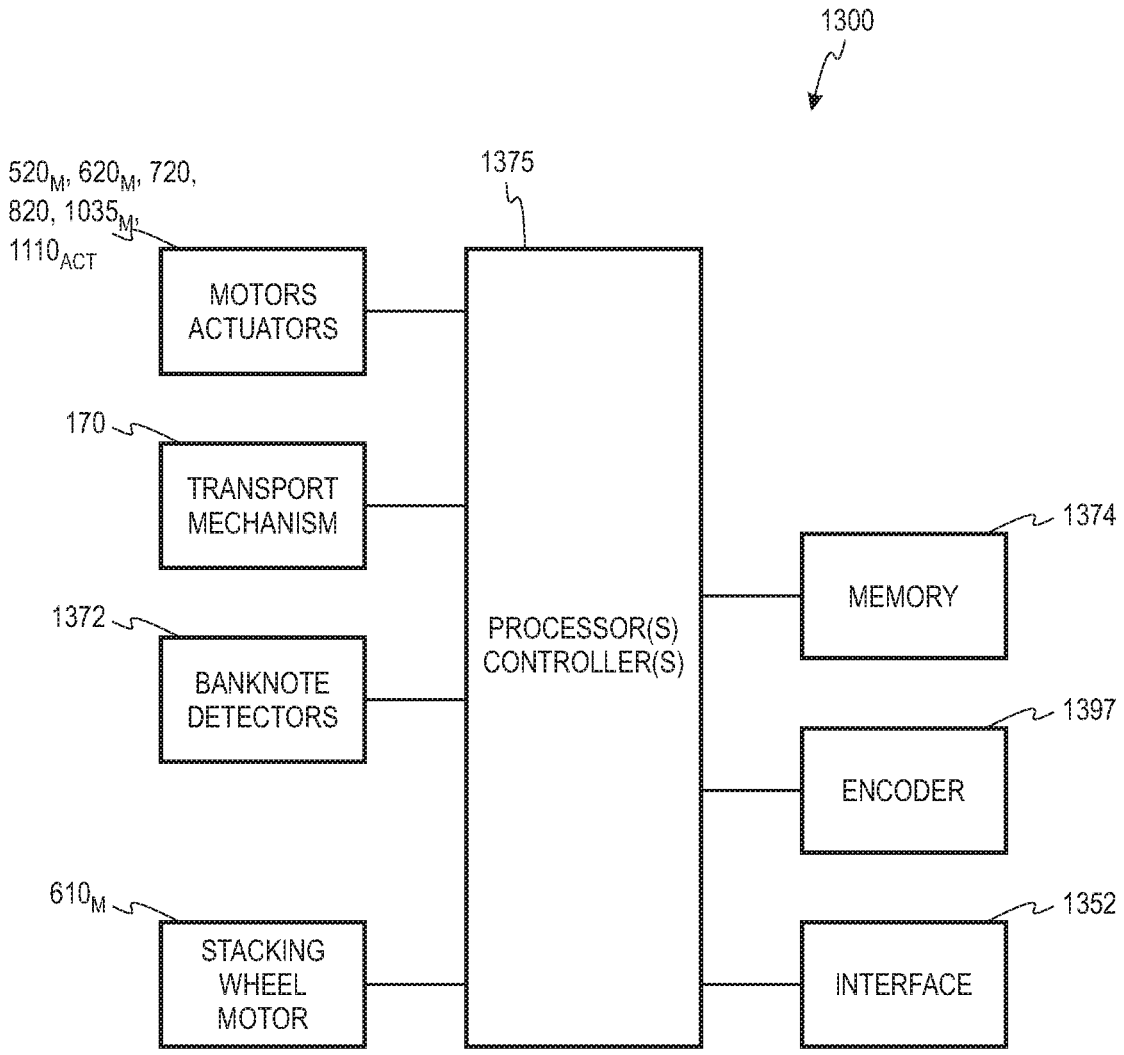
FIG. 13 illustrates a block diagram of various components of a banknote processing system or device in accordance with various embodiments of this disclosure.

According to various embodiments, strapping transport mechanism 170 comprises one or more driven transport rolls to transport banknotes along the strapping transport path to the stacker wheels 610 and the driven transport rolls are rotationally driven and controlled by one or more transport motors communicatively coupled to a processor, e.g., processor 1375 (FIG. 13).

Banknotes received by the stacker wheels 610 are then stacked on a cradle 620 positioned in a cradle home or stacking position $\mathbf{620}_H$ (see, e.g., FIG. 4A) located within a generally vertical stacking and strapping column 105 (see, e.g., FIGS. 2 and 4A). According to various embodiments, the cradle 620 comprises one or more cradle arms $\mathbf{620}_A$ (see, e.g., FIGS. 6A and 6B). The cradle 620 positioned in a cradle home or stacking position $\mathbf{620}_H$ (see, e.g., FIG. 4A) is sometimes referred to as a banknote escrow location. According to various embodiments, the cradle 620 is configured to accommodate the stacking of as many as 100 to 125 banknotes thereon.

According to various embodiments, one or more tamping arms such as front tamping arm $\mathbf{330}_F$ and rear tamping arm $\mathbf{330}_R$ may be employed to tap the front and rear edges of banknotes BN as they are being stacked on the cradle 620 and/or are in a stack of banknotes resting on the cradle 620 (see, e.g., FIG. 3). According to various embodiments, the one or more tamping arms $\mathbf{330}_F$, $\mathbf{330}_R$, move forward and backward in a reciprocating manner and their motion may be coordinated so the tamping arms $\mathbf{330}_F$, $\mathbf{330}_R$ move to their innermost positions at the same time.

According to various embodiments, the banknote strapping device 100 comprises a reel or roll $\mathbf{120}_R$ of strapping material 120 within the housing 110 (see, e.g., FIG. 3).

FIG. 4A illustrates a front view of the banknote strapping device 100 of FIG. 1 illustrating various components positioned in their initial positions prior to any banknotes having been received in the stacker wheels 610 or on the cradle 620. In FIG. 4A, a plunger module or assembly 1100 (see FIG. 11A) comprising a plunger arm 1110 and an anvil 1120 are shown in their respective plunger arm home position $\mathbf{1110}_H$ and upper anvil home position $\mathbf{1120}_H$. The cradle 620 is positioned in a cradle home or stacking position $\mathbf{620}_H$ and a floor 910 is positioned in a floor home position $\mathbf{910}_H$. As can be seen in FIG. 4A, the anvil 1120 in the anvil home position $\mathbf{1120}_H$, the cradle 620 in a cradle home or stacking position $\mathbf{620}_H$, and the floor 910 are positioned vertically with respect to each other and are all located within the generally vertical stacking and strapping column 105. In this regard, according to various embodiments, banknotes to be strapped by a strapping device 100 are all stacked in a single escrow region located in a single stacking and strapping column 105 and then strapped at a strapping position within the same stacking and strapping column 105.

According to various embodiments, the generally vertical stacking and strapping column 105 is defined in part by right surface or wall 580 on the right side and an upper left surface or wall 592 and a lower left surface or wall 590 on the left side. Tamping arms $\mathbf{330}_F$, $\mathbf{330}_R$ may also define a front and rear side of the generally vertical stacking and strapping column 105 according to various embodiments.

Figure 4B:
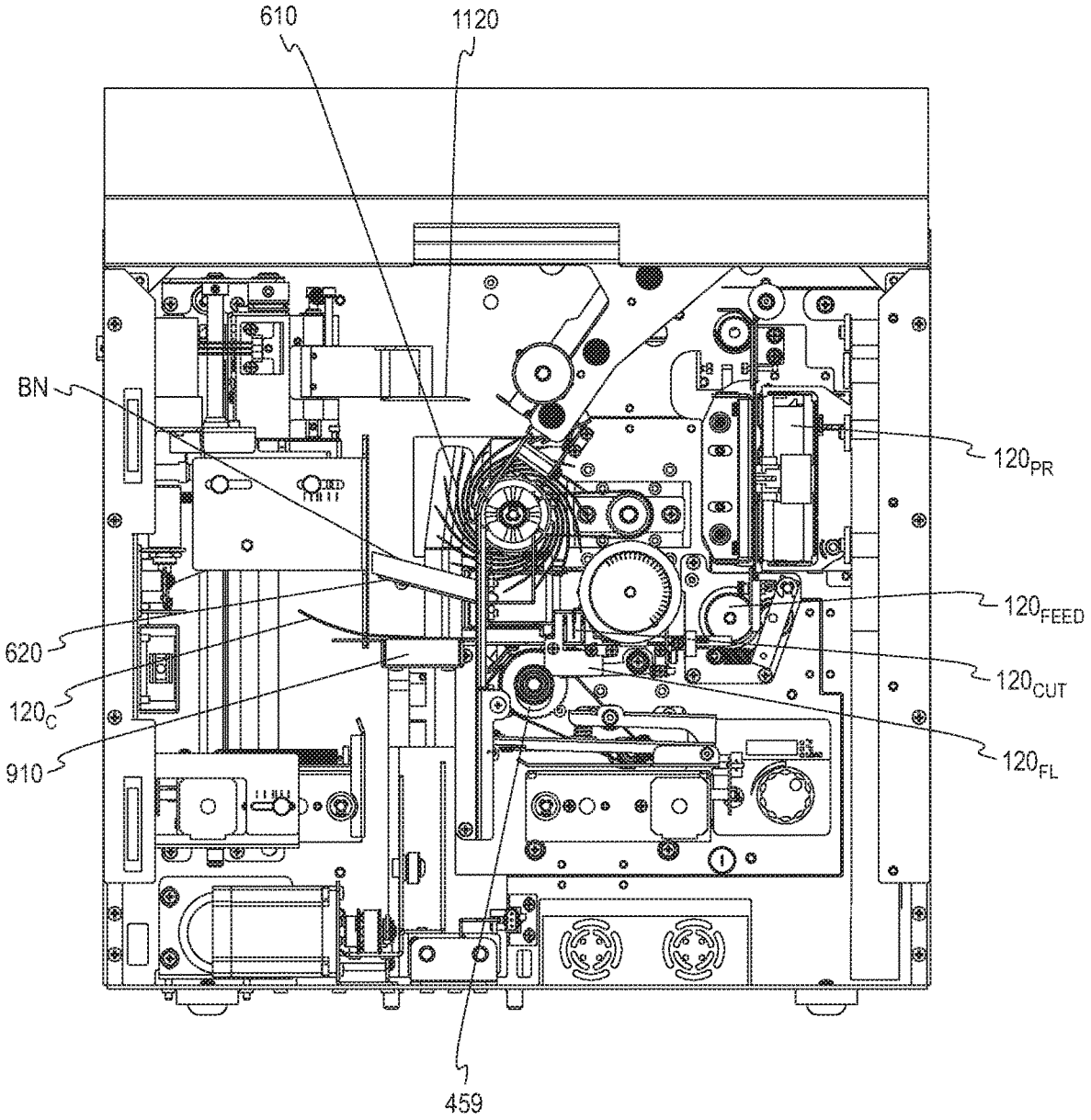

FIG. 4B illustrates various components in positions after a number of banknotes BN have been stacked on the cradle 620 while the cradle is in the cradle home or stacking position $\mathbf{620}_H$. According to various embodiments, before or after banknotes begin to be routed along the strapping transport path, a strapper printer $\mathbf{120}_{PR}$ may print desired information on a lead portion of the strapping material 120. For example, the information printed on the strapping material may include the denomination of banknotes to be stacked on the cradle, strapping device 100 identification information, banknote batch information, time and/or date information relating to the time and/or date a stack of banknotes was processed by the strapping device 100, operator information such as an operator identifier (e.g., operator name and/or number), identifying information of one or more other banknote processing devices from which the banknote strapping device 100 received the banknotes to be strapped, banknote source and/or destination information such as identification information of a customer and/or financial institution from which the banknotes originated and/or which operated the strapping device 100 and/or to which a strap of a banknotes is to be delivered, etc. After optionally having information printed thereon, the lead portion of the strapping material is cut by a strap cutter $\mathbf{120}_{CUT}$ and a lead end of a cut piece (or strap) $\mathbf{120}_C$ of strapping material 120 is transported or fed onto an upper surface of the floor 910. According to various embodiments, lead portion of the strapping material is transported or fed onto an upper surface of the floor 910 prior to the lead portion of the strapping material being cut into a strap $\mathbf{120}_C$ by the strap cutter $\mathbf{120}_{CUT}$.

According to various embodiments, the strap or piece $\mathbf{120}_C$ of strapping material 120 is cut to a standard length based on the type and/or denomination and/or width of banknotes to be strapped and not based on the quality of the banknotes to be strapped (e.g., new, brick quality; highly worn, used currency, etc.). For example, because all denominations of U.S. currency have the same dimensions including width, the length of the strap $\mathbf{120}_C$ is cut to a single standard length regardless of which denomination of U.S. banknotes is to be strapped and regardless of the quality or qualities of the banknotes to be strapped.

According to various embodiments, the length of a strap $\mathbf{120}_C$ is set using the following formula:

$$\text{Strap length}=\text{overlap}_{min}+2*\text{banknote width}+2*\text{height of stack}_{max}$$

For U.S. banknotes having a banknote width of 2.61 inches, a desired minimum overlap in the ends of the strap $\mathbf{120}_C$ ($\text{overlap}_{min}$) being set to 0.40 inches, and a maximum compressed height of a stack of unfit U.S. currency (height of $\text{stack}_{max}$) being set to 0.80 inches, a standard strap length for U.S. banknotes may be set to 7.72 inches. By contrast, according to various embodiments, the compressed height of a stack of fit U.S. banknotes may be 0.50 inches. According to various embodiments, the corresponding width of the stacking and strapping column 105 may be set to 2.64 inches providing a clearance of 0.03 inches.

According to various embodiments, strapping material is cut when a cam 459 is rotated and lifts a follower lever $\mathbf{120}_{FL}$ which drives the strapping material 120 into a serrated edge of a strap cutter $\mathbf{120}_{CUT}$. As also described herein with respect to FIGS. 14A-14C, strapping material 120 can be positioned in a strapping material transport path located partially below a guide plate 1410. According to various embodiments, the cam follower lever $\mathbf{120}_{FL}$ forces a gripper block 1402 and the strapping material 120 against spring-loaded grippers 1404. Together the gripper block 1402 and the spring-loaded grippers 1404 grasp the strapping material 120 and force the strapping material 120 through the serrated edge of the strap cutter $\mathbf{120}_{CUT}$.

Figure 14A:
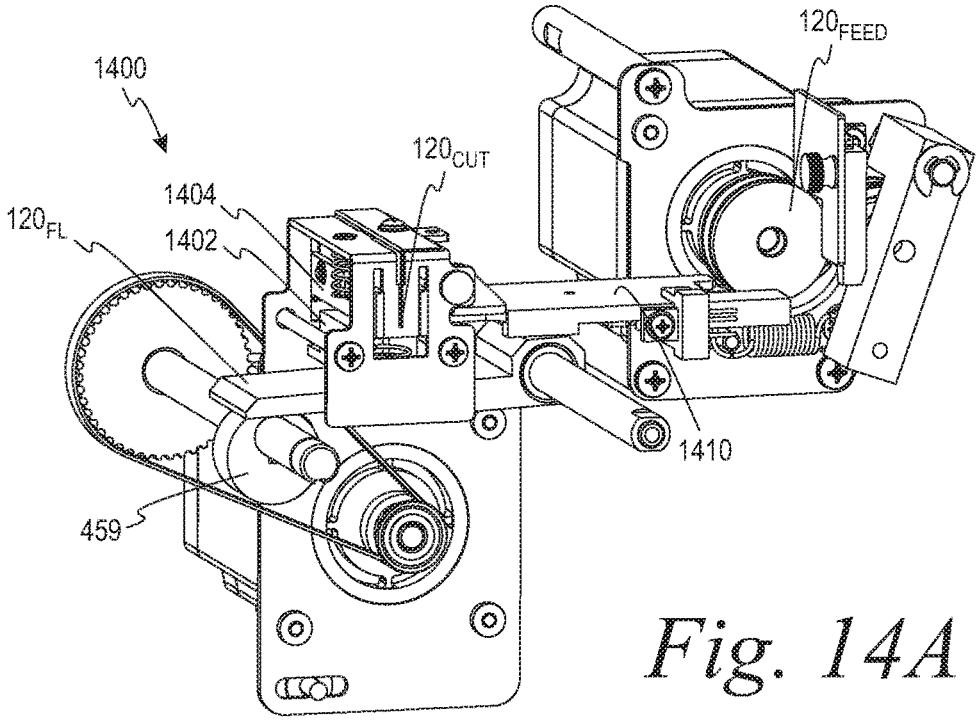
FIG. 14A illustrates a perspective view of a strap feed and strap cut mechanism of a banknote strapping device in accordance with various embodiments of this disclosure.
Figure 14B:
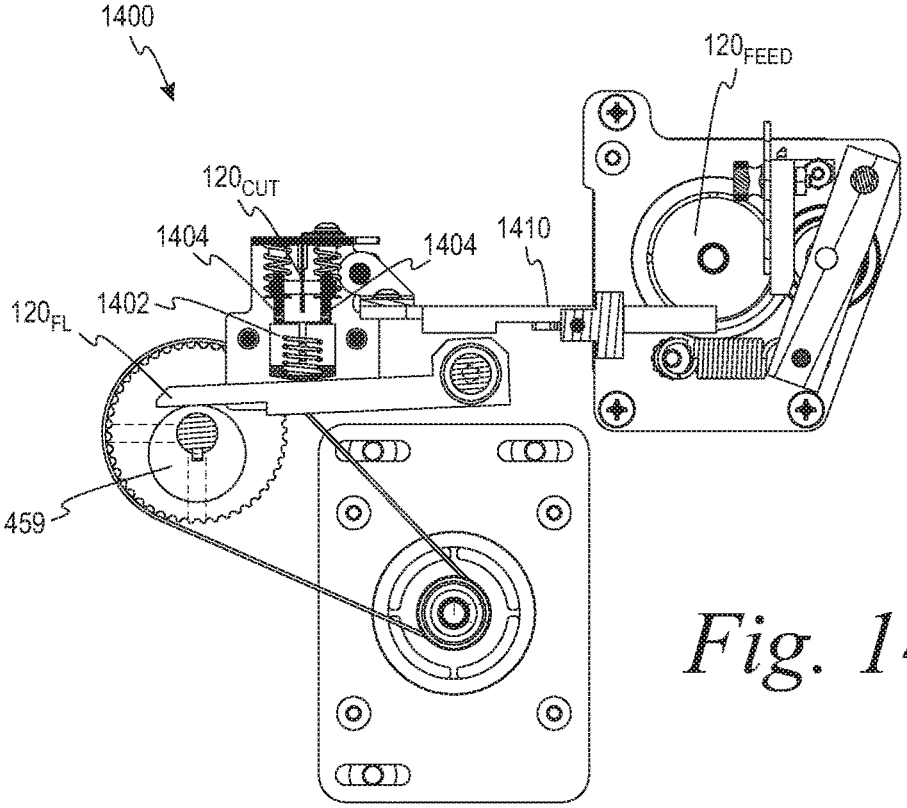
FIG. 14B illustrates a front view of a strap feed and strap cut mechanism of a banknote strapping device in accordance with various embodiments of this disclosure.
Figure 14C:
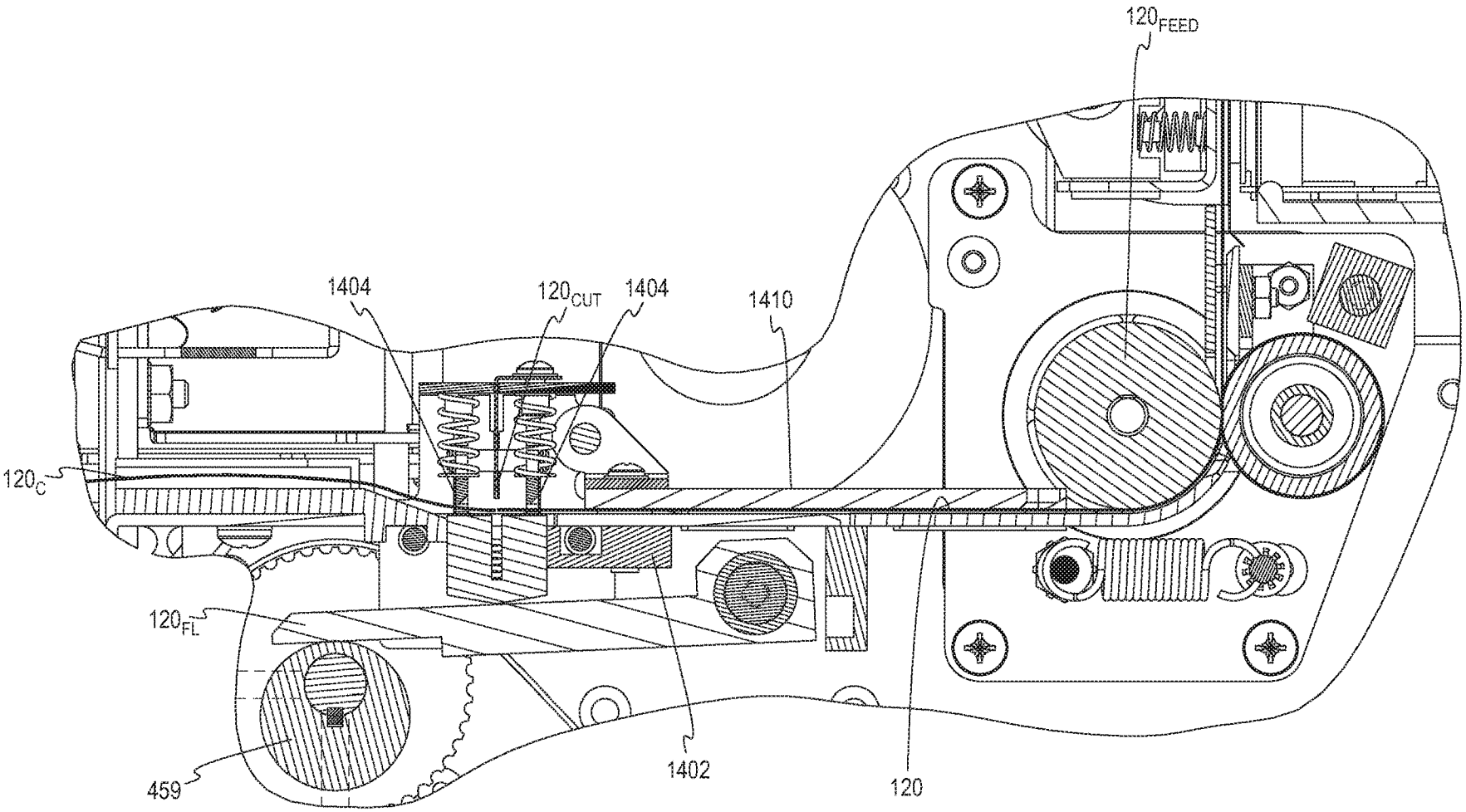
FIG. 14C illustrates a partial sectional view of a portion of a banknote strapping device in accordance with various embodiments of this disclosure.

According to various embodiments, strapping material 120 and/or cut straps $\mathbf{120}_C$ may be fed along a strapping material transport path by one or more strapping material feed rollers $\mathbf{120}_{FEED}$ (see, e.g., FIGS. 4B and 14C).

In FIG. 4B, banknotes BN begin to be sequentially transported from the strapping transport path to the stacker wheels 610 and are then stacked on the cradle 620 positioned in the cradle home or stacking position $\mathbf{620}_H$.

Figure 4C:
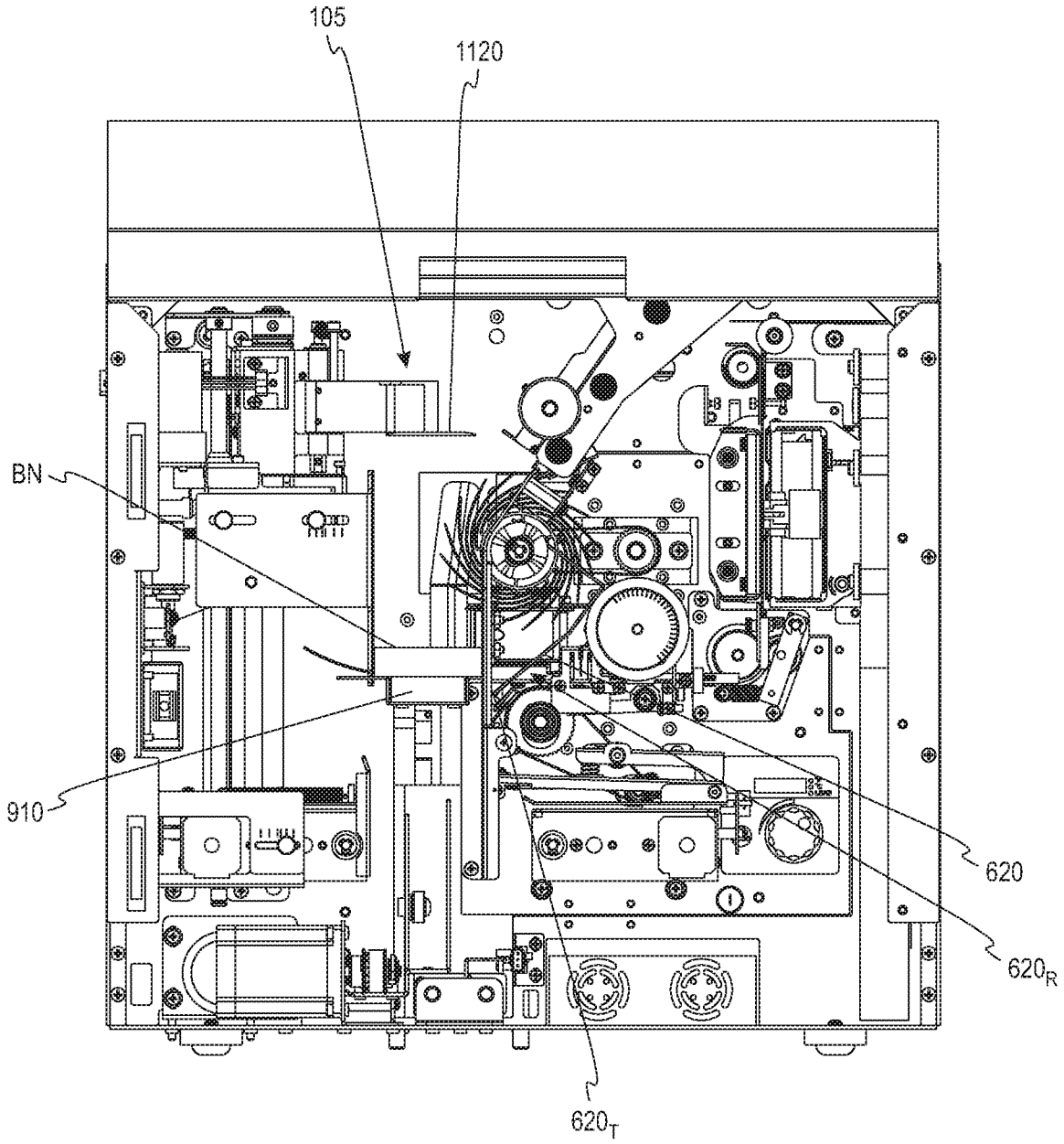

In FIG. 4C, the cradle 620 is shown in a cradle retracted position $\mathbf{620}_R$. In the cradle retracted position $\mathbf{620}_R$, ends or tips $\mathbf{620}_T$ of the cradle arms $\mathbf{620}_A$ (see, e.g., FIGS. 6A and 6B) do not extend into the stacking and strapping column 105. Banknotes are often strapped with a first predetermined number of banknotes in a strap of banknotes. Often the first predetermined number of banknotes is one hundred (100) banknotes. According to various embodiments, after a certain number of banknotes have been stacked on the cradle 620, the cradle 620 is retracted to the cradle retracted position $\mathbf{620}_R$ and the stack of banknotes that had been stacked thereon are transferred to and supported by the floor 910 with the strap or cut piece $\mathbf{120}_C$ of strapping material 120 being pinched or sandwiched between the bottom banknote in the stack of banknotes and the floor 910 and is held in place by the weight of the stack of banknotes. According to various embodiments, the certain number of banknotes is less than the first predetermined number of banknotes, e.g., the certain number may be 95, 96, 97, or 98 banknotes when the first predetermined number of banknotes is 100 banknotes. According to various embodiments, the certain number of banknotes is the first predetermined number of banknotes, that is, the cradle 620 is moved to the cradle retracted position $\mathbf{620}_R$ when a complete stack of banknotes to be strapped has been stacked upon the cradle 620.

Figure 4D:
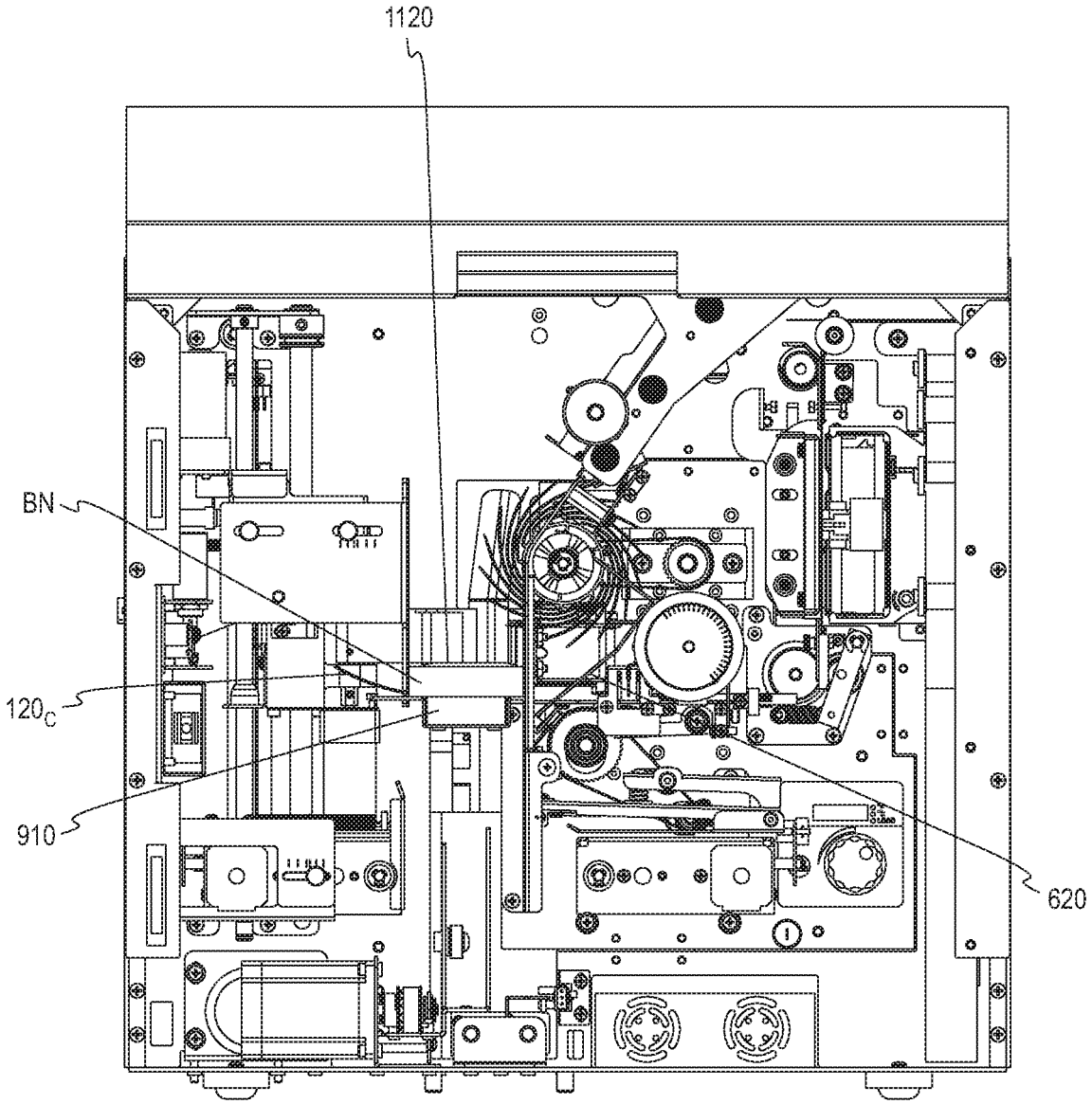
Figure 4E:
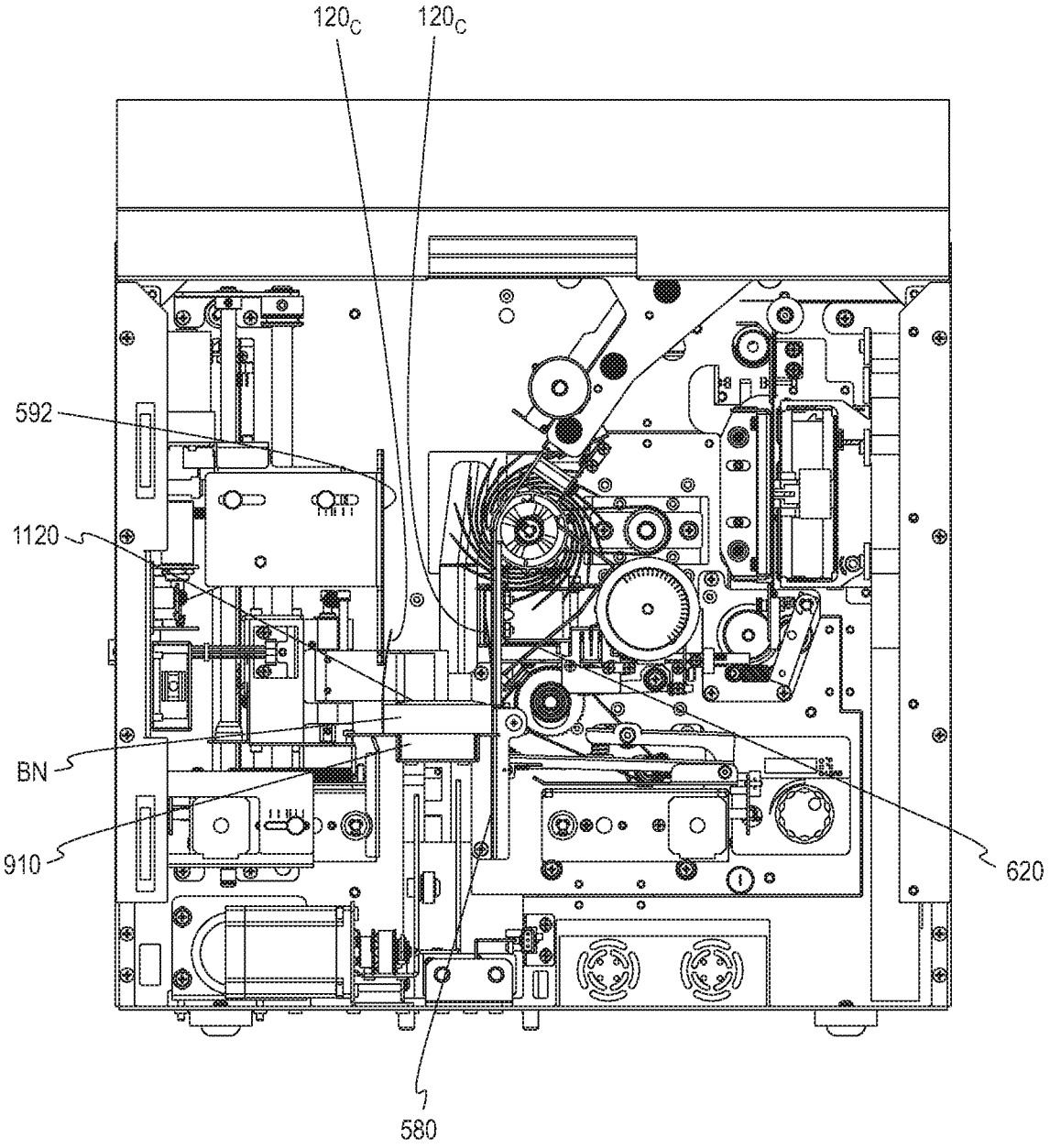
Figure 4F:
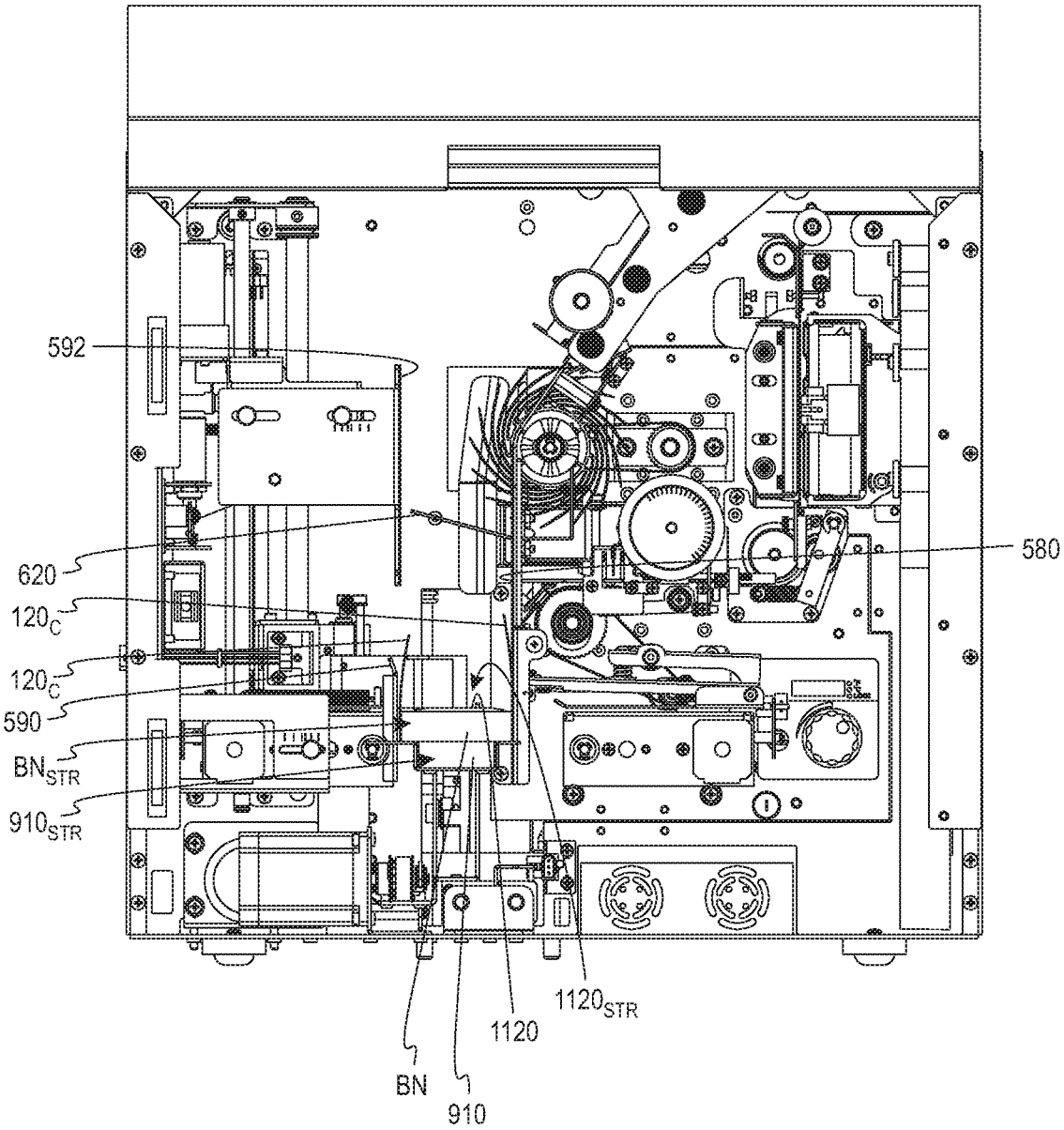

The plunger assembly 1100 is configured to move the anvil 1120 generally vertically downward within the stacking and strapping column 105 from the upper anvil home position $\mathbf{1120}_H$ above the cradle home or stacking position $\mathbf{620}_H$ to a lower anvil strapping position $\mathbf{1120}_{STR}$ (see FIG. 4F).

In FIG. 4D, the anvil 1120 has moved downward and has made contact with the top of the stack of banknotes BN supported by the floor 910. The cradle 620 is being maintained in the cradle retracted position $\mathbf{620}_R$. The anvil 1120 is moved into contact with the stack of banknotes being supporting on floor 910 after the first predetermined number (e.g., 100) of banknotes have been stacked on the floor 910.

In FIG. 4E, the anvil 1120, the stack of banknotes BN and the floor 910 have moved further downward and the anvil 1120 has moved far enough downward that the cradle 620 may be returned to the cradle home or stacking position $\mathbf{620}_H$. The strap $\mathbf{120}_C$ has two ends. As the anvil 1120, the stack of banknotes BN and the floor 910 move downward along with a middle portion of the strap $\mathbf{120}_C$ which is sandwiched between the bottom banknote in the stack of banknotes and the floor 910, the side portions of the strap $\mathbf{120}_C$ are bent upward by the sides surfaces or walls 592, 580 of the stacking and strapping column 105 so that the strap $\mathbf{120}_C$ takes on a U-shape as seen in FIG. 4E.

Figure 9A:
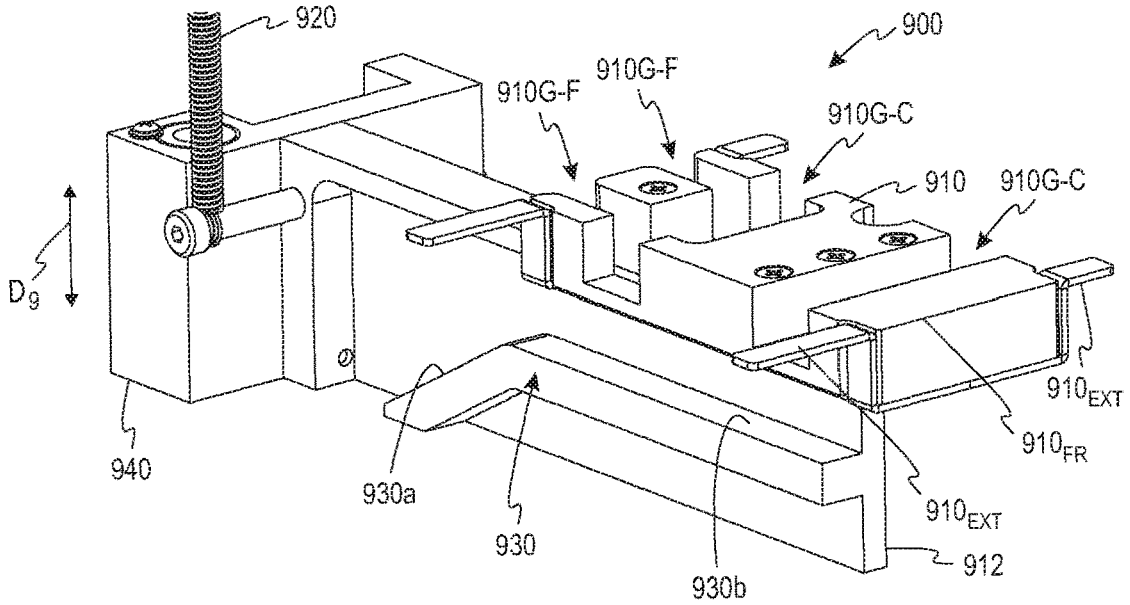
FIG. 9A illustrates a side perspective view of a floor in accordance with various embodiments of this disclosure.

According to various embodiments, the floor 910 is biased upward toward the floor home position $\mathbf{910}_H$ such as by a floor spring 920 (see FIG. 9A). As the anvil 1120 moves downward and presses banknotes stacked on the floor 910 downward, the banknotes transfer a downward force from the anvil to the floor 910 while the upward bias of the floor 910 presses banknotes in the stack upward. As a result, the stack of banknotes becomes compressed between the anvil 1120 and the floor 910. As the anvil 1120 continues to move downward, the upward bias of the floor spring 920 is overcome and the anvil 1120 moves the compressed stack of banknotes BN and the floor 910 downward. Accordingly, the downward movement of the anvil 1120 forces the stack of banknotes and the floor 910 downward.

In FIG. 4F, the anvil 1120, the stack of banknotes BN and the floor 910 have moved further downward to a strapping position so that the anvil 1120 is at an anvil strapping position $\mathbf{1120}_{STR}$, the stack of banknotes is at a banknote strapping position $\text{BN}_{STR}$ and the floor 910 is at a floor strapping position $\mathbf{910}_{STR}$. The side portions of the strap $\mathbf{120}_C$ are still bent upward by the sides surfaces or walls 590, 580 of the stacking and strapping column 105 so that the strap $\mathbf{120}_C$ remains in a U-shape as seen in FIG. 4F. By the time the anvil 1120 has traveled to the anvil strapping position $\mathbf{1120}_{STR}$, the cradle 620 has returned to the cradle home or stacking position $\mathbf{620}_H$ and it is ready to receive additional banknotes.

According to various embodiments, the anvil strapping position $\mathbf{1120}_{STR}$ is the lowest position of the anvil 1120.

According to various embodiments, the upward biased floor 910 compresses the stack of banknotes BN against the anvil 1120 with a predetermined or set force which aids in achieving a snuggly strapped set of banknotes. According to various embodiments, the predetermined or set force is determined by a spring such as floor spring 920.

The anvil strapping position $\mathbf{1120}_{STR}$ is aligned with two strap fold units 700, 800 (see FIGS. 7A-8B). According to various embodiments, strap fold unit 700 is a cold fold unit or module and strap fold unit 800 is a hot fold unit or module.

Figure 5A:
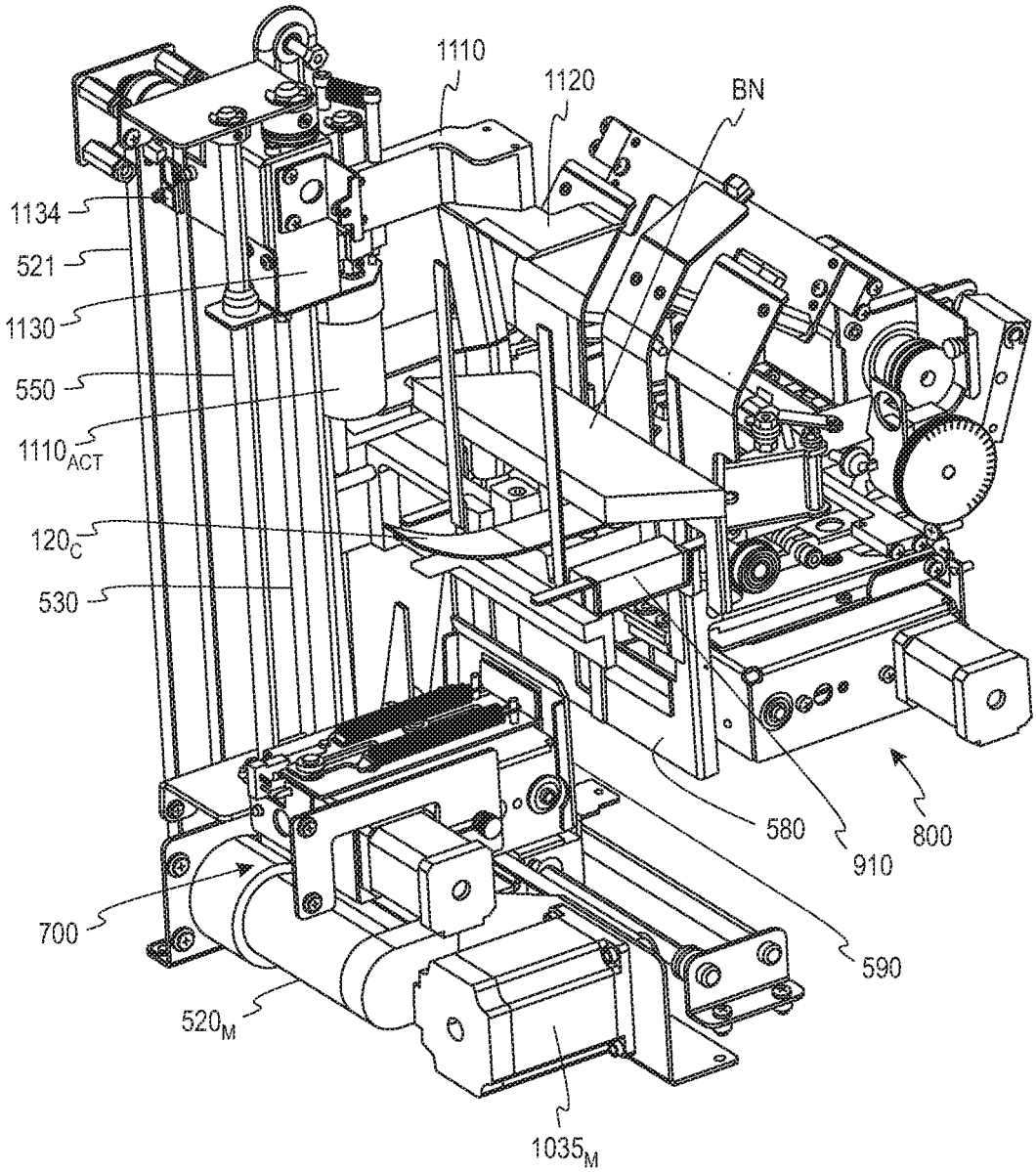
FIGS. 5A and 5B illustrate front perspective views of select components of the banknote strapping device of FIG. 1 in accordance with various embodiments of this disclosure.
Figure 5B:
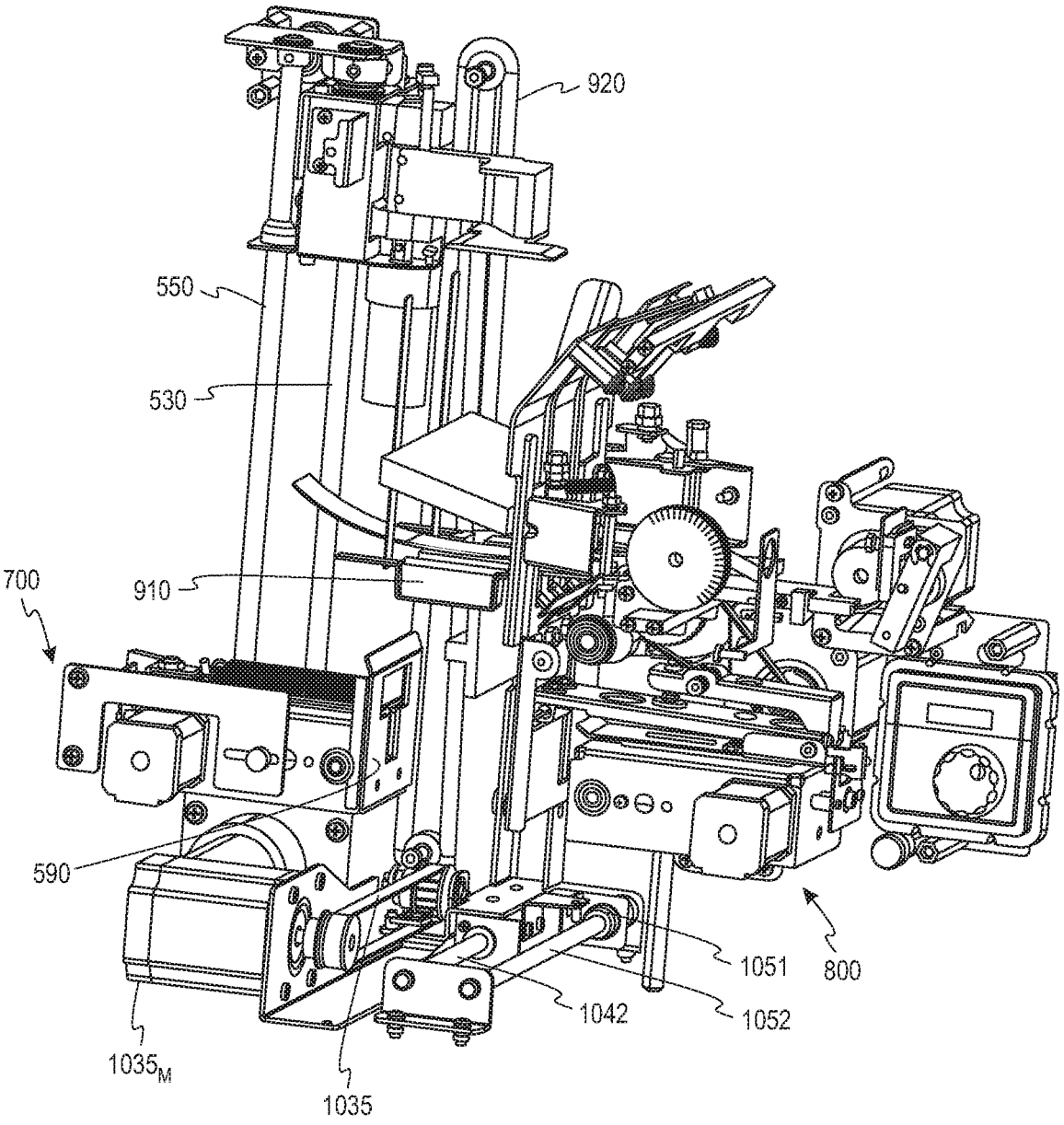
Figure 5C:
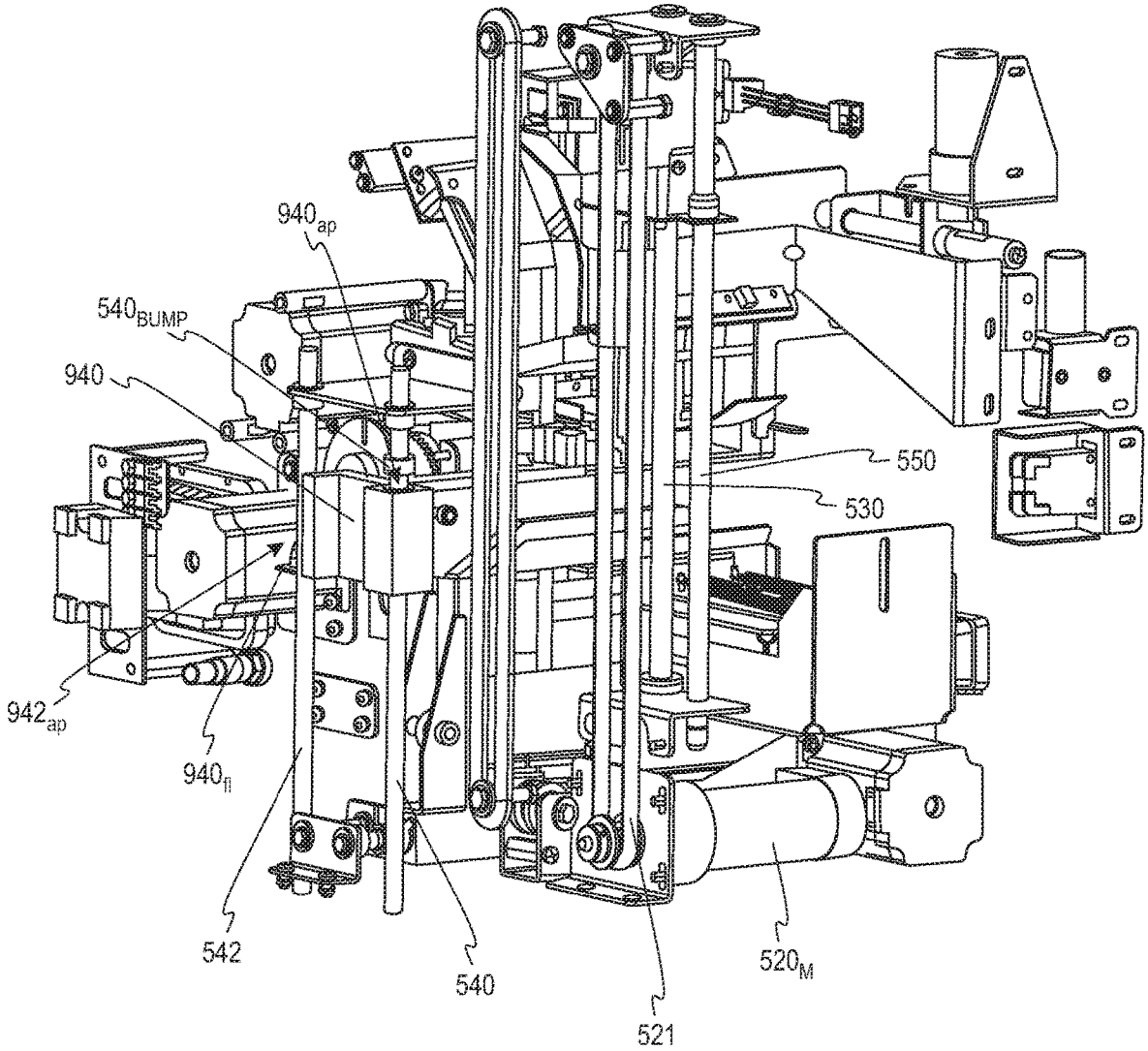
FIG. 5C illustrates a rear perspective view of select components of the banknote strapping device of FIG. 1 in accordance with various embodiments of this disclosure.
Figure 10:
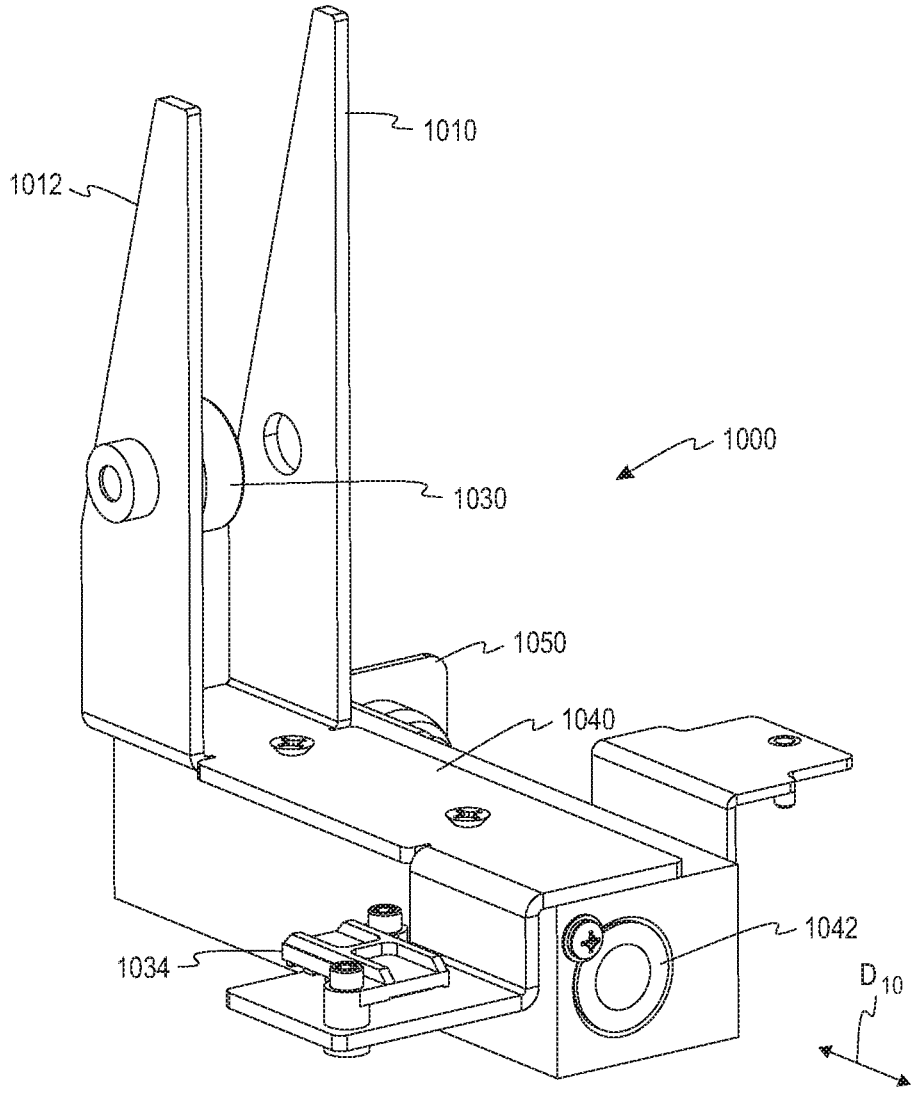
FIG. 10 illustrates a perspective view of an eject traveler in accordance with various embodiments of this disclosure.

FIGS. 5A and 5B illustrate front perspective views, and FIG. 5C illustrates a rear perspective view, of select components of the banknote strapping device of FIG. 1. With reference to FIGS. 5A, 5B, and 10, as disclosed herein, according to various embodiments, motion of an eject traveler base 1040 may be constrained along a shaft 1042 which may be a generally horizontal shaft. To further constrain the motion of eject traveler base 1040 and prevent it from pivoting around the shaft 1042, the eject traveler base 1040 may further comprise a stabilization flange 1050 including a second shaft coupler 1051 having an aperture therein and mounted about a second generally horizontal shaft 1052 which may be generally parallel to shaft 1042. The two shafts 1042, 1052 assist in constraining the movement of the base 1040 to a linear motion forward and backward in direction $D_{10}$. According to various embodiments, a belt 1035 may be coupled to the base 1040 via belt clamp 1034 and the belt 1035 may be driven by an eject traveler motor $\mathbf{1035}_M$ communicatively coupled to a processor, e.g., processor 1375 (FIG. 13).

According to various embodiments, before a strapped stack of banknotes is ejected from the strapping device and/or before the prongs 1010, 1012 engage the rear edges of the banknotes in the strap, the floor 910 is first lowered so the strapped stack of banknotes hang from the anvil 1120 via the strap $\mathbf{120}_C$. According to various embodiments, just before the prongs 1010, 1012 contact the rear edges of the banknotes in the strap, the floor 910 is first lowered by the forward motion of the eject traveler base 1040 so the strapped stack of banknotes hang from the anvil 1120 via the strap $\mathbf{120}_C$. According to various embodiments in which the floor is spring-biased upward, the floor may be lowered through the interaction of a platform lowering bearing or roll 1030 and an eject ramp 930 shown in FIG. 9A. According to various embodiments, the platform lowering bearing or roll 1030 is a ball bearing.

Figure 6A:
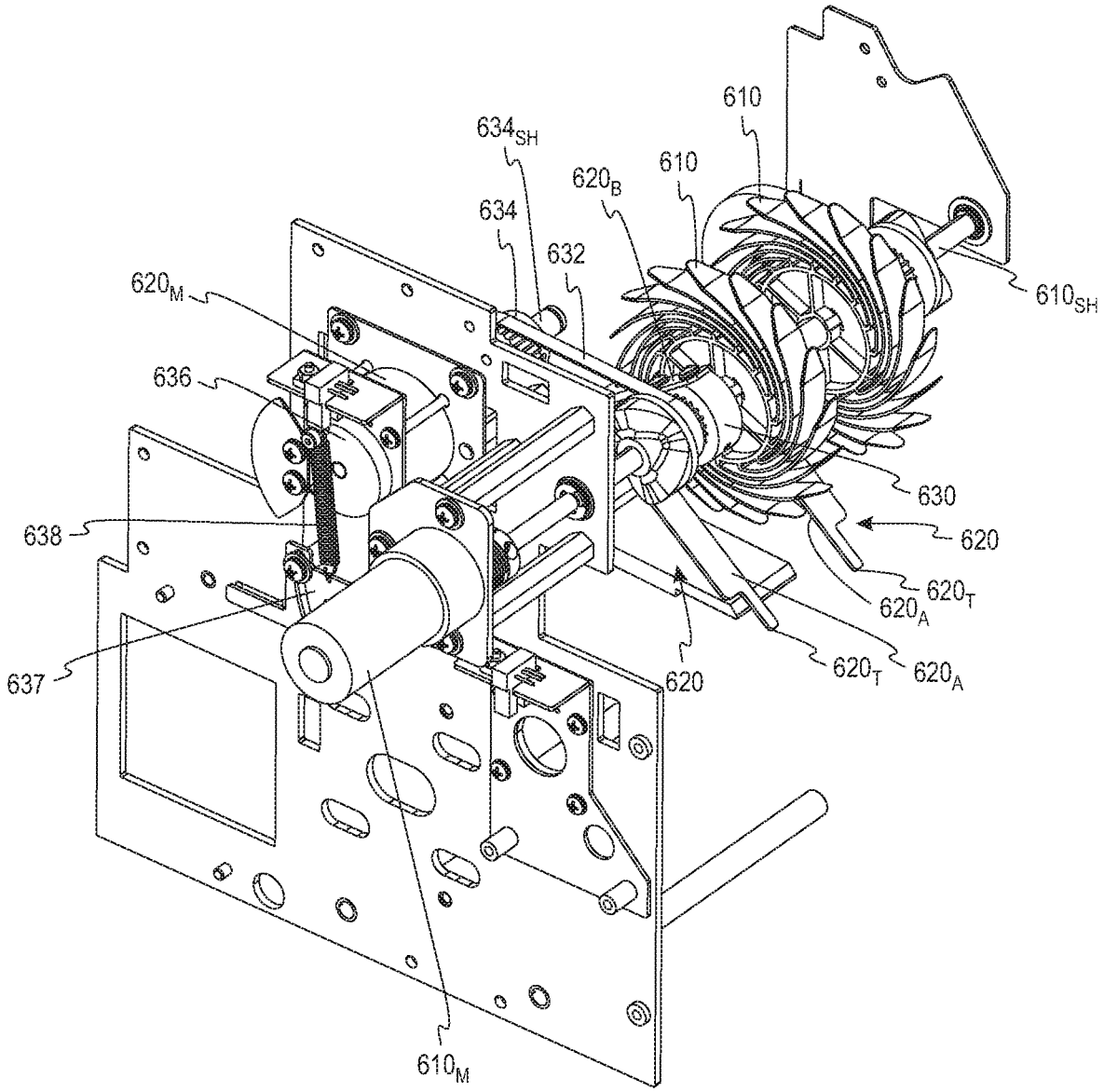
FIG. 6A illustrates a perspective view of select components of the banknote strapping device of FIG. 1 in accordance with various embodiments of this disclosure.
Figure 6B:
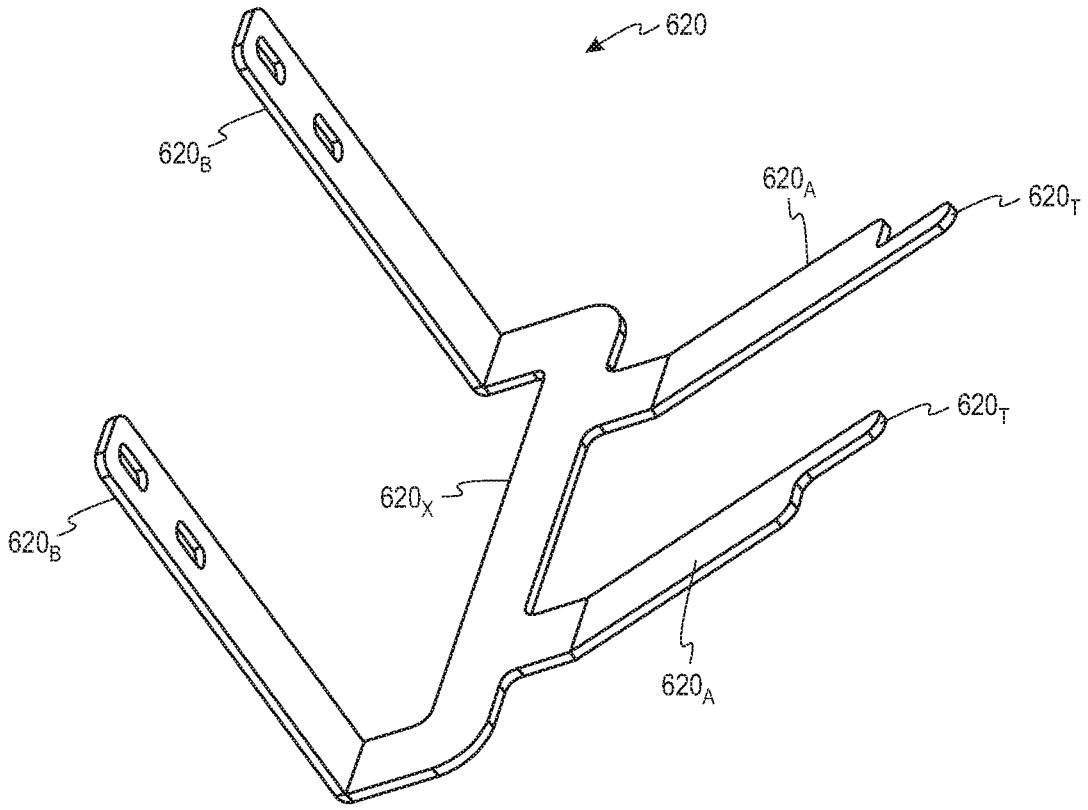
FIG. 6B illustrates a perspective view of a cradle in accordance with various embodiments of this disclosure.

FIG. 6A illustrates a perspective view of select components of the banknote strapping device 100 of FIG. 1 and FIG. 6B illustrates a perspective view of a cradle 620 according to various embodiments. According to various embodiments, the stacker wheels 610 are fixedly coupled to a stacker wheel shaft $\mathbf{610}_{SH}$ which is rotationally driven by the stacker wheel motor $\mathbf{610}_M$. The one or more cradle arms $\mathbf{620}_A$ of the cradle 620 are coupled to one or more cradle pulley housing(s) 630. The cradle pulley housings 630 are each mounted about the stacker wheel shaft $\mathbf{610}_{SH}$ but do not rotate with the rotation of the stacker wheel shaft $\mathbf{610}_{SH}$. A bearing within each cradle pulley housings 630 may facilitate the independent rotation of the stacker wheel shaft $\mathbf{610}_{SH}$ within the cradle pulley housings 630. According to various embodiments, back ends $\mathbf{620}_B$ of the cradle arms $\mathbf{620}_A$ of the cradle 620 are coupled to one or more cradle pulley housing(s) 630. As shown in FIG. 6B, according to various embodiments, the cradle arms $\mathbf{620}_A$ of the cradle 620 may be coupled to each other such as via a cross member $\mathbf{620}_X$.

According to various embodiments, a cradle belt 632 operatively connects one or more of the cradle pulley housings 630 to a cradle motor or solenoid $\mathbf{620}_M$ which operates as a cradle actuator.

According to various embodiments, to move the cradle 620 from its cradle home position $\mathbf{620}_H$ (see FIG. 4A) to its retracted position $\mathbf{620}_R$ (see FIG. 4C), the cradle motor or solenoid $\mathbf{620}_M$ rotates a pulley shaft $\mathbf{634}_{SH}$ and a pulley 634 coupled thereto which in turn drives the cradle belt 632 (clockwise in FIG. 6A) which in turn rotates one or more of the cradle pulley housings 630 (clockwise in FIG. 6A). As the cradle pulley housings 630 rotate (clockwise in FIG. 6A), the cradle 620 rotates about the stacker wheel shaft $\mathbf{610}_{SH}$ until the cradle 620 reaches its retracted position $\mathbf{620}_R$ in which the ends or tips $\mathbf{620}_T$ of the cradle arms $\mathbf{620}_A$ do not extend into the stacking and strapping column 105.

According to various embodiments, a spring hub 636 coupled to the pulley shaft $\mathbf{634}_{SH}$ has an over-center spring 638 is coupled between the outer portion of the spring hub 636 and a fixed lever 637. The fixed lever 637 allows for spring force adjustment. Over-center spring 638 biases the cradle 620 to either of the two end positions, retracted position $\mathbf{620}_R$ or home position $\mathbf{620}_H$. According to various embodiments, to rapidly return the cradle 620 from its retracted position $\mathbf{620}_R$ (see FIG. 4C) to its cradle home position $\mathbf{620}_H$ (see FIG. 4A), the cradle solenoid $\mathbf{620}_M$ is energized and rotates the pulley shaft $\mathbf{634}_{SH}$ in the opposite direction as previously stated (counterclockwise in FIG. 6A).

According to various embodiments, the banknote strapping device 100 can receive and stack banknotes to be strapped in near continuous manner.

According to various embodiments, after the $100^{th}$ note of a stack of notes to be delivered to the cradle 620 or the floor 910 is identified by an appropriate sensor of a banknote scanner of a banknote processing system or device 1300 such as a denomination sensor and/or after the $100^{th}$ note of a stack of notes has been delivered to the cradle 620 or the floor 910, a transport mechanism of the banknote processing system or device 1300 and/or the strapping transport mechanism 170 will pause for a fraction of a second. According to various embodiments, the pause duration of the banknote strapping transport mechanism 170 is only limited primarily to the speed capability of the plunger motor $\mathbf{580}_M$, and then secondarily by the speed capability of the cradle solenoid $\mathbf{620}_M$. According to various embodiments, the strapping transport mechanism 170 is paused by or less than by approximately 0.3 seconds. According to various embodiments, this is the amount of time it takes for the plunger motor $\mathbf{580}_M$ to drive the plunger 1100 from its home position $\mathbf{1110}_H$ past the cradle home position $\mathbf{620}_H$, plus the time it takes for the cradle solenoid $\mathbf{620}_M$ to drive the cradle 620 back to the cradle home position $\mathbf{620}_H$ to be ready to catch the $1^{st}$ banknote of the next strap.

According to various embodiments, banknotes such as U.S. banknotes are transported along the strapping transport path in a wide-edge leading manner at a rate of at least about 1000 banknotes per minute and are received by the stacking wheels 610 and stacked on the cradle 620 or floor 910 at the same rate. At a rate of 1000 banknotes per minutes, a stack of 100 banknotes is received on the cradle 620/floor 910 in six (6) seconds. According to various embodiments, after 60 banknotes have been stacked on the cradle 620 (3.6 seconds after stacking on the cradle 620 begins), the strapper printer $\mathbf{120}_{PR}$ prints desired information on to a lead portion of the strapping material 120, feeds the lead portion of the strapping material onto an upper surface of the floor 910 and cuts the lead portion of the strapping material into a strap $\mathbf{120}_C$ by the strap cutter $\mathbf{120}_{CUT}$. Then according to various embodiments, the cradle 620 is moved to its cradle retracted position $\mathbf{620}_R$ and the stack of banknotes thereon is lowered onto the floor 910. When a complete stack of 100 banknotes have been stacked on the floor 910, the plunger assembly 1100 moves the anvil 1120 from its home position $\mathbf{1120}_H$ to its lower anvil strapping position $\mathbf{1120}_{STR}$.

According to various embodiments, after a first stack of 100 banknotes have been stacked on the floor 910 (about 6 seconds after stacking began), the plunger assembly 1100 moves the anvil 1120 from its home position $\mathbf{1120}_H$ to a position below the cradle home position $\mathbf{620}_H$, and the cradle returns to its cradle home position $\mathbf{620}_H$. Over about the next 6.0 seconds, the next (e.g., second) stack of banknotes are stacked on the cradle 620 or floor 910, while the first stack of 100 banknotes is strapped and ejected from the strapping device 100. According to various embodiments, it takes less than or about 3.6 seconds to fold & weld (heat seal one end of the strap $\mathbf{120}_C$ to the other end of the strap $\mathbf{120}_C$) the strap $\mathbf{120}_C$ about the first stack of banknotes, and to eject the first strapped stack of banknotes from the strapping device 100, and return the plunger assembly 1100 and the anvil 1120 to its untucked, upper anvil home position $\mathbf{1120}_H$.

Thus, according to various embodiments, the banknote strapping device 100 is configured to deliver a strapped stack of 100 banknotes at a rate of or less than every 6.3 seconds with less than or about 0.3 second of pause time while the cradle 620 is not in its home position $\mathbf{620}_H$ ready to receive banknotes thereon.

Figure 7A:
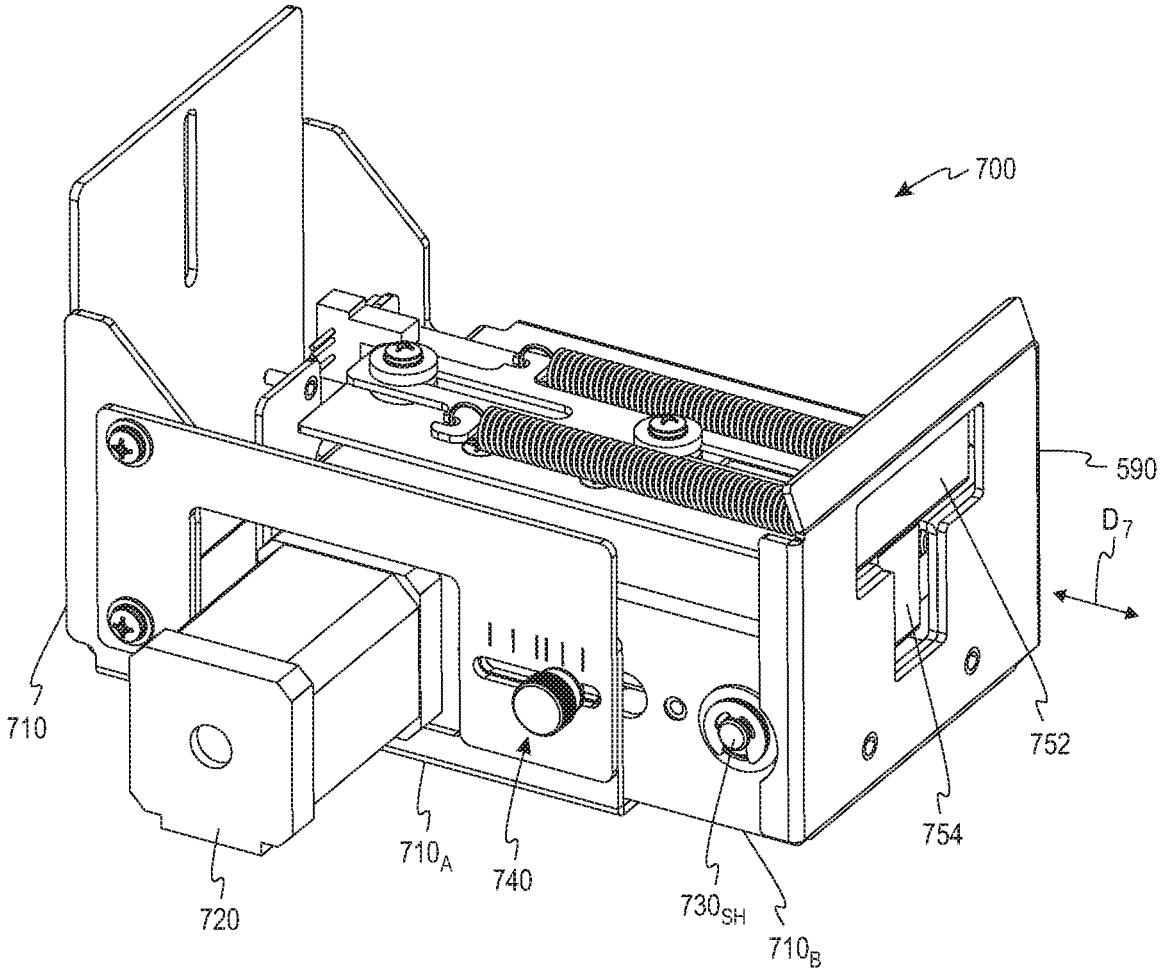
FIG. 7A illustrates a perspective view of a cold fold module in accordance with various embodiments of this disclosure.
Figure 7B:
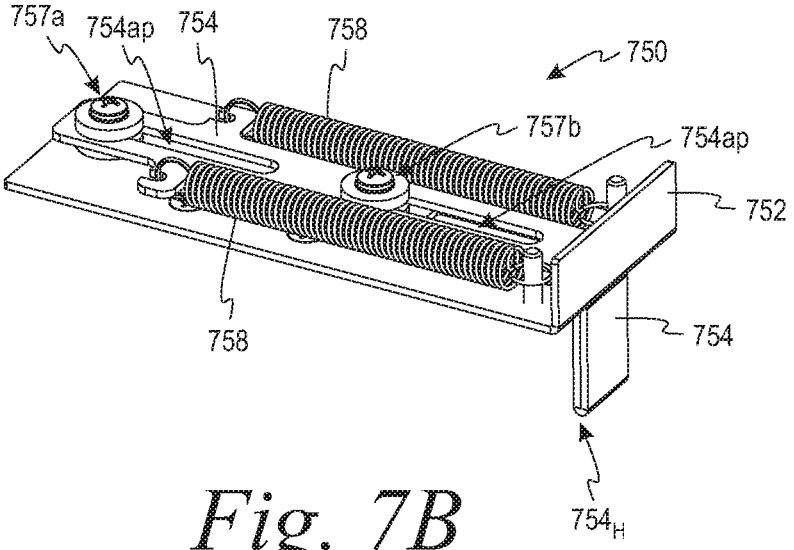
FIG. 7B illustrates a perspective view of a fold member of the cold fold module of FIG. 7A in accordance with various embodiments of this disclosure.

FIG. 7A illustrates a perspective view of the cold fold module or unit 700 and FIG. 7B illustrates a perspective view of a fold member 752 of the cold fold module or unit of FIG. 7A. According to various embodiments, the cold fold module 700 comprises a housing 710 which may comprise two portions $\mathbf{710}_A$ and $\mathbf{710}_B$ which are laterally moveable with respect to each other. According to various embodiments, side surface or wall 590 of the stacking and strapping column 105 comprises part of the housing 710 of the cold fold module. According to various embodiments, outer portion $\mathbf{710}_A$ of the housing may be rigidly coupled directly or indirectly to the housing 110 of the strapping device 100 and inner portion $\mathbf{710}_B$ may be slidingly coupled to the outer portion $\mathbf{710}_A$. An adjustment knob 740 may be used to adjust the relative positions of portions $\mathbf{710}_A$ and $\mathbf{710}_B$ and allow the relative positions to become releasably fixed with respect to each other. For example, according to various embodiments, the banknotes to be strapped by the strapping device 100 have rectangular shape with varying lengths and widths depending on the denomination and/or type of banknote to be strapped. The lengths of the banknotes are longer than the widths of the banknotes. According to various embodiments, banknotes are stacked on the cradle 620 and the floor 910 with their narrower dimension (width) generally parallel to the front of the strapping device 100. The position of side surface or wall 590 can be adjusted relative to an opposing side surface or the wall 580 so that the distance between the two side walls 590, 580 is slightly larger than the narrow dimension (width) of the banknotes to be strapped by the strapping device. When a stack of banknotes having a different width is to be strapped by strapping device 100, the side surface or wall 590 can be moved relative to the opposing side surface or wall 580 using the adjustment knob 740 to enable inner housing portion $\mathbf{710}_B$ to slide relative to outer housing portion $\mathbf{710}_A$ (see, e.g., arrow $D_7$). As shown in FIG. 7A, to assist proper placement of inner housing portion $\mathbf{710}_B$ to relative to outer housing portion $\mathbf{710}_A$, the housing 710 may have markings associated with different types and/or denominations of banknotes to be accommodated by the strapping device 100, e.g., a mark for U.S. banknotes, a mark for Canadian banknotes, and various marks for €5, €10, €20, €50, €100, and €100 banknotes. Upper side surface or wall 592 may be similarly adjustable with respect to its distance from opposing side surface or wall 580.

Figure 4G:
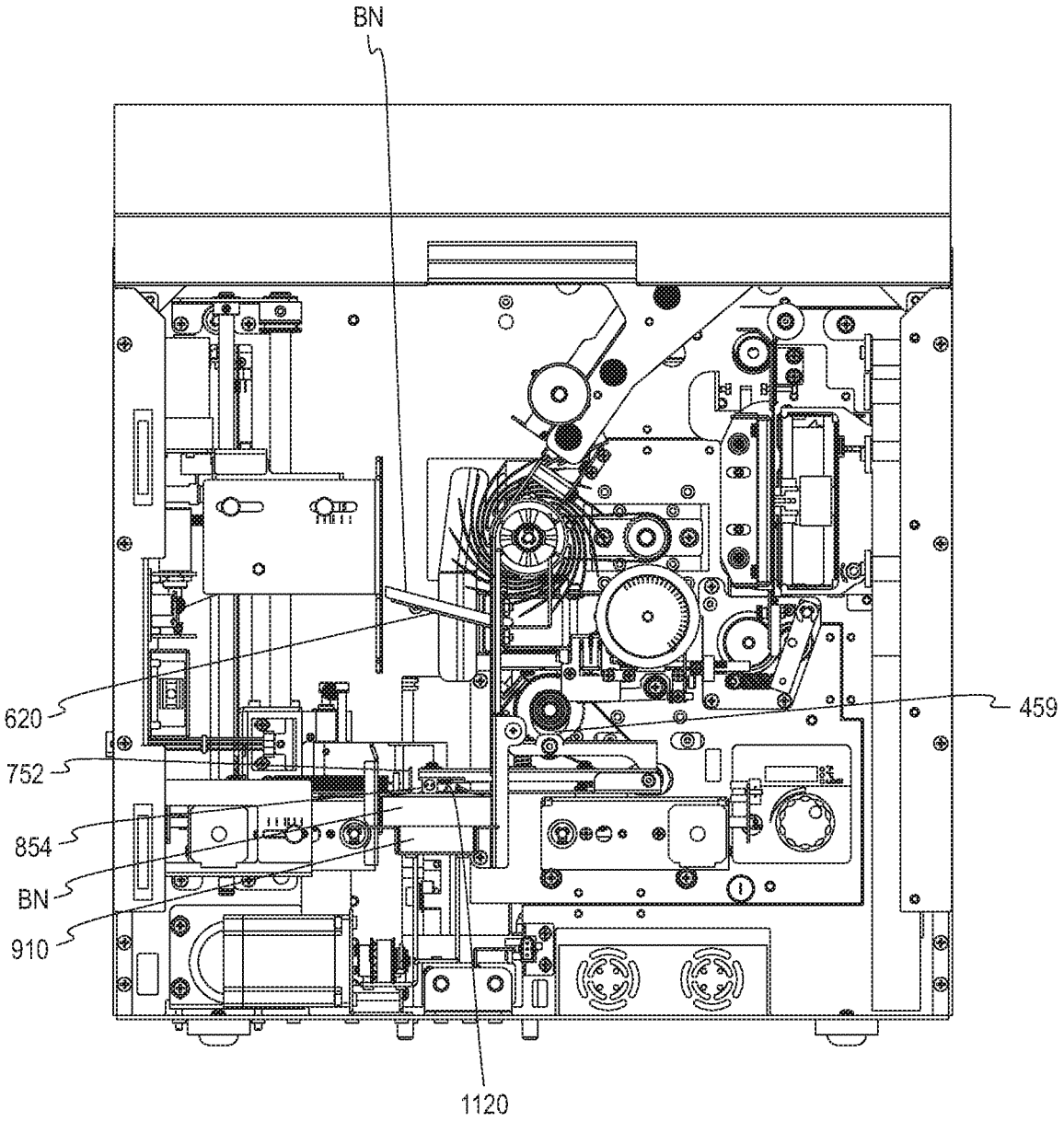

According to various embodiments, the cold fold module 700 comprises a cold fold traveler 750 comprising a fold member 752 and a tongue 754, both of which are configured to move laterally (see arrow $D_7$). In FIG. 7A, the fold member 752 and the tongue 754 are shown in their respective home positions. An actuator 720 is configured to cause the fold member 752 and the tongue 754 to move (to the right in FIGS. 7A and 4G) to their respective strapping positions as shown in FIG. 4G. When actuated by the actuator 720, the tongue 754 moves to the right and presses a portion of the strap $\mathbf{120}_C$ against a left side of the stack of banknotes BN to be strapped while the fold member 752 continues moving to the right to cause a left end of strap $\mathbf{120}_C$ to fold over the top of the stack of banknotes to be strapped.

According to various embodiments, the motion of the fold member 752 is belt driven and, the motion of the tongue 754 is spring driven by fold member 752. According to various embodiments, posts 757*a*, 757*b* coupled to the fold member 752 slide within apertures 754*ap* of the tongue 754. According to various embodiments, to aid in the rapid return of the tongue 754 from its tongue strapping position as shown in FIG. 4G to its tongue home position $\mathbf{754}_H$ shown in FIG. 7B, one or more springs 758 bias the tongue 754 to its tongue home position $\mathbf{754}_H$ relative to fold member 752. According to various embodiments, a first end of each spring 758 is coupled to an outer portion of the tongue 754 and a second end of each spring 758 is coupled to the fold member 752 near an inner end thereof. When the actuator 720 drives the fold member 752 to its home position, the springs 758 pull the tongue 754 to its home position while also pushing against the stack of notes and aiding in the return of cold fold traveler 750. According to various embodiments, the springs 758 are always pulling the tongue 754 toward a tongue home position $\mathbf{754}_H$ (shown in FIG. 7B) relative to fold member 752. When the fold member 752 begins to move from its fold member home position shown in FIG. 7A toward its fold member strapping position as shown in FIG. 4G (to the right in FIG. 7A), the tongue 754 moves along with the fold member 752 due to the bias of the springs 758. However, as the fold member 752 travels past the edge of the stack of banknotes BN to be strapped, the movement of the tongue 754 stops at the left side of the stack of banknotes BN to be strapped and compresses the strap $\mathbf{120}_C$ against the stack. When fold member 752 continues to extend, the tongue 754 cannot move any further but the springs 758 grow in length. When the fold member 752 begins to be retracted, the tongue 754 stays in place pushing against the stack until fold member 752 reaches the edge of the stack. The fold member 752 and the tongue 754 then move together (to the left in FIG. 7A) until the fold member 752 reaches its fold member home position shown in FIG. 7A.

Figure 8A:
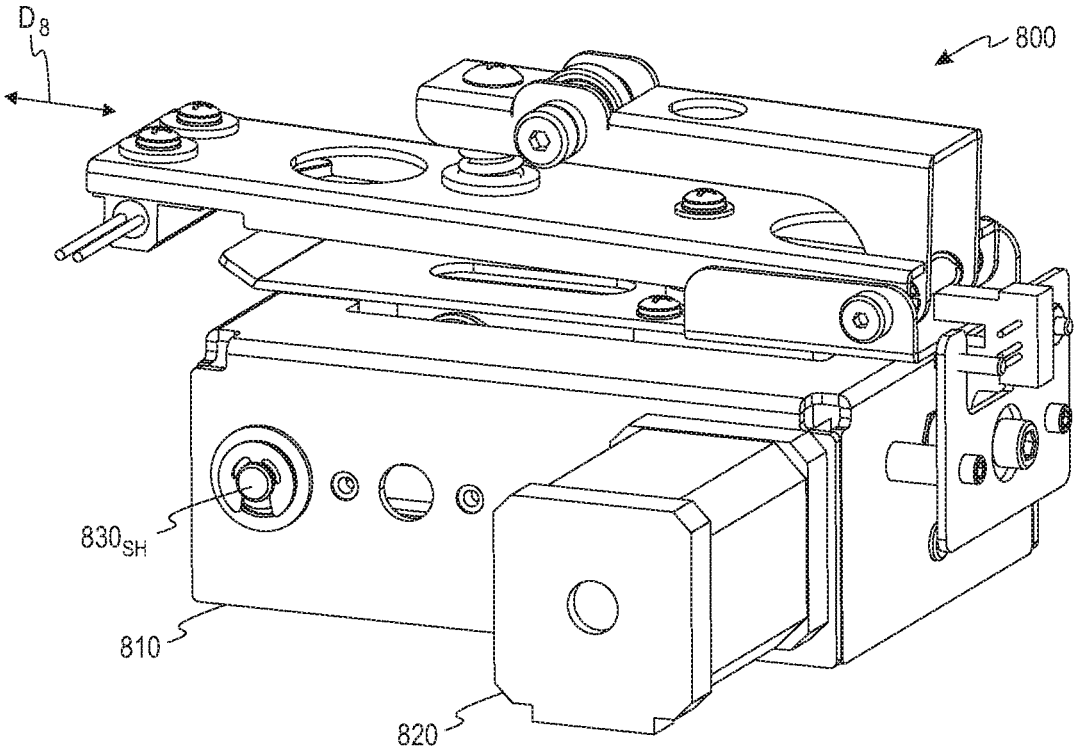
FIG. 8A illustrates a perspective view of a hot fold module in accordance with various embodiments of this disclosure.
Figure 8B:
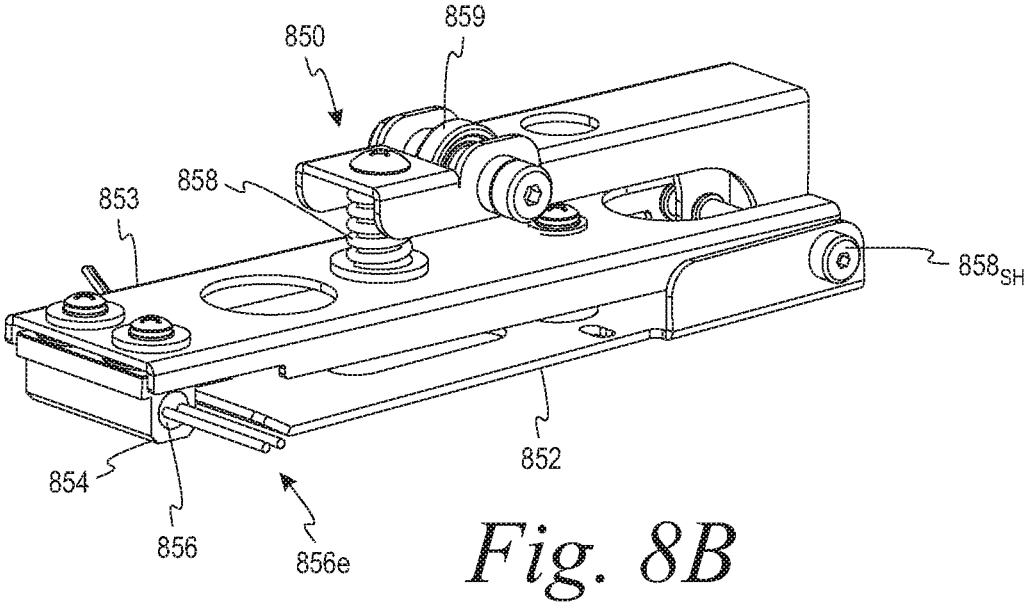
FIG. 8B illustrates a perspective view of a hot fold traveler of the hot fold module of FIG. 8A in accordance with various embodiments of this disclosure.

FIG. 8A illustrates a perspective view of a hot fold module or unit 800 and FIG. 8B illustrates a perspective view of a hot fold traveler 850 of the hot fold module 800 of FIG. 8A. According to various embodiments, the hot fold module 800 comprises a housing 810 and the hot fold traveler 850, which is configured to move laterally (see arrow $D_8$) with respect to the housing 810. According to various embodiments, the hot fold traveler 850 comprises hot fold member 852, a platen 854, and a heating element 856. In FIG. 8A, the hot fold traveler 850 is shown in its hot fold traveler home position. An actuator 820 is configured to cause the hot fold traveler 850 to move (to the left in FIGS. 8A and 4G) to its respective hot fold traveler strapping position as shown in FIG. 4G. When actuated by the actuator 820, the hot fold traveler 850 moves to the left and the hot fold member 852 causes a right end of strap $\mathbf{120}_C$ to fold over the top of the stack of banknotes to be strapped. According to various embodiments, the platen 854, and the heating element 856 are mounted on a distal end of an upper hot fold traveler arm 853 which is hingedly coupled to hot fold member 852 about hot fold traveler shaft $\mathbf{858}_{SH}$. According to various embodiments, the upper hot fold traveler arm 853 is biased away from the hot fold member 852 by a spring (not shown). According to various embodiments, the hot fold traveler 850 comprises a cam contact surface or roll 859. According to various embodiments, a cam load applied to roll 859 and platen 854 is controlled by a spring 858. According to various embodiments, the motion of the hot fold traveler 850 is belt driven.

Turning to back to FIG. 4F, as disclosed herein, the anvil 1120, the stack of banknotes BN and the floor 910 are located at a strapping position with the anvil 1120 is at the anvil strapping position $\mathbf{1120}_{STR}$, the stack of banknotes is at the banknote strapping position $BN_{STR}$ and the floor 910 is at a floor strapping position $\mathbf{910}_{STR}$. The side portions of the strap $\mathbf{120}_C$ are bent upward by the sides surfaces or walls 590, 580 of the stacking and strapping column 105 so that the strap $\mathbf{120}_C$ remains in a U-shape as seen in FIG. 4F.

With reference to FIG. 4G, the tongue 754 of the cold fold module 700 then moves laterally to the right and presses a portion of the strap $\mathbf{120}_C$ against the left side of the stack of banknotes BN to be strapped while the fold member 752 continues moving to the right to cause a left end of strap $\mathbf{120}_C$ to fold over the top of the stack of banknotes to be strapped and on top of the anvil 1120. The fold member 752 is held at its fold member strapping position as shown in FIG. 4G. After the left end of the strap $\mathbf{120}_C$ has been folded over the top of the stack of banknotes and the top of the anvil 1120, the hot fold traveler 850 is moved laterally to its hot fold traveler strapping position as shown in FIG. 4G, thereby causing the right end of the strap $\mathbf{120}_C$ to fold over the top of the stack of banknotes to be strapped and over the left end of the strap $\mathbf{120}_C$ above the anvil 1120. The cam 459 is then rotated against the contact surface or roll 859 of the hot fold traveler 850 to cause the hot fold traveler arm 853 to move toward the hot fold member 852 and to press the platen 854 into contact with the right end of the strap $\mathbf{120}_C$ which in turn presses the right end of the strap $\mathbf{120}_C$ into contact with the left end of the strap $\mathbf{120}_C$ which in turn presses the left end of the strap $\mathbf{120}_C$ against an upper surface of the anvil 1120 while the heating element 856 is energized. According to various embodiments, one side of the strap $\mathbf{120}_C$ has a heat-activated adhesive thereon. For example, the inner side of strap $\mathbf{120}_C$ (lower surface of right end of strap $\mathbf{120}_C$ in FIG. 4G) may have a heat-activated adhesive thereon. When the heating element 856 is energized, the heat-activated adhesive melts causing an overlapping portion of strap $\mathbf{120}_C$ near the right end of the strap $\mathbf{120}_C$ to adhere to an overlapping portion of the strap $\mathbf{120}_C$ near the left end of the strap $\mathbf{120}_C$. The stack of banknotes BN is now strapped.

According to various embodiments, the anvil 1120 resists the downward pressure applied by the platen 854 helping to secure a strong bond between the overlapping ends of the strap $\mathbf{120}_C$. According to various embodiments, the anvil 1120 may also aid in protecting the banknotes from the heat applied to the strap $\mathbf{120}_C$ by the platen 854/heating element 856.

As disclosed herein, according to various embodiments, the upward biased floor 910 compresses the stack of banknotes BN against the anvil 1120 with a predetermined or set force during the strapping process which aids in achieving a snuggly strapped set of banknotes. According to various embodiments, the upward biased floor 910 compresses the stack of banknotes BN against the anvil 1120 with a predetermined or set force which aids in achieving a snuggly strapped set of banknotes even for stacks of banknotes having varying heights such as a stack of new notes of "brick" quality versus a stack of well-circulated "street" banknotes having a "fluffy" quality such as due to varying bends, folds, wrinkles, and/or creases in the individual banknotes in the stack. While the height of stack of "fluffy" banknotes even while compressed between the anvil 1120 and the floor 910 can be relatively much thicker than a stack of "brick" banknotes, when compressed by the anvil 1120 and floor 910 and strapped by the strapping device 100, both stacks of banknotes can be snuggly strapped by the strapping device 100.

According to various embodiments, these snuggly strapped stacks of banknotes may be achieved without the strapping device 100 having to pull on one or more ends of the strap $\mathbf{120}_C$ to tighten the strap $\mathbf{120}_C$ around a stack of banknotes during the strapping process. Additionally, strapping devices which pull on one or more ends of the strap $\mathbf{120}_C$ to tighten the strap $\mathbf{120}_C$ around a stack of banknotes during the strapping process often require an operator to observe the quality of notes to be strapped and/or to obverse whether straps $\mathbf{120}_C$ are being applied too loosely or too tightly to strapped stacks of banknotes and to adjust a strap tensioning mechanism as the quality of notes changes. According to various embodiments, use of the strapping device 100 avoids the need to adjust such tensioning due to variance of the quality of notes to be strapped and/or reduces or eliminates the need for operator monitoring and tension adjustment as the spring-biased floor 910 automatically, self-adjusts the distance between the floor 910 and the anvil 1120 and thus the length of the non-overlapping portion of the straps $\mathbf{120}_C$ based on the varying quality/height of the compressed stack of banknotes to be strapped.

As explained another way, according to various embodiments, while the anvil 1120 moves to a set strapping position $\mathbf{1120}_{STR}$, the spring-biased floor 910 will be pushed to a variable floor strapping position $\mathbf{910}_{STR}$ relative to the anvil 1120 based on the condition/quality of the banknotes to be strapped. A stack of "fluffy" notes will cause the spring-biased floor 910 to travel slightly further downward than a stack of "brick" notes. According to various embodiments, the result is a consistent strap tension regardless of the fitness/condition/quality of the banknotes being strapped.

As disclosed herein, according to various embodiments, the banknote strapping device 100 straps a stack of banknotes without wrapping one end of strapping material 120 around the stack of banknotes to be strapped such as by using a wrap arm which rotates about the stack of banknotes. Rather, according to various embodiments, a stack of banknotes to be strapped is placed on top of a cut strap $\mathbf{120}_C$ and the ends of the cut strap $\mathbf{120}_C$ are folded about the remaining sides of the stack of banknotes. According to various embodiments, one side of a stack of banknotes to be strapped is placed next to a middle portion of a cut strap $\mathbf{120}_C$ and the ends of the cut strap $\mathbf{120}_C$ are folded about the remaining sides of the stack of banknotes.

According to various embodiments, a stack of banknotes is strapped by a strap $\mathbf{120}_C$ by using only linear motions of various components such as the vertical movement of a floor 910 on which the stack of banknotes to be strapped rests and the horizontal movement of the cold fold member 752 and hot fold member 852.

While a first stack of banknotes BN is being strapped at the strapping position, banknotes for a subsequent stack of banknotes BN to be strapped may be being received on the cradle 620 as shown in FIG. 4G. For example, where a strap size is 100 banknotes (first predetermined number), the first 100 banknotes ($BN_1$-$BN_{100}$) would constitute the first stack of banknotes BN being strapped at the strapping position, while the next received banknote $BN_{101}$ would be received on the cradle 620 as shown in FIG. 4G. Subsequent banknotes, e.g., $BN_{102}$-$BN_{200}$, would be received on the cradle 620 and/or on the floor 910 once the floor 910 has returned to its floor home position $\mathbf{910}_H$ as disclosed herein.

Next, the cold fold member 752, the tongue 754, and the hot fold traveler 850 are returned to their respective home positions. The strapped stack of banknotes is now ready to be ejected from the strapping device 100 via output dispensing ramp 185 (see FIGS. 1 and 3). According to various embodiments, the strapping device 100 is configured to eject a strapped stack of banknotes from the strapping device 100 directly from the location at which the stack of banknotes was strapped, that is, the banknote strapping position $BN_{STR}$ just below the anvil strapping position $\mathbf{1120}_{STR}$. According to various embodiments, the strapping device 100 is configured to eject a strapped stack of banknotes from the strapping device 100 directly from the location at which the stack of banknotes was strapped within the stacking and strapping column 105.

Figure 9B:
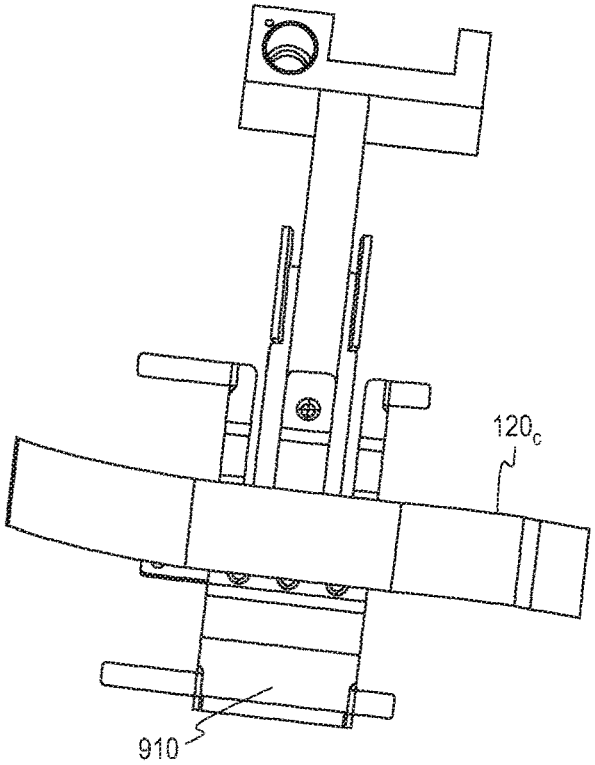
FIG. 9B illustrates a top perspective view of a floor with a piece of strapping material thereon in accordance with various embodiments of this disclosure.
Figure 9C:
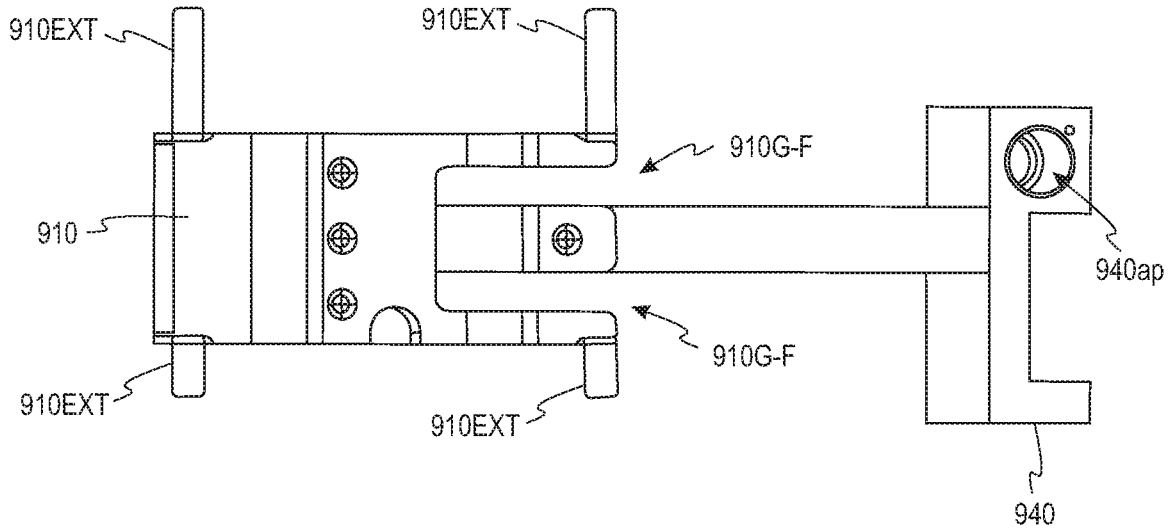
FIG. 9C illustrates a top perspective view of a floor in accordance with various embodiments of this disclosure.
Figure 9D:
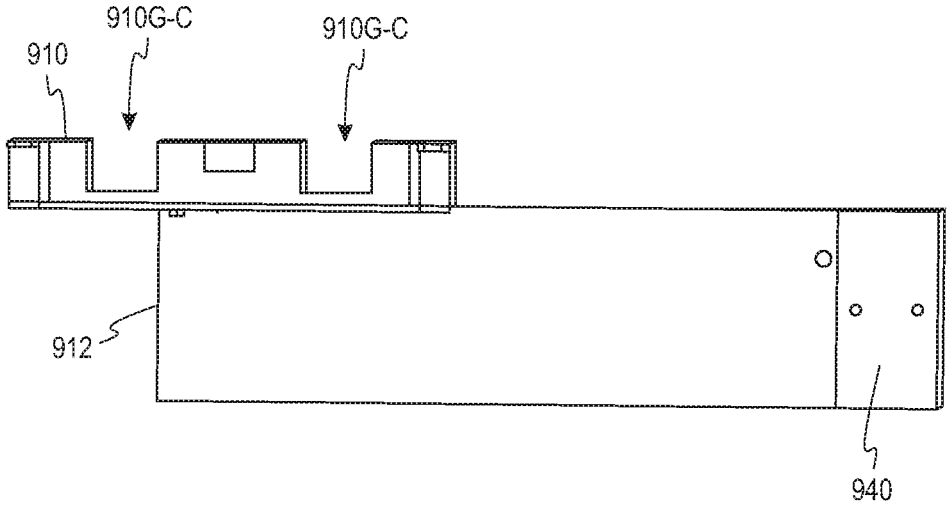
FIG. 9D illustrates a side view of a floor in accordance with various embodiments of this disclosure.

FIG. 9A illustrates a side perspective view of a floor 910 and FIG. 9B illustrates a top perspective view of a floor 910 with a piece of strapping material or strap $\mathbf{120}_C$ thereon. FIG. 9C illustrates a top perspective view and FIG. 9D illustrates a side view of a floor 910. According to various embodiments, the floor 910 is coupled to or formed integral with a floor support 912. A floor spring 920 biases the floor support 912 and floor 910 upward. The eject ramp 930 coupled to or formed integral with the floor support 912 may be located on one side of the floor support. The eject ramp may comprise an angled portion 930*a* located to the rear of a horizontal portion 930*b*. According to various embodiments, the ejection of a strapped stack of banknotes is accomplished using an eject traveler 1000 shown in FIG. 10. As the eject traveler 1000 is moved forward, the platform lowering bearing or roll 1030 contacts the angled portion 930*a* of the eject ramp 930 (see FIG. 3) and rolls along the angled portion 930*a* of the ramp 930 causing the floor support 912 and the floor 910 to be forced downward. As the eject traveler 1000 continues to move forward, the platform lowering bearing or roll 1030 rolls along the generally horizontal portion 930*b* of the ramp 930 and the prongs 1010, 1012 of the eject traveler 1000 push the strapped stack of banknotes out of the strapping device 100 via the output dispensing ramp 185.

Figure 4H:
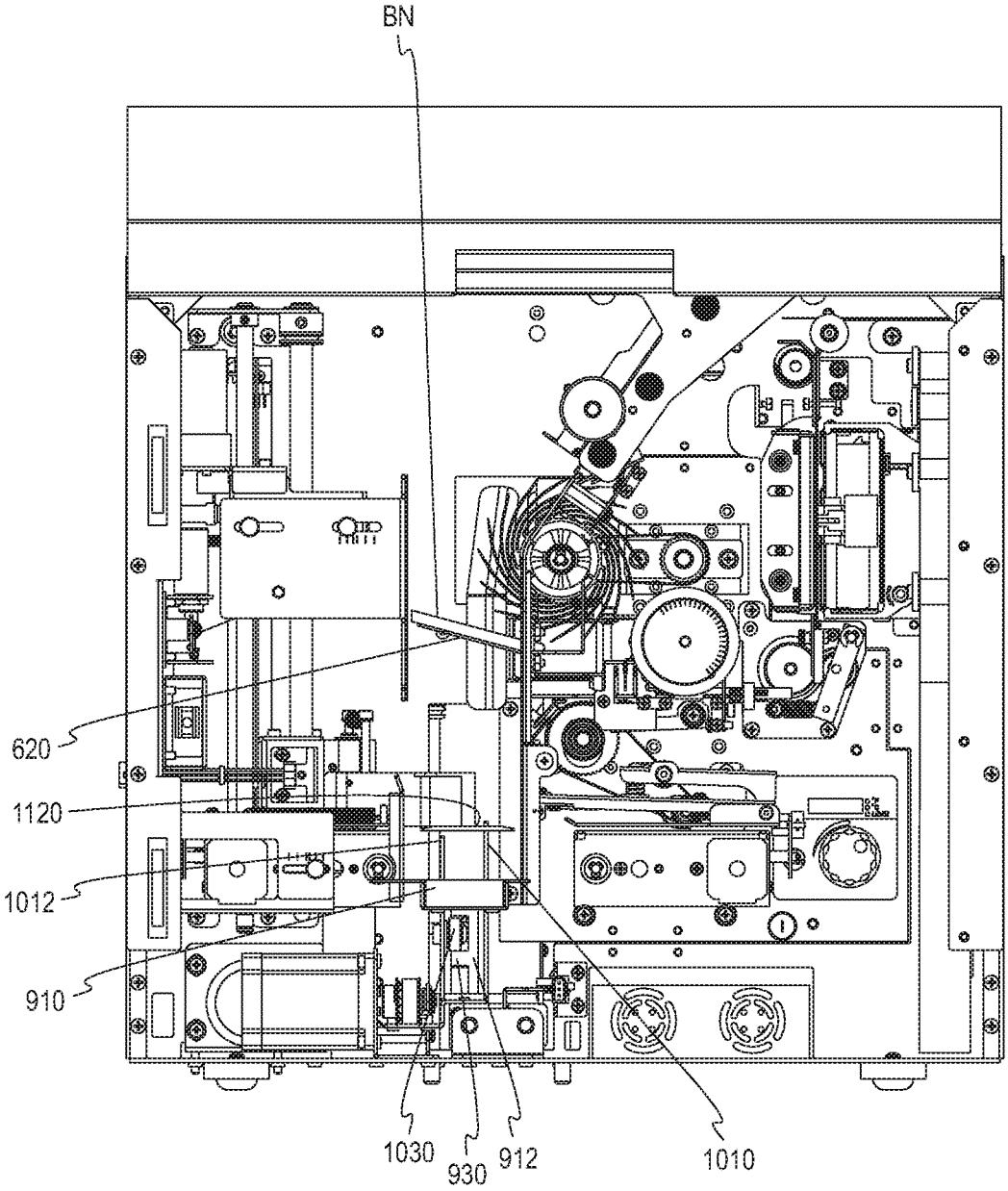

In FIG. 4H, the strapped stack of banknotes has been ejected from the strapping device 100. The floor 910 has been lowered from its floor strapping position $\mathbf{910}_{STR}$ by the action of the platform lowering bearing or roll 1030 holding the generally horizontal portion 930*b* of the ramp 930 down against the upward bias of the floor spring 920.

Figure 4I:
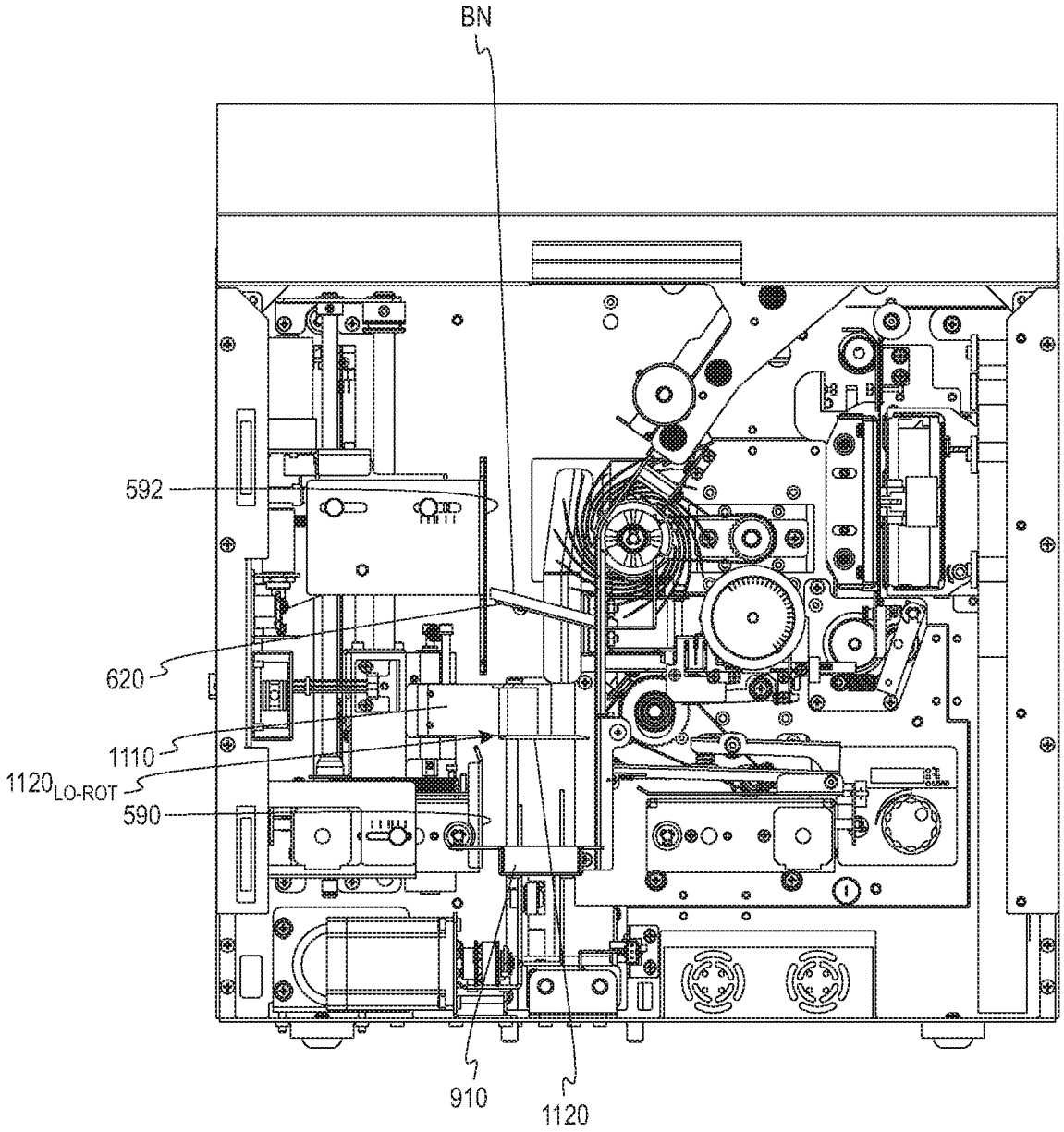

Next in FIG. 4I, the plunger assembly 1100 moves the anvil 1120 upward to an anvil lower rotation position $\mathbf{1120}_{LO\text{-}ROT}$ above a top of the lower left surface or wall 590 and below a bottom of the upper left surface or wall 592. The anvil rotation position $\mathbf{1120}_{ROT}$ is below the cradle home position $\mathbf{620}_H$ so as not to contact the cradle 620 or interfere with the stacking of banknotes thereon. As also disclosed herein with respect to FIGS. 11A and 11B, while at the anvil lower rotation position $\mathbf{1120}_{LO\text{-}ROT}$, the plunger assembly 1100 is configured to rotate the anvil 1120 out of the generally vertical stacking and strapping column 105 so that it may be raised above the cradle 620 which is in the generally vertical stacking and strapping column 105 without interfering with the stacking of banknotes on the cradle 620.

FIG. 10 illustrates a perspective view of the eject traveler 1000 in accordance with various embodiments of this disclosure. According to various embodiments, the ejection of a strapped stack of banknotes is accomplished using the eject traveler 1000 shown in FIG. 10. The eject traveler 1000 comprises one or more prongs 1010, 1012 coupled to the eject traveler base 1040 configured to move forward and backward (see arrow $D_{10}$) with respect to the front of the strapping device 100. According to various embodiments, the eject traveler base 1040 is driven by a belt coupled to the eject traveler base 1040 by a belt clamp 1034. The motion of the eject traveler base 1040 may be constrained along a shaft 1042 which may be a generally horizontal shaft. To eject a strapped stack of banknotes BN, the eject traveler 1000 is moved forward and prongs 1010, 1012 contact rear edges of the banknotes in the strap and push the strapped stack of banknotes forward and the overlapping portion of the strap $\mathbf{120}_C$ off of a front edge $\mathbf{1120}_F$ (see FIG. 11A) of the anvil 1120. The strapped stack of banknotes is then ejected from the strapping device via output dispensing ramp 185 by the continued movement of the prongs 1010, 1012 in a forward direction.

Figure 11A:
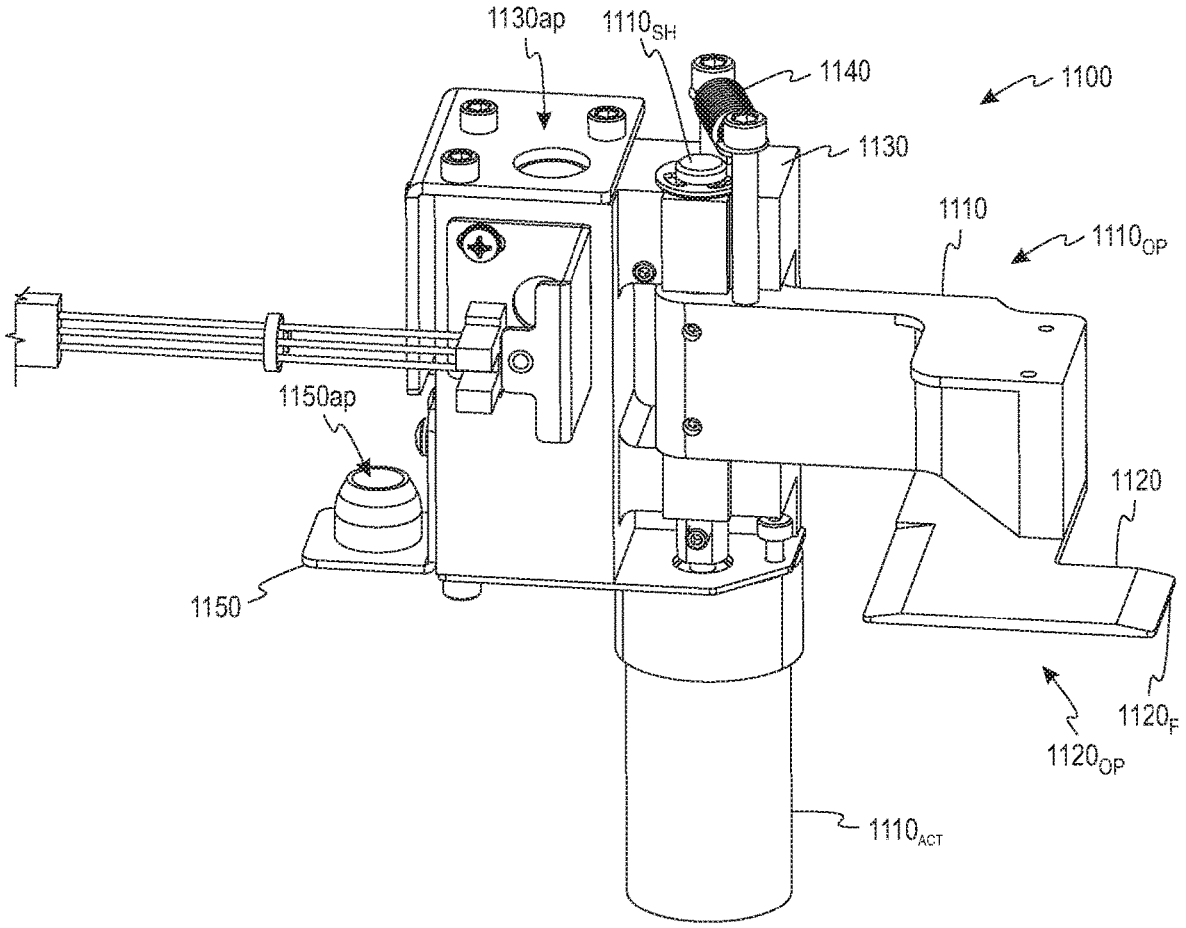
FIG. 11A illustrates a perspective view of various components of a plunger module with an anvil positioned in an operational position in accordance with various embodiments of this disclosure.
Figure 11B:
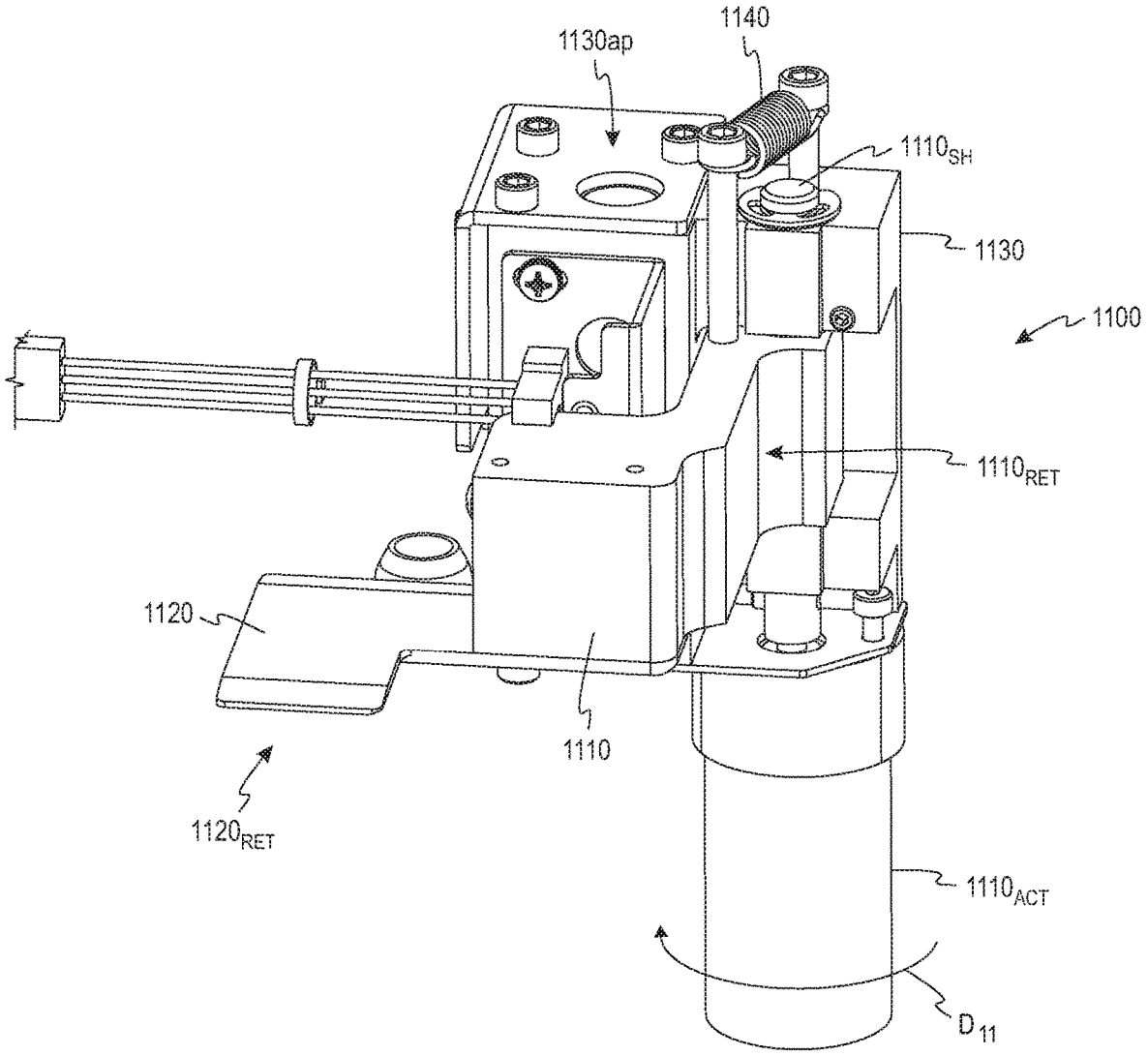
FIG. 11B illustrates a perspective view of various components of a plunger module with an anvil positioned in a return position in accordance with various embodiments of this disclosure.

FIG. 11A illustrates a perspective view of various components of a plunger module or assembly 1100 with the anvil 1120 positioned in a first operational position $\mathbf{1120}_{OP}$. FIG. 11B illustrates a perspective view of various components of a plunger module or assembly 1100 with the anvil 1120 positioned in a second return or tucked position $\mathbf{1120}_{RET}$. As indicated by arrow $D_{11}$ in FIG. 11B, the plunger assembly 1100 is configured to rotate the plunger arm 1110 and the anvil 1120 about a plunger arm shaft $\mathbf{1110}_{SH}$ to move the plunger arm 1110 and the anvil 1120 from respective operational plunger arm 1110 and anvil 1120 operational positions $\mathbf{1110}_{OP}$, $\mathbf{1120}_{OP}$ (shown in, e.g., FIGS. 11A, 4A, and 41) wherein the anvil 1120 extends into the stacking and strapping column 105 to respective return positions $\mathbf{1110}_{RET}$, $\mathbf{1120}_{RET}$ (shown in, e.g., FIGS. 11B, 4J and 4K) wherein the anvil does not extend into the stacking and strapping column 105. According to various embodiments, the movement of the anvil 1120 from extending into the stacking and strapping column 105 (FIGS. 11A and 41) to a position where the anvil does not extend into the stacking and strapping column 105 (see FIG. 11B and 4J) is accomplished using a pivoting plunger arm actuator $\mathbf{1110}_{ACT}$. According to various embodiments, the plunger arm 1110 and the anvil 1120 are rotated about plunger arm shaft $\mathbf{1110}_{SH}$ by about 90°.

With reference to FIGS. 5A, 11A, and 11B, according to various embodiments, the plunger assembly 1110 has a non-rotating base 1130 to which the plunger arm 1110 is pivotally coupled. To assist in constraining the base 1130 from rotating about a generally vertical axis such as shaft $\mathbf{1110}_{SH}$, the base may have two or more apertures 1130*ap* and 1150*ap* through which generally vertical shafts 530 and 550, respectively, extend. According to various embodiments, a belt 521 may be coupled to the plunger base 1130 via belt clamp 1134 and the belt may be driven by a plunger assembly motor $\mathbf{520}_M$ communicatively coupled to a processor, e.g., processor 1375 (FIG. 13). The plunger assembly motor $\mathbf{520}_M$ may be operated to raise and lower the plunger assembly 1100 and the anvil 1120 with the base 1130 sliding along generally vertical shafts 530, 550. Accordingly, according to various embodiments, the plunger assembly 1100 has a generally vertical linear motion.

According to various embodiments, an over-center spring 1140 is coupled between pivoting plunger arm 1110 and plunger base 1130. According to various embodiments, the over-center spring 1140 pulls the pivoting plunger arm 1110 into one of either of the two positions—the first operational position $\mathbf{1120}_{OP}$ or the second return or tucked position $\mathbf{1120}_{RET}$. According to various embodiments, when the pivoting plunger arm actuator $\mathbf{1110}_{ACT}$ rotates the pivoting plunger arm 1110, the plunger arm 1110 will be unstable in the middle of the stroke and stable at either end position. According to various embodiments, the over-center spring 1140 helps to ensure that only two possible positions are achieved for the pivoting plunger arm 1110 as disclosed herein in conjunction with over-center spring 638 in the cradle mechanism of FIG. 6A.

As disclosed herein, in FIG. 41, the anvil 1120 has been moved to an anvil lower rotation position $\mathbf{1120}_{LO\text{-}ROT}$ above a top of the lower left surface or wall 590 and below a bottom of the upper left surface or wall 592 with the anvil 1120 still being in an anvil operational position.

Figure 4J:
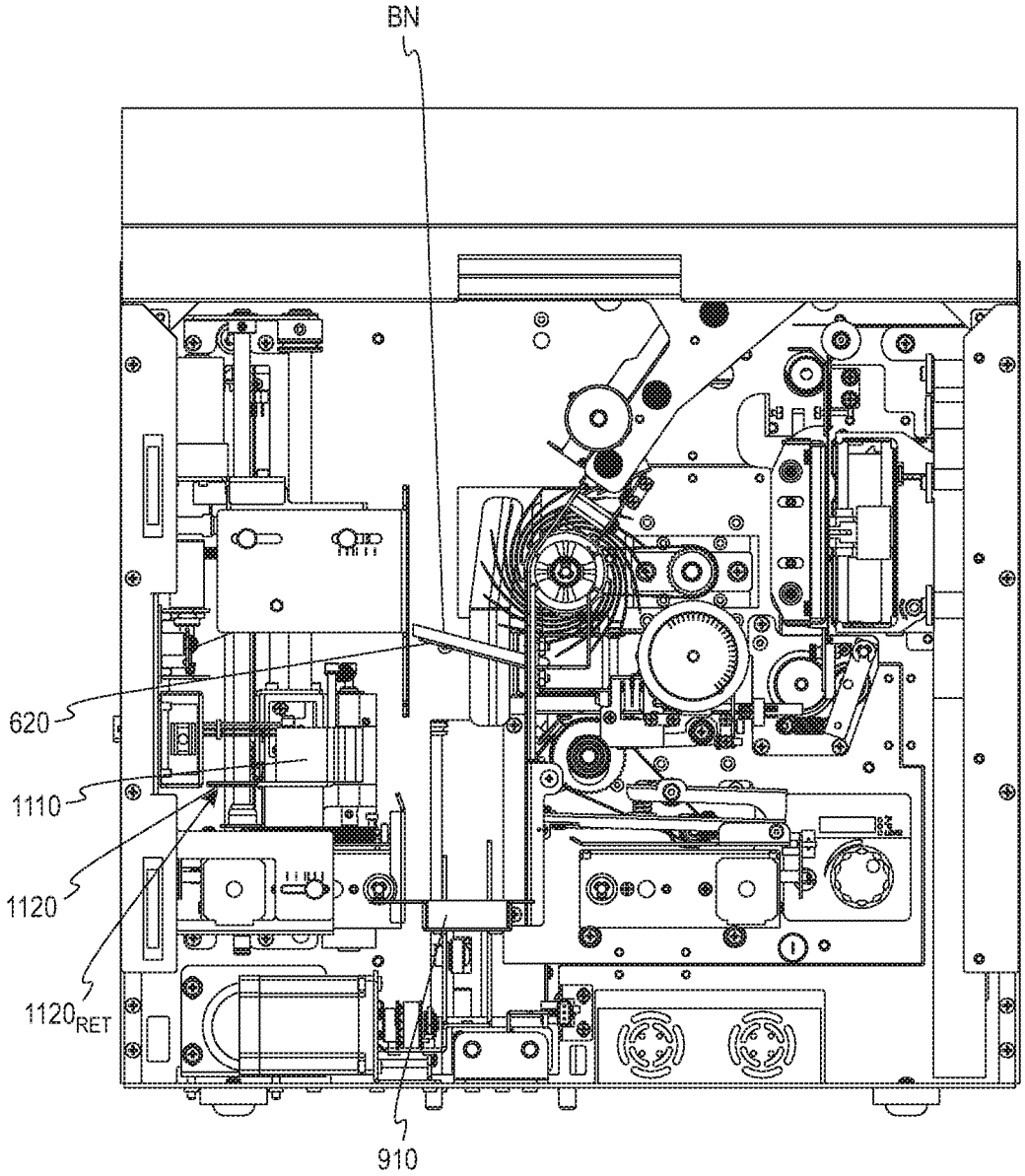

In FIG. 4J, the plunger arm 1110 and the anvil 1120 have been moved to their respective return or tucked positions $\mathbf{1110}_{RET}$, $\mathbf{1120}_{RET}$. The anvil 1120 is now clear of the stacking and strapping column 105 and the floor 910 can be returned to the floor home position $\mathbf{910}_{H}$.

Figure 4K:
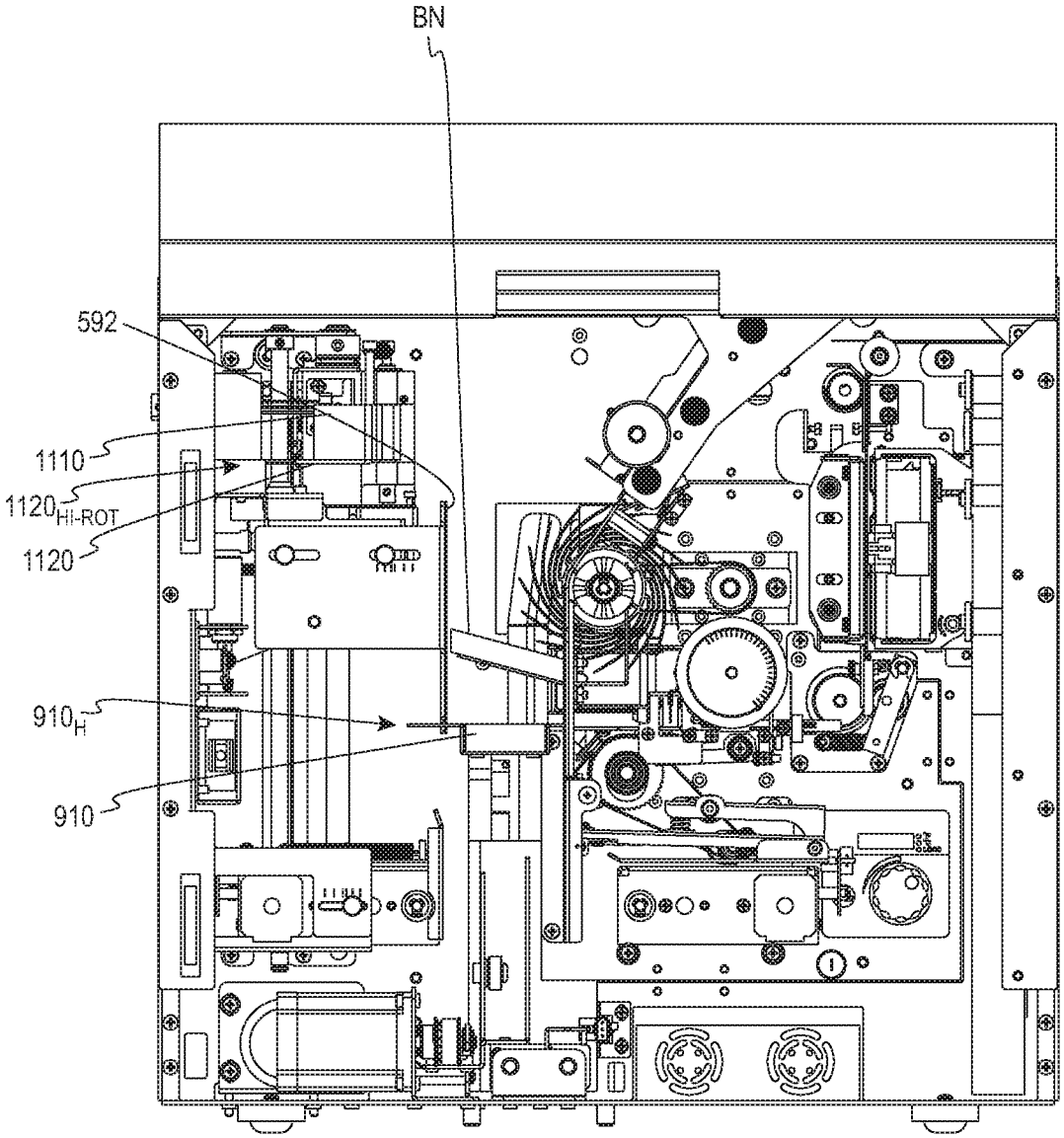

Next in FIG. 4K, the floor 910 has returned to the floor home position $\mathbf{910}_{H}$ and the plunger assembly 1100 has raised the anvil to the height of its anvil home position $\mathbf{1120}_{H}$ but with the anvil (and the plunger arm 1110) still in its return or tucked position $\mathbf{1120}_{RET}$. As shown in FIG. 4K, the anvil 1120 has been moved to an anvil upper rotation position $\mathbf{1120}_{HI\text{-}ROT}$ above a top of the upper left surface or wall 592 with the anvil 1120 still being in an anvil return or tucked position $\mathbf{1120}_{RET}$. At the anvil upper rotation position $\mathbf{1120}_{HI\text{-}ROT}$, the pivoting plunger arm 1110 has clearance to rotate back to its untucked or operational, home position $\mathbf{1120}_{H}$ shown in FIGS. 4A and 4B, thereby moving the anvil 1120 back to its operational, home position $\mathbf{1110}_{H}$ shown in FIGS. 4A and 4B.

According to various embodiments, the plunger arm 1110 and the anvil 1120 are rotated about $\mathbf{1110}_{SH}$ by about 90° in a first direction when the anvil is at the height of the anvil lower rotation position $\mathbf{1120}_{LO\text{-}ROT}$ and rotated by about 90° in a second, opposite direction when the anvil 1120 is at the height of the anvil upper rotation position $\mathbf{1120}_{HI\text{-}ROT}$.

According to various embodiments, to return the floor 910 to the floor home position $\mathbf{910}_{H}$, the eject traveler base 1040 is moved backward by the eject traveler motor $\mathbf{1035}_{M}$ communicatively coupled to and controlled by a processor, e.g., processor 1375 (FIG. 13). As the eject traveler base 1040 moves backward, the platform lowering bearing or roll 1030 rolls along the generally horizontal portion 930*b* of the ramp 930 and then the floor begins to rise as the spring 920 raises the floor 910 so that the angled portion 930*a* of the eject ramp 930 contacts the platform lowering bearing or roll 1030 (see, e.g., FIG. 3). When the eject traveler base 1040 has moved backward far enough that the angled portion 930*a* of the eject ramp 930 clears the platform lowering bearing or roll 1030, the spring 920 raises the floor 910 to the floor home position $\mathbf{910}_{H}$ shown in FIGS. 4A, 4B just below the cradle 620 which is in the cradle home position $\mathbf{620}_{H}$.

According to various embodiments, once the floor 910 has been returned to its floor home position $\mathbf{910}_{H}$, the cradle 620 may be moved from its cradle home position $\mathbf{620}_{H}$ (see FIG. 4A) to its retracted position $\mathbf{620}_{R}$ (see FIG. 4C) and thereby transfer any banknotes stacked thereon to become stacked on the floor 910.

When subsequent banknotes are being stacked on cradle 620 when the anvil 1120 returns to its anvil home position $\mathbf{1120}_{H}$ after a stack of banknotes has been strapped and ejected from the strapping device 100, the strapping device 100 returns to the condition illustrated in FIG. 4B, and the process of strapping banknotes continues as disclosed herein.

When there are no subsequent banknotes being stacked on cradle 620 when the anvil 1120 returns to its anvil home position $\mathbf{1120}_{H}$ after a stack of banknotes has been strapped and ejected from the strapping device 100, the strapping device 100 returns to the condition illustrated in FIG. 4A. Once subsequent banknotes begin to be stacked on cradle 620, the strapping device 100 returns to the condition illustrated in FIG. 4B, and the process of strapping banknotes continues as disclosed herein.

According to various embodiments, the banknote strapping device 100 has a cradle 620 that rapidly returns to its cradle home position $\mathbf{620}_{H}$ (see FIG. 4A) from its retracted position $\mathbf{620}_{R}$ (see FIG. 4C) after that anvil 1120 has moved below the cradle home position $\mathbf{620}_{H}$ so that banknotes can be quickly resumed to be stacked on the cradle 620. The ability of the cradle 620 to rapidly restore to the cradle home position $\mathbf{620}_{H}$ reduces pausing between strap cycles. According to various embodiments, after the first predetermined number (e.g., 100) of banknotes have been stacked on the floor 910 or cradle 620, a processor, e.g., processor 1375 (FIG. 13), communicatively coupled to the transport motor (s) of the strapping transport mechanism 170 instructs the transport motor to momentarily stop feeding banknotes along the strapping transport path to the stacker wheels 610 and/or instructs the stacker wheel motor $\mathbf{610}_{M}$ to momentarily stop feeding banknotes from the stacker wheels to the cradle 620 or floor 910. Once the anvil 1120 has moved below the cradle home position $\mathbf{620}_{H}$ and the cradle 620 has been returned to its cradle home position $\mathbf{620}_{H}$, the processor instructs the transport motor to resume feeding banknotes along the strapping transport path to the stacker wheels 610 and/or instructs the stacker wheel motor $\mathbf{610}_{M}$ to resume feeding banknotes from the stacker wheels 610 to the cradle 620.

Turning back to FIGS. 9A-9D, according to various embodiments, in order to facilitate the smooth transfer of a stack of banknotes from the cradle 620 to the floor 910, the floor 910 may have one or more cradle channels 910G-C therein to accommodate the arcuate movement of the cradle arms $\mathbf{620}_{A}$ and the ends or tips $\mathbf{620}_{T}$ of the cradle arms $\mathbf{620}_{A}$. As the cradle 620 having a stack of banknotes stacked thereon moves from its cradle home position $\mathbf{620}_{H}$ to its retracted position $\mathbf{620}_{R}$, the cradle arms $\mathbf{620}_{A}$ move through the cradle channels 910G-C of the floor 910 allowing the lowermost banknote in the stack to come to be supported on the upper surface of the floor 910. According to various embodiments, to enhance the stability of a stack of banknotes stack on the floor 910 and/or to accommodate wider banknotes, the floor 910 may be provided with one or more extensions 910EXT coupled to the floor.

According to various embodiments, in order to facilitate the forward movement of the one or more prongs 1010, 1012 of the eject traveler 1000 and facilitate the ability of the prongs 1010, 1012 to push a strapped stacked of banknotes off a forward end $\mathbf{910}_{FR}$ of the floor 910 during the process of ejecting a strapped stack of banknotes from the banknote strapping device 100, the floor 910 may have one or more eject prong channels 910G-F through which the prongs 1010, 1012 may travel. According to various embodiments, eject prong channels 910G-F are dimensioned to allow the one or more prongs 1010, 1012 to travel forward to near a midpoint of the floor 910 to ensure the strap $\mathbf{120}_C$ has been pushed off the front edge $\mathbf{1120}_F$ (see FIG. 11A) of the anvil 1120.

According to various embodiments, the floor support 912 is coupled to or formed integral with a floor support base 940. The floor support base 940 may have one or more apertures, e.g., apertures 940*ap*, 942*ap* therein.

With reference to FIGS. 9A-9D, and 5C, according to various embodiments, the floor support 912 is coupled to or formed integral with a non-rotating floor support base 940. According to various embodiments, to assist in constraining the floor support base 940 from rotating about a generally vertical axis such as shaft 540, the floor support base 940 may have two or more apertures 940*ap* and 942*ap* through which generally vertical shafts 540 and 542, respectively, extend. Although not shown in FIGS. 9A-9C, a second aperture 942*ap* may be positioned in a floor support base flange 940*fl* coupled to or formed integral with the floor support base (see FIG. 5C). According to various embodiments, a spring 920 may be coupled to the floor support 912. As disclosed herein, according to various embodiments, the downward movement of the anvil 1120 may push the floor 910 downward and the spring 920 may pull the floor 910 upward with the floor support base 940 sliding along generally vertical shafts 540, 542. Accordingly, according to various embodiments, the floor 910 and the floor support base 940 have a generally vertical linear motion (see arrow D9 in FIG. 9A). According to various embodiments, linear bearings may facilitate the smooth movement of the floor support base 940 up and down the shafts 540, 542. According to various embodiments, the use of spring 920 which always pulls the floor 910 upward assists with compressing a stack of notes during strapping and enables the floor to be returned to the floor home position $\mathbf{910}_H$ after a stack of notes has been strapped without the use of an actuator. According to various embodiments, the floor support base 940 travels up the generally vertical shaft 540 until it stops at a bumper $\mathbf{540}_{BUMP}$ residing on shaft 540 near the floor home position $\mathbf{910}_H$. According to various embodiments, the bumper $\mathbf{540}_{BUMP}$ assists with preventing the floor 910 from contacting the cradle 620 as the floor 910 returns to the floor home position $\mathbf{910}_H$.

According to various embodiments, the strapping device 100 has a width $W_1$ of about 20 inches (51 cm), a depth $D_1$ of about 20 inches (51 cm) and a height $H_1$ of about 22 inches (56 cm), see., e.g., FIGS. 1-2.

According to various embodiments, the banknote strapping device 100 is a compact, table-top device. With reference to FIGS. 1 and 2, according to various embodiments, a width $W_1$ of the banknote strapping device 100 is less than between about 20 inches (51 cm) and about 22 inches (56 cm). According to various embodiments, the width $W_1$ of the banknote strapping device 100 is less than or about 20 inches (51 cm). According to various embodiments, a depth $D_1$ of the banknote strapping device 100 is less than between about 20 inches (51 cm) and about 22 inches (56 cm). According to various embodiments, the depth $D_1$ of the banknote strapping device 100 is less than or about 20 inches (51 cm). According to various embodiments, a height $H_1$ of the banknote strapping device 100 is less than between about 22 inches (56 cm) and about 24 inches (61 cm). According to various embodiments, the height $H_1$ of the banknote strapping device 100 is less than or about 22 inches (56 cm).

According to various embodiments, the banknote strapping device 100 has a footprint of less than about 3 square feet. According to various embodiments, the banknote strapping device 100 has a footprint of less than about 2.9 square feet. According to various embodiments, the banknote strapping device 100 has a footprint of less than 2.8 square feet.

According to various embodiments, the banknote strapping device 100 occupies less than about 5.2 cubic feet. According to various embodiments, the banknote strapping device 100 occupies less than about 5.1 cubic feet. According to various embodiments, the banknote strapping device 100 occupies less than about 5.0 cubic feet. According to various embodiments, the banknote strapping device 100 occupies less than about 4.9 cubic feet (0.138 $m^3$).

According to various embodiments, the banknote strapping device 100 weighs between about 130 pounds (59 kg) and 145 pounds (66 kg). According to various embodiments, the banknote strapping device 100 weighs between about 135 pounds (61 kg) and 140 pounds (64 kg). According to various embodiments, the banknote strapping device 100 weighs about or less than about 145 pounds (66 kg). According to various embodiments, the banknote strapping device 100 weighs about or less than about 140 pounds (64 kg). According to various embodiments, the banknote strapping device 100 weighs about or less than about 135 pounds (61.2 kg).

According to various embodiments, the distance from the anvil home position $\mathbf{1120}_H$ to the lowest point on the floor support 912 when the floor is in the eject position is about or less than 13 inches. According to various embodiments, the distance from the anvil home position $\mathbf{1120}_H$ to the anvil strapping position $\mathbf{1120}_{STR}$ (also referred to as the plunger stroke) is about or less than about 9 inches. According to various embodiments, the distance from the anvil home position $\mathbf{1120}_H$ to the base of the inside of the housing 110 is about or less than about 14.4 inches.

According to various embodiments, the conveyance of a stack of notes to be strapped and a strapped stack of notes is reduced. Total conveyance is any movement of a stack of 100 notes from a point of accumulation to a final position after ejecting the strapped stack of notes onto a table or into a bin. According to various embodiments, the strapping device 100 has an internal vertical conveyance of about or less than about 3.8 inches when moving a stack of notes from a floor home position $\mathbf{910}_H$ to the floor strapping position $\mathbf{910}_{STR}$. According to various embodiments, the strapping device 100 has an internal horizontal conveyance of about or less than about 3 inches when the eject traveler pushes the strapped stack of banknotes off the floor 910 onto the ramp 185 at the front of the machine. Conversely, in other banknote strapping devices there is often an internal vertical conveyance from an escrow area (where banknotes to be strapped are stacked), then an internal horizontal conveyance to move the stack of banknotes to be strapped to a strapping mechanism, and then another internal horizontal conveyance to move the strapped stack of banknotes to a position over a collection bin.

According to various embodiments, the banknote strapping device 100 is referred to as a "single escrow" strapping device. According to various such embodiments, banknotes to be strapped by a strapping device 100 are all received from the strapping transport path and then are all stacked in a single escrow region, that is, the area of the cradle home position $\mathbf{620}_H$ whether they are received initially on the cradle 620 and then transferred to the floor 910 at the floor home position $\mathbf{910}_H$ or, especially for later bills in a stack, directly onto floor at the floor home position $\mathbf{910}_H$. According to various such embodiments, banknotes to be strapped by a strapping device 100 are all received from the strapping transport path and then are all stacked in a single escrow region located in a single stacking and strapping column 105. In this regard, note that the cradle home position $\mathbf{620}_H$ and the floor home position $\mathbf{910}_H$ are both located within the same stacking and strapping column 105.

Conversely, some prior banknote strapping devices employ two or more escrow stacking locations associated with a single strapping position and stack notes in, e.g., a second stacking or escrow location while banknotes previously received in, e.g., a first stacking or escrow location are being strapped at the single strapping position and then alternate stacking stacks of banknotes in the two or more escrow locations to permit a stack transport device to move from, e.g., a first escrow location to the single strapping position and then back to the first escrow location while pausing transporting banknotes to the first escrow location while the transport device is not present in the first escrow location and ready to receive a next stack of banknotes to be strapped and meanwhile stacking banknotes in a different (e.g., second) escrow stacking location.

Figure 12:
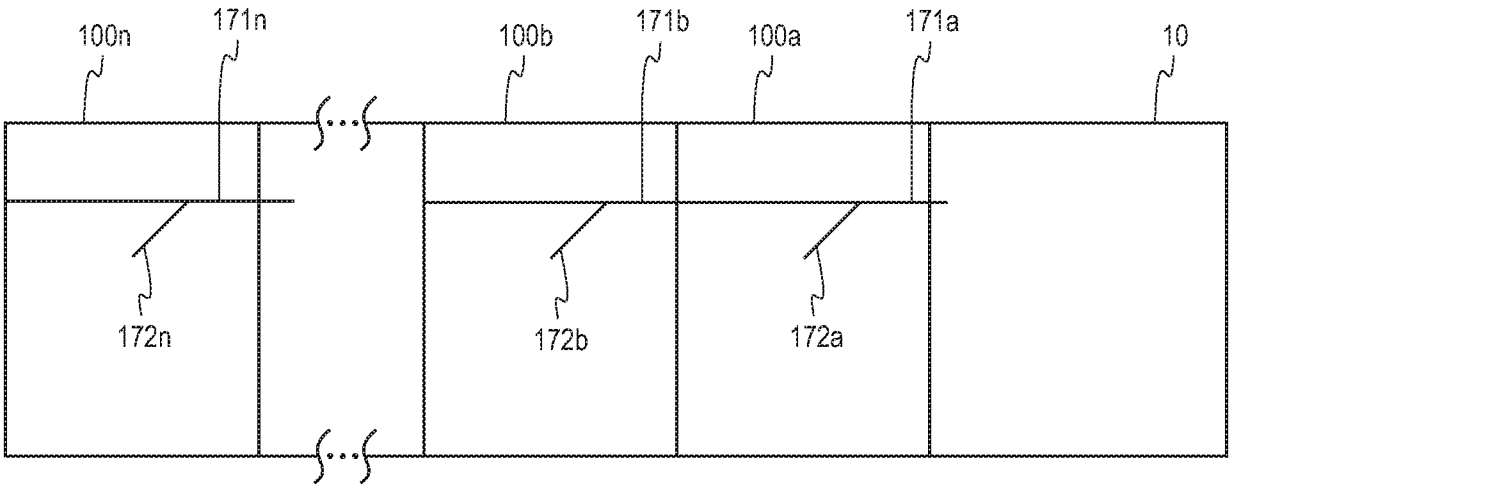
FIG. 12 illustrates a schematic representation of a banknote processing system comprising a banknote processing device and a plurality of banknote strapping devices in accordance with various embodiments of this disclosure.

FIG. 12 illustrates a schematic representation of a banknote processing system 1200 comprising a banknote processing device 10 and a plurality of banknote strapping devices 100*a* . . . 100*n*. According to various embodiments, the banknote processing device 10 and its components and its operation may be the same or similar to the document processing devices and/or document processing systems described in U.S. Pat. No. 8,544,656, incorporated herein by reference in its entirety, such as document processing devices 101, 301, 401 and/or document processing system 100 therein. According to various embodiments, the banknote processing device 10 and its components and its operation may be the same or similar to the document processing devices and/or document processing systems described in U.S. Pat. No. 7,686,151, incorporated herein by reference in its entirety, such as document judgment or handling devices 100, 100*a*, 100*d* and/or document processing systems 110*a*, 200 therein.

The banknote processing device 10 may comprise in input hopper or receptacle and one or more output receptacles, a transport mechanism configured to transport banknotes from the input hopper to the one or more output receptacles and/or out of the banknote processing device 10 to a first banknote strapping device 100*a*. According to various embodiments, banknote processing device 10 and/or banknote processing system 1200 may comprise a display assembly which may comprise a user interface. Banknotes or documents to be processed by the banknote processing device 10 are stacked within the input hopper. The transport mechanism then transports the banknotes or documents along a transport path, past one or more sensors or detectors, and to the one or more output receptacles and/or out of the banknote processing device to a first banknote strapping device 100*a*. Banknotes transported out of the banknote processing device 10 are received on a transport path 171*a* and then may either be transported along a first strapping transport path 172*a* or out of the first banknote strapping device 100*a* such as to a second banknote strapping device 100*b*. Banknotes transported to the second banknote strapping device 100*b* are received on a transport path 171*b* and then may either be transported along a second strapping transport path 172*b* or out of the second banknote strapping device 100*a* such as to a $n^{th}$ banknote strapping device 100*n* which is similar to the first and second banknote strapping devices 100*a*, 100*b*. The banknote strapping devices 100*a*, 100*b*, 100*n* may be similar or identical to the banknote strapping devices 100 disclosed herein. Banknotes transported along one of the strapping transport path 172*a*, 172*b*, 172*n* are transported to a cradle 620 or floor 910 of the associated banknote strapping device 100*a*-100*n*.

According to various embodiments, one or more processors (e.g., processors 1375) of the banknote processing device 10 control the operation of the banknote strapping device(s) 100, 100*a*-100*n* communicatively coupled thereto.

According to various embodiments, the banknote strapping devices 100*a*-100*n* may be configured to strap banknotes having the same or different types and/or denominations. For example, a first banknote strapping device 100*a* may be configured to strap US $20 banknotes, a second banknote strapping device 100*b* may be configured to strap US $1 banknotes, a third banknote strapping device 100*c* may be configured to strap US $5 banknotes, etc. As another example, a first banknote strapping device 100*a* may be configured to strap US $20 banknotes, a second banknote strapping device 100*b* may also be configured to strap US $20 banknotes, a third banknote strapping device 100*c* may be configured to strap US $5 banknotes. As another example, a first banknote strapping device 100*a* may be configured to strap US $20 banknotes, a second banknote strapping device 100*b* may also be configured to strap €20 banknotes, a third banknote strapping device 100*c* may be configured to strap €50 banknotes, and a fourth banknote strapping device 100*d* may be configured to strap ¥1000 banknotes.

According to various embodiments, banknotes to be transported by the transport mechanisms of devices 10, 100, and 100*a*-*n* are generally rectangularly shaped having two generally parallel wide or long edges and two generally orthogonal narrow or short edges and two banknote surfaces or faces. According to various embodiments, the banknote transport mechanisms transport banknotes in a wide-edge leading manner. According to various embodiments, the banknote transport mechanisms are configured to transport U.S. banknotes.

According to various embodiments, the transport mechanisms of devices 10, 100, and 100*a*-*n* are operated at high speeds and can transport banknotes at a rate of at least 1000 banknotes per minute along associated transport paths such as, for example, at a rate of at least 1000 U.S. banknotes per minute in a wide-edge leading manner.

According to various embodiments, the transport mechanisms of devices 10, 100, and 100*a*-*n* transport banknotes at a rate of at least 600 banknotes per minute along the transport path such as, for example, at a rate of at least 600 U.S. banknotes per minute in a wide-edge leading manner.

According to various embodiments, the transport mechanisms of devices 10, 100, and 100*a*-*n* transport banknotes at a rate of at least 800 banknotes per minute along the transport path such as, for example, at a rate of at least 800 U.S. banknotes per minute in a wide-edge leading manner.

According to various embodiments, the banknote processing device 10 comprises one or more sensors configured to retrieve information from processed banknotes to denominate the banknotes such as, for example, determining the denomination of U.S. banknotes of a plurality of denominations and generating a total of the value of a stack or batch of banknotes processed by the banknote strapping device 100.

FIG. 13 illustrates a block diagram of various components of a banknote processing system or device 1300 according to various embodiments. According to various embodiments, the banknote processing system 1200, banknote processing device 10, and/or strapping devices 100, 100*a*-100*n* comprise: one or more processors and/or controllers 1375 such as a CPU communicatively coupled to a memory 1374; components controlling the transport mechanism(s) such as one or motors controlling movement of various driven rollers and stacking wheels 610; one or more strapping device associated motors or actuators such as motors or actuators $\mathbf{520}_M$, $\mathbf{610}_M$, $\mathbf{620}_M$, 720, 820, $\mathbf{1035}_M$, $\mathbf{1110}_{ACT}$; one or more banknote or document sensors or detectors 1372; one or more encoders 1397; and/or a user or operator interface 1352. According to various embodiments, sensors or detectors 1372 include one or more denomination sensors, one or more image scanner(s), one or more authentication sensors, one or more density sensors, one or more fitness sensors, or a combination thereof.

According to various embodiments, the banknote strapping devices 100, 100*a*-100*n* provide the ability to strap banknotes to banknote processing devices and/or systems which previously only provided the ability to stack unstrapped banknotes in output receptacles. According to various embodiments, the addition of the banknote strapping devices 100, 100*a*-100*n* to banknote processing devices and/or systems increases operational through-put and improves security.

FIG. 14A illustrates a perspective view and FIG. 14B illustrates a front view of a strap feed and strap cut mechanism 1400 of a banknote strapping device 100 in accordance with various embodiments of this disclosure, and FIG. 14C illustrates a partial sectional view of a portion of a banknote strapping device 100 in accordance with various embodiments of this disclosure. According to various embodiments, strapping material is cut when a cam 459 is rotated and lifts a follower lever $\mathbf{120}_{FL}$ which drives the strapping material 120 into a serrated edge of a strap cutter $\mathbf{120}_{CUT}$. In FIG. 14C, strapping material 120 is illustrated positioned in a strapping material transport path located partially below guide plate 1410. According to various embodiments, the cam follower lever $\mathbf{120}_{FL}$ forces a gripper block 1402 and the strapping material 120 against spring-loaded grippers 1404. Together the gripper block 1402 and the spring-loaded grippers 1404 grasp the strapping material 120 and force the strapping material 120 through the serrated edge of the strap cutter $\mathbf{120}_{CUT}$.

According to various embodiments, strapping material 120 and/or cut straps $\mathbf{120}_C$ may be fed along a strapping material transport path by one or more strapping material feed rollers $\mathbf{120}_{FEED}$ (see, e.g., FIGS. 4B and 14C).

As disclosed herein, according to various embodiments, strapping material 120 and/or cut straps $\mathbf{120}_C$ may be fed along a strapping material path by one or more strapping material feed rollers $\mathbf{120}_{FEED}$ (see, e.g., FIG. 4B). According to various embodiments, the roll $\mathbf{120}_R$ (see, e.g., FIG. 3) is installed perpendicular to the orientation of the strapping material path as the strapping material path approaches the vertical stacking and strapping column 105 and the floor 910 in the floor home position $\mathbf{910}_H$ rather than parallel with the strapping material path in that area. According to various embodiments, the perpendicular orientation of the roll $\mathbf{120}_R$ enables for the size of the banknote strapping device 100 and the housing 110 to be reduced. According to various alternative embodiments, the roll $\mathbf{120}_R$ is installed parallel to the orientation of the strapping material path as the strapping material path approaches the vertical stacking and strapping column 105 and the roll $\mathbf{120}_R$ is positioned below the hot fold module 800 and the height of the banknote strapping device 100 is nearly doubled. According to various embodiments, further space is saved by ejecting the completed strapped banknotes out the front of the banknote strapping device 100 onto a table rather than ejecting strapped banknotes laterally out of the side of the banknote strapping device 100 into a bin positioned below the banknote strapping device 100.

Figure 15A:
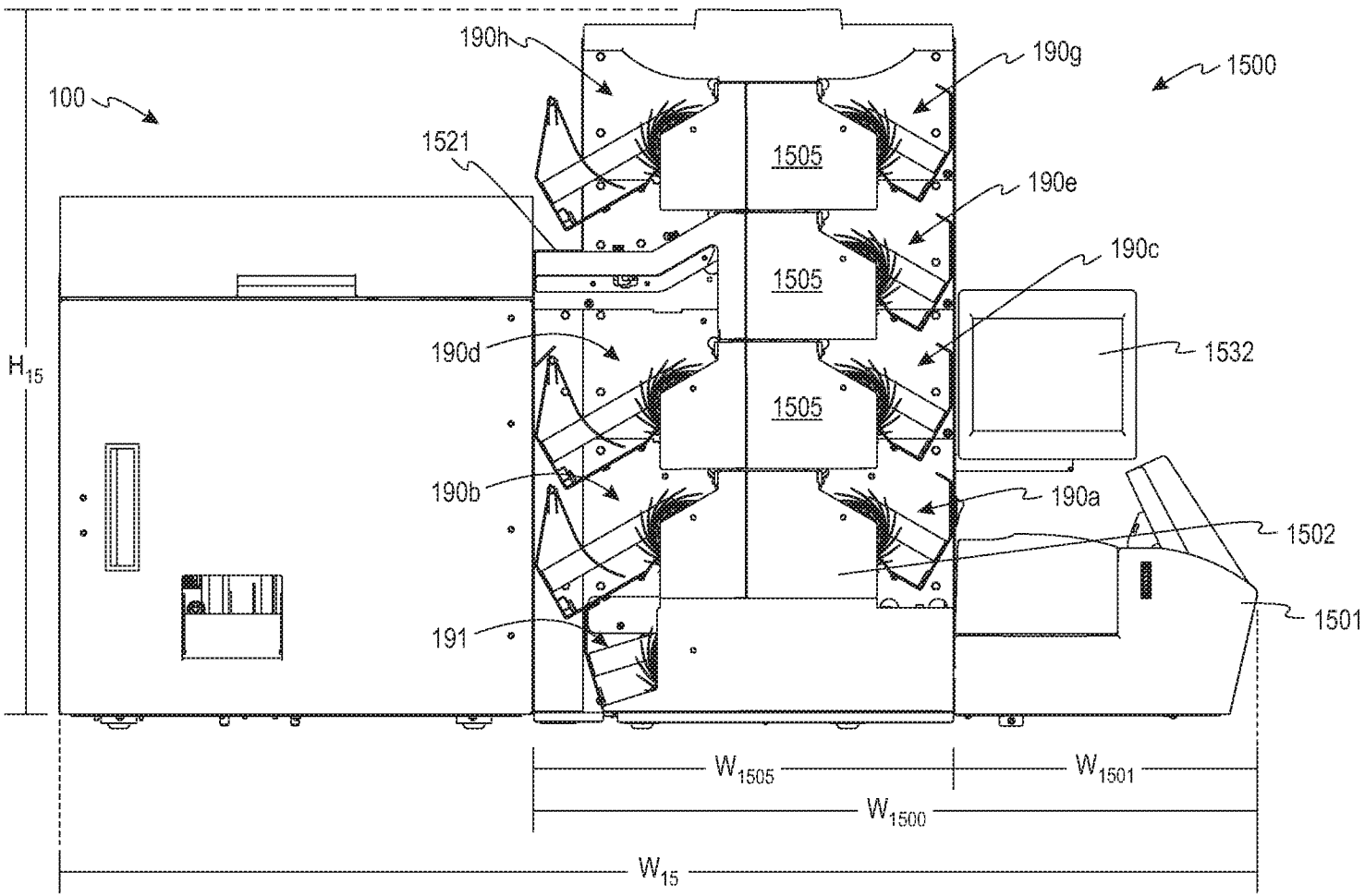
FIG. 15A illustrates a front view of a banknote strapping device and a document processing system in accordance with various embodiments of this disclosure.
Figure 15B:
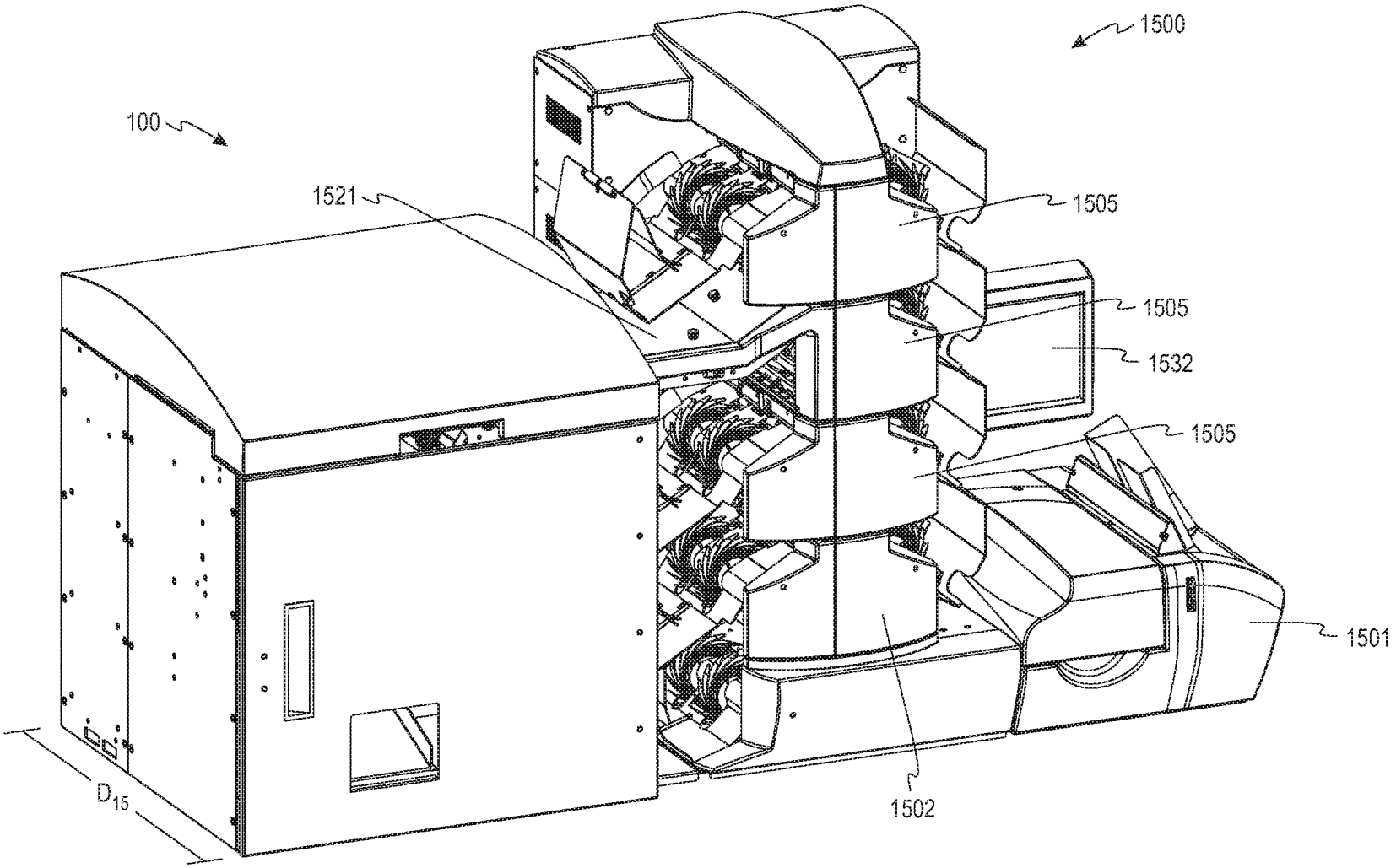
FIG. 15B illustrates a perspective view of a banknote strapping device and a document processing system in accordance with various embodiments of this disclosure.
Figure 16A:
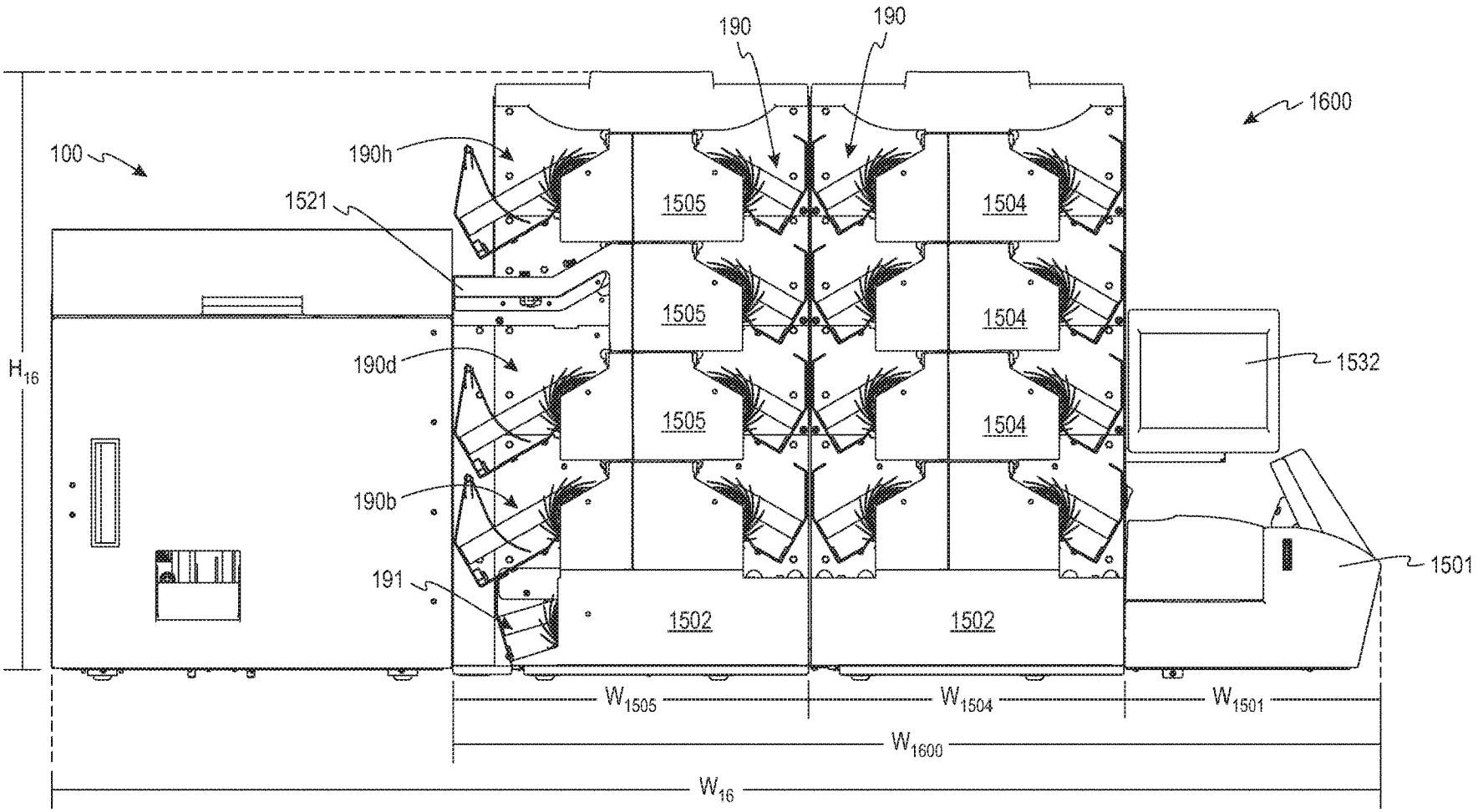
FIG. 16A illustrates a front view of a banknote strapping device and a document processing system in accordance with various embodiments of this disclosure.
Figure 16B:
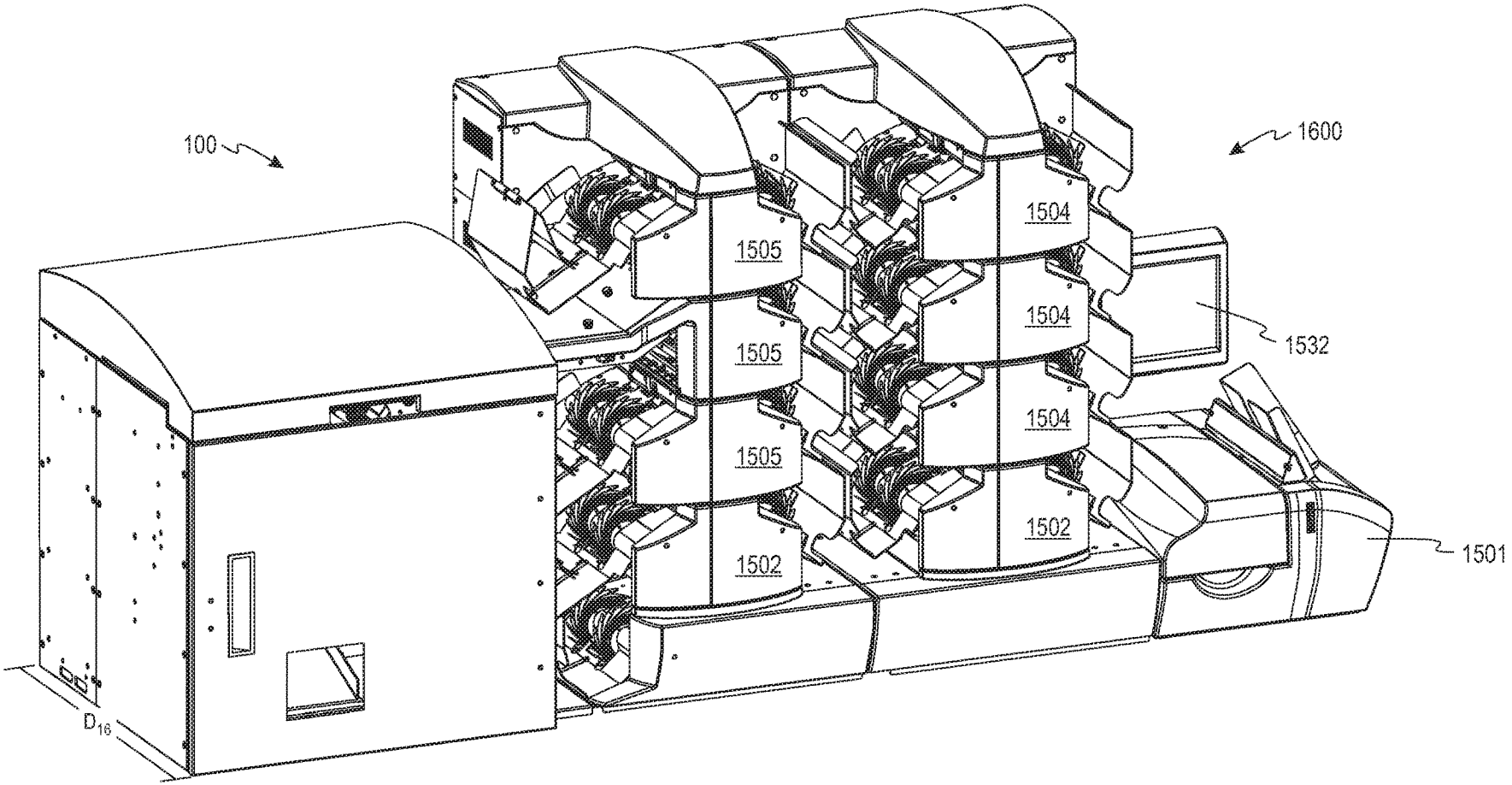
FIG. 16B illustrates a perspective view of a banknote strapping device and a document processing system in accordance with various embodiments of this disclosure.

FIG. 15A illustrates a front view and FIG. 15B illustrates a perspective view of a banknote strapping device 100 and a document processing system 1500 according to various embodiments. FIG. 16A illustrates a front view and FIG. 16B illustrates a perspective view of a banknote strapping device 100 and a document processing system 1600 according to various embodiments. According to various embodiments, the document processing systems 1500, 1600 and their components and their operation may be the same or similar to the document processing devices and/or document processing systems described in U.S. Pat. No. 8,544,656, incorporated herein by reference in its entirety. According to various embodiments, the document processing system 1500 comprises a document processing device 1501, a first base module 1502, and a plurality of pocket modules 1505 which components and operation may be the same or similar to the document processing device 101, 401, base module 102, 402, and pocket modules 104, 404 described in U.S. Pat. No. 8,544,656. According to various embodiments, the document processing system 1600 comprises a document processing device 1501, a first base module 1502, a second base module 1502, and a plurality of pocket modules 1504, 1505 which components and operation may be the same or similar to the document processing device 101, 401, base module 102, 402, and pocket modules 104, 404 described in U.S. Pat. No. 8,544,656. The base module 1502 and pocket modules 1504, 1505 comprises a plurality of output receptacles 190*a*-190*h* and 191. As illustrated in FIGS. 15A-15B and FIGS. 16A-16B, one of the output receptacles 190 in a pocket module 104, 404 described in U.S. Pat. No. 8,544,656 has been removed and replaced by a transport mechanism 1521 configured to transport banknotes to the strapping device 100 such as to transport path 171*a* shown in FIG. 12. Additionally, according to various embodiments, various of the output receptacles, namely, output receptacles 190*b*, 190*d*, and 190*h* have an increased capacity of about 500 banknotes compared with output receptacles 190*a*, 190*c*, 190*e*, and 190*g* which have a capacity of about 100 banknotes. As illustrated, the document processing system 1500 comprises eight (8) output receptacles 190 and 191 and the document processing system 1600 comprises sixteen (16) output receptacles 190 and 191.

According to various embodiments, the document processing system 1500 has a width $W_{1500}$ of about or less than about or about 31 inches (79 cm), a depth $D_{1500}$ of about or less than about 17.5 inches (45 cm) and a height $H_{1500}$ of about or less than about 30½ inches (78 cm) or 31 inches (79 cm). According to various embodiments, the width $W_{1500}$ of document processing system 1500 comprises a width $W_{1501}$ of document processing device 1501 of about or less than about 13 inches and a width $W_{1505}$ of the pocket modules 1505 of about or less than about 18 inches (46 cm). According to various embodiments, the combination of the banknote strapping device 100 and a document processing system 1500 has a width $W_{15}$ of about or less than about 51½ inches (131 cm) or 51 inches (130 cm), a depth $D_{15}$ of less than about or about 20 inches (51 cm) and a height $H_{15}$ of less than about or about 30½ inches (78 cm) or 31 inches (79 cm).

According to various embodiments, the document processing system 1600 has a width $W_{1600}$ of about or less than about or about 47 inches (120 cm), a depth $D_{1500}$ of about or less than about 17.5 inches (45 cm) and a height $H_{1500}$ of about or less than about 30½ inches (78 cm) or 31 inches (79 cm). According to various embodiments, the width $W_{1600}$ of document processing system 1500 comprises a width $W_{1501}$ of document processing device 1501 of about or less than about 13 inches, a width $W_{1504}$ of the pocket modules 1504 of about or less than about 16 inches (41 cm), and a width $W_{1505}$ of the pocket modules 1505 of about or less than about 18 inches (46 cm). According to various embodiments, the combination of the banknote strapping device 100 and a document processing system 1600 has a width $W_{16}$ of about or less than about 67 inches (170 cm) or 51 inches (130 cm), a depth $D_{15}$ of less than about or about 20 inches (51 cm) and a height $H_{15}$ of less than about or about 30½ inches (78 cm) or 31 inches (79 cm).

While the concepts disclosed herein are susceptible to various modifications and alternative forms, specific embodiments thereof have been shown by way of example in the drawings and herein described in detail. It should be understood, however, that it is not intended to limit the inventions to the particular forms disclosed, but on the contrary, the intention is to cover all modifications, equivalents, and alternatives falling within the spirit and scope of the inventions as defined by the appended claims.

In one example embodiment, a banknote strapping device comprises a generally vertical stacking and strapping column, a banknote floor residing within the generally vertical stacking and strapping column and moveable generally vertically within the column, the banknote floor being biased upward to a floor home position, a banknote cradle having a cradle stacking position and a cradle retracted position, wherein when in the cradle stacking position, the banknote cradle is positioned within the stacking and strapping column above the banknote floor so that banknotes from a transport path may be stacked on the cradle, wherein when in the cradle retracted position, the banknote cradle is not positioned in the stacking and strapping column, a plunger assembly having an anvil, wherein the plunger assembly is configured to move the anvil generally vertically downward within the stacking and strapping column from an upper anvil home position above the cradle stacking position of the cradle to a lower strapping position, wherein when a first predetermined number of banknotes have been stacked on the cradle, the cradle retracts from the cradle stacking position and the cradle retracted position and wherein as the cradle moves from the cradle stacking position to the cradle retracted position, a stack of banknotes that had been stacked thereupon is transferred to the banknote floor positioned at the floor home position, wherein the anvil then travels generally vertically downward and contacts a top banknote in the stack of banknotes on the floor and pushes the stack of banknotes and the floor to a strapping position at which the stack of banknotes is strapped, wherein the cradle returns to the cradle stacking position while the anvil is positioned below the cradle stacking position, and wherein, after the stack of banknotes has been strapped, the plunger assembly pivots the anvil out of the stacking and strapping column, then raises the anvil above the cradle stacking position, and then pivots the anvil back into the stacking and strapping column.

In one or more of the above examples, after the anvil pivots out of the stacking and strapping column, the floor returns to the floor home position.

In one or more of the above examples, the cradle moves (1) from the cradle stacking position to the cradle retracted position when the anvil is positioned above the cradle stacking position and (2) back from the cradle retracted position to the cradle stacking position when the anvil is positioned below the cradle stacking position in less than about half of a second.

In one or more of the above examples, the cradle moves (1) from the cradle stacking position to the cradle retracted position when the anvil is positioned above the cradle stacking position and (2) back from the cradle retracted position to the cradle stacking position when the anvil is positioned below the cradle stacking position in less than about 0.3 seconds.

In another example embodiment, a banknote strapping device comprises a banknote floor moveable generally parallel to a first linear direction from a floor home position to a floor strapping position, a banknote cradle having a cradle stacking position, wherein when in the cradle stacking position, the banknote cradle is positioned near the floor home position so that banknotes from a transport path may be stacked on the cradle, a plunger assembly having an anvil, wherein the plunger assembly is configured to move the anvil generally parallel to the first linear direction from a first anvil home position on a first side of the cradle stacking position of the cradle to a second anvil strapping position located on a second side of the cradle stacking position, wherein when a first predetermined number of banknotes have been stacked on the cradle, the cradle retracts from the cradle stacking position and wherein as the cradle moves from the cradle stacking position, a stack of banknotes that had been stacked thereupon is transferred to the banknote floor positioned at the floor home position, wherein the anvil then travels generally parallel to the first linear direction and contacts the stack of banknotes on the floor and moves the stack of banknotes and the floor to a strapping position with the anvil at the anvil strapping position and the floor at the floor strapping position at which the stack of banknotes is strapped, wherein the floor home position, the floor strapping position, the cradle home position, the anvil home position, and the anvil strapping position are arranged linearly generally parallel to the first linear direction.

In one or more of the above examples, a stack of banknotes strapped at the strapping position are ejected from the device directly from the strapping position.

In another example embodiment, a banknote strapping device comprises a banknote floor moveable generally parallel to a first linear direction from a floor home position to a floor strapping position, a banknote escrow having an escrow stacking position, wherein when in the escrow stacking position, the banknote escrow is positioned near the banknote floor home position so that banknotes from a transport path may be stacked on the banknote escrow, an anvil configured to move generally parallel to the first linear direction from a first anvil home position on a first side of the escrow stacking position to a second anvil strapping position located on a second side of the escrow stacking position, wherein when a first predetermined number of banknotes have been stacked on the banknote escrow, a stack of banknotes that had been stacked thereupon is transferred to the banknote floor positioned at the floor home position, wherein the anvil then travels generally parallel to the first linear direction and contacts the stack of banknotes on the floor and moves the stack of banknotes and the floor to a strapping position at which the stack of banknotes is strapped, wherein the floor home position, the floor strapping position, the escrow stacking position, the anvil home position, and the anvil strapping position are arranged linearly generally parallel to the first linear direction.

In one or more of the above examples, a stack of banknotes strapped at the strapping position is ejected from the device directly from the strapping position.

In another example embodiment, a method of strapping banknotes using a banknote strapping device comprising a banknote floor moveable generally parallel to a first linear direction from a floor home position to a floor strapping position; a banknote cradle having a cradle stacking position; and a plunger assembly having an anvil comprises stacking banknotes on the banknote cradle when the cradle is in the cradle stacking position positioned near the floor home position, when a first predetermined number of banknotes have been stacked on the cradle, retracting the cradle from the cradle stacking position and transferring a stack of banknotes that had been stacked on the cradle to the banknote floor positioned at the floor home position, moving the anvil generally parallel to the first linear direction from an anvil home position on a first side of the cradle stacking position of the cradle toward a second anvil strapping position located on a second side of the cradle stacking position, while moving the anvil, the anvil contacting a stack of banknotes on the floor and moving the stack of banknotes and the floor to a strapping position at which the stack of banknotes is strapped with the anvil being positioned at the anvil strapping position and the floor being positioned at the floor strapping position, and strapping the stack of banknotes at the strapping position, wherein the floor home position, the floor strapping position, the cradle home position, the anvil home position, and the anvil strapping position are arranged linearly generally parallel to the first linear direction.

In one or more of the above examples, the method further comprises ejecting a stack of banknotes strapped at the strapping position from the banknote strapping device directly from the strapping position.

In one or more of the above examples, the ejecting comprises moving the stack of banknotes strapped at the strapping position linearly out of the banknote strapping device.

In one or more of the above examples, the method further comprises moving the cradle from a retracted position back to the cradle stacking position after the anvil has moved past the cradle stacking position.

In one or more of the above examples, the cradle is retracted the cradle from the cradle stacking position and moved back to the cradle stacking position in less than 1 second.

In one or more of the above examples, the cradle is retracted the cradle from the cradle stacking position and moved back to the cradle stacking position in less than 0.3 seconds/

In one or more of the above examples, the method further comprises stacking banknotes on the stack of banknotes transferred from the cradle to the floor, pausing the stacking of banknotes after a second predetermined number of banknotes have been accumulated on the floor, wherein the act of the anvil contacting a stack of banknotes on the floor occurs after the act of pausing.

In one or more of the above examples, the method further comprises moving the cradle from a retracted position back to the cradle stacking position after the anvil has moved past the cradle stacking position, and resuming stacking banknotes on the banknote cradle after the cradle has been moved back to the cradle stacking position.

In one or more of the above examples, the time between the acts of pausing the stacking and resuming stacking banknotes is less than 1 second.

In one or more of the above examples, the time between the acts of pausing the stacking and resuming stacking banknotes in less than 0.3 seconds.

In another example embodiment, a banknote strapping device comprises a banknote floor moveable generally parallel to a first linear direction from a floor home position to a floor strapping position, a banknote cradle having a cradle stacking position, wherein when in the cradle stacking position, the banknote cradle is positioned near the floor home position so that banknotes from a transport path may be stacked on the banknote cradle, and a plunger assembly having an anvil, wherein the plunger assembly is configured to move the anvil generally parallel to the first linear direction from an anvil home position on a first side of the cradle stacking position of the banknote cradle to an anvil strapping position located on a second side of the cradle stacking position, wherein when a first predetermined number of banknotes have been stacked on the banknote cradle, a stack of banknotes that had been stacked thereupon is transferred to the banknote floor positioned at the floor home position, wherein the anvil travels generally parallel to the first linear direction and contacts the stack of banknotes on the banknote floor and moves the stack of banknotes and the banknote floor to a strapping position with the anvil at the anvil strapping position and the banknote floor at the floor strapping position at which the stack of banknotes is strapped, and wherein the floor home position, the floor strapping position, the cradle stacking position, the anvil home position, and the anvil strapping position are arranged linearly generally parallel to the first linear direction.

In one or more of the above examples, to transfer the stack of banknotes from the banknote cradle to the banknote floor positioned at the floor home position, the banknote cradle retracts from the cradle stacking position to a cradle retracted position, and wherein the stack of banknotes is transferred to the banknote floor as the banknote cradle moves from the cradle stacking position to the cradle retracted position.

In one or more of the above examples, the banknote strapping device further comprises a generally vertical stacking and strapping column, wherein the banknote floor is disposed within the generally vertical stacking and strapping column.

In one or more of the above examples, when the banknote cradle is in the cradle stacking position, the banknote cradle is positioned within the generally vertical stacking and strapping column above the banknote floor, and wherein, when the banknote cradle is in the cradle retracted position, the banknote cradle is positioned outside the generally vertical stacking and strapping column.

In one or more of the above examples, after the stack of banknotes has been strapped, the plunger assembly pivots the anvil out of the stacking and strapping column, raises the anvil above the cradle stacking position, and pivots the anvil back into the stacking and strapping column.

In one or more of the above examples, after the anvil pivots out of the stacking and strapping column, the banknote floor returns to the floor home position.

In one or more of the above examples, the banknote strapping device further comprises one or more fold units, wherein, at the anvil strapping position, the anvil is aligned with the one or more fold units and the one or more fold units fold a strap on the stack of banknotes.

In one or more of the above examples, the one or more fold units includes a cold fold unit and a hot fold unit, wherein the hot fold unit includes a heating element, wherein the cold fold unit moves to press a first side of the strap on the stack of banknotes, and wherein the hot fold unit moves to press a second side of the strap on the stack of banknotes and heat seal at least a portion of the strap.

In one or more of the above examples, the stack of banknotes strapped at the strapping position are ejected from the banknote strapping device directly from the strapping position.

In one or more of the above examples, ejecting the stack of banknotes includes moving the stack of banknotes strapped at the strapping position linearly out of the banknote strapping device.

In one or more of the above examples, ejecting the stack of banknotes includes ejecting the stack of banknotes on a dispensing ramp.

In another example embodiment, a method of strapping banknotes using a banknote strapping device including a banknote floor moveable generally parallel to a first linear direction from a floor home position to a floor strapping position, a banknote cradle having a cradle stacking position, and a plunger assembly having an anvil, comprises stacking banknotes on the banknote cradle when the banknote cradle is in the cradle stacking position positioned near the floor home position, when a first predetermined number of banknotes have been stacked on the banknote cradle, retracting the banknote cradle from the cradle stacking position and transferring a stack of banknotes that had been stacked on the banknote cradle to the banknote floor positioned at the floor home position, moving the anvil generally parallel to the first linear direction from an anvil home position on a first side of the cradle stacking position of the banknote cradle toward a second anvil strapping position located on a second side of the cradle stacking position, contacting, by the anvil during movement of the anvil, the stack of banknotes on the banknote floor and moving the stack of banknotes and the banknote floor to a strapping position at which the stack of banknotes is strapped with the anvil being positioned at the anvil strapping position and the banknote floor being positioned at the floor strapping position, and strapping the stack of banknotes at the strapping position, wherein the floor home position, the floor strapping position, the cradle stacking position, the anvil home position, and the anvil strapping position are arranged linearly generally parallel to the first linear direction.

In one or more of the above examples, the method further comprises ejecting the stack of banknotes strapped at the strapping position from the banknote strapping device directly from the strapping position.

In one or more of the above examples, ejecting the stack of banknotes includes moving the stack of banknotes strapped at the strapping position linearly out of the banknote strapping device.

In one or more of the above examples, ejecting the stack of banknotes includes ejecting the stack of banknotes on a dispensing ramp.

In one or more of the above examples, the method further comprises moving the banknote cradle from a retracted position back to the cradle stacking position after the anvil has moved past the cradle stacking position.

In one or more of the above examples, the method further comprises stacking banknotes on the stack of banknotes transferred from the banknote cradle to the banknote floor, and pausing the stacking of banknotes after a second predetermined number of banknotes have been accumulated on the banknote floor, wherein the anvil contacts the stack of banknotes on the banknote floor after pausing the stacking of banknotes.

In one or more of the above examples, the method further comprises moving the banknote cradle from a retracted position back to the cradle stacking position after the anvil has moved past the cradle stacking position, and resuming stacking banknotes on the banknote cradle after the banknote cradle has been moved back to the cradle stacking position.

In one or more of the above examples, strapping the stack of banknotes at the strapping position includes aligning the anvil with one or more fold units at the anvil strapping position, and folding, by the one or more fold units, a strap on the stack of banknotes.

In one or more of the above examples, the one or more fold units includes a cold fold unit and a hot fold unit, and wherein the hot fold unit includes a heating element, and the method further comprises moving the cold fold unit to press a first side of the strap on the stack of banknotes, and moving the hot fold unit to press a second side of the strap on the stack of banknotes and heat seal at least a portion of the strap.

What is claimed:

1. A banknote strapping device comprising:

a banknote floor moveable between a floor home position and a floor strapping position, wherein a floor spring biases the banknote floor towards the floor home position;

a stacking and strapping column, wherein the banknote floor is disposed within the stacking and strapping column;

a banknote cradle having a cradle stacking position, wherein when in the cradle stacking position, the banknote cradle is positioned near the floor home position in the stacking and strapping column so that banknotes from a transport path may be stacked on the banknote cradle; and a plunger assembly having an anvil, wherein the plunger assembly is configured to move the anvil from an anvil home position in the stacking and strapping column on a first side of the cradle stacking position of the banknote cradle to an anvil strapping position located on a second side of the cradle stacking position, wherein when a first predetermined number of banknotes have been stacked on the banknote cradle, a stack of banknotes that had been stacked thereupon is transferred to the banknote floor positioned at the floor home position, wherein the anvil travels and contacts the stack of banknotes on the banknote floor causing the banknote floor to be pressed against the bias of the floor spring and the anvil further travels and overcomes the bias of the floor spring to move the stack of banknotes and the banknote floor to a strapping position, wherein the stack of banknotes is strapped when the anvil is at the anvil strapping position and the banknote floor is at the floor strapping position, and wherein, after the stack of banknotes has been strapped, the plunger assembly horizontally pivots the anvil, about a plunger arm shaft disposed vertically with respect to the stacking and strapping column, out of the stacking and strapping column to avoid contact with the banknote cradle in the stacking and strapping column, raises the anvil above the cradle stacking position of the banknote cradle, and pivots the anvil back into the stacking and strapping column.

2. The banknote strapping device of claim 1, wherein, to transfer the stack of banknotes from the banknote cradle to the banknote floor positioned at the floor home position, the banknote cradle retracts from the cradle stacking position to a cradle retracted position, and wherein the stack of banknotes is transferred to the banknote floor as the banknote cradle moves from the cradle stacking position to the cradle retracted position.

3. The banknote strapping device of claim 2, wherein, when the banknote cradle is in the cradle stacking position, the banknote cradle is positioned within the stacking and strapping column above the banknote floor, and wherein, when the banknote cradle is in the cradle retracted position, the banknote cradle is positioned outside the stacking and strapping column.

4. The banknote strapping device of claim 2, wherein after the anvil pivots out of the stacking and strapping column, the banknote floor returns to the floor home position.

5. The banknote strapping device of claim 1, further comprising one or more fold units, wherein, at the anvil strapping position, the anvil is aligned with the one or more fold units and the one or more fold units fold a strap on the stack of banknotes.

6. The banknote strapping device of claim 5, wherein the one or more fold units includes a cold fold unit and a hot fold unit, wherein the hot fold unit includes a heating element, wherein the cold fold unit moves to press a first side of the strap on the stack of banknotes, and wherein the hot fold unit moves to press a second side of the strap on the stack of banknotes and heat seal at least a portion of the strap.

7. The banknote strapping device of claim 1, wherein the stack of banknotes strapped at the strapping position are ejected from the banknote strapping device directly from the strapping position.

8. The banknote strapping device of claim 7, wherein ejecting the stack of banknotes includes moving the stack of banknotes strapped at the strapping position linearly out of the banknote strapping device.

9. The banknote strapping device of claim 7, wherein ejecting the stack of banknotes includes ejecting the stack of banknotes on a dispensing ramp.

* * * * *